US007380387B2

(12) United States Patent
Ishii et al.

(10) Patent No.: US 7,380,387 B2
(45) Date of Patent: Jun. 3, 2008

(54) SHEET PACKAGE PRODUCING SYSTEM, SHEET HANDLING DEVICE, AND FILLET FOLDING DEVICE

(75) Inventors: Yoshiyuki Ishii, Shizuoka (JP); Hiroyuki Nishida, Shizuoka (JP); Takao Asakura, Shizuoka (JP); Hideyuki Uezono, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/376,084

(22) Filed: Mar. 16, 2006

(65) Prior Publication Data

US 2006/0156692 A1 Jul. 20, 2006

Related U.S. Application Data

(62) Division of application No. 11/069,564, filed on Mar. 2, 2005, now Pat. No. 7,069,708, which is a division of application No. 10/189,404, filed on Jul. 8, 2002, now Pat. No. 6,907,711.

(30) Foreign Application Priority Data

Jul. 9, 2001 (JP) ..... 2001-207328
Jul. 9, 2001 (JP) ..... 2001-207558
Jul. 11, 2001 (JP) ..... 2001-211127

(51) Int. Cl.
*B65B 63/04* (2006.01)

(52) U.S. Cl. ..... 53/116; 53/136.3; 53/136.5; 53/491

(58) Field of Classification Search ..... 53/116, 53/135.1, 136.1, 482, 136.3, 491, 136.5, 53/367, 138.1, 371.7, 371.8, 372.2, 372.6, 53/372.7, 376.4, 376.5, 376.8, 377.3, 377.4, 53/377.6, 382.3, 382.2, 387.3
See application file for complete search history.

(56) References Cited

U.S. PATENT DOCUMENTS 3,342,014 A * 9/1967 Prager ..... 53/214

(Continued)

FOREIGN PATENT DOCUMENTS

JP 5-53620 3/1993

(Continued)

*Primary Examiner*—Hemant M. Desai
(74) *Attorney, Agent, or Firm*—Sughrue Mion, PLLC

(57) ABSTRACT

A sheet package producing system includes at least a cutter module and a packaging module. The cutter module has a cutter blade, for producing X-ray films by cutting a continuous sheet material. The packaging module has packaging robots, for producing a sheet package by packaging the X-ray films stacked on one another. In the sheet package producing system, a first module control unit is incorporated in the cutter module, for controlling the cutter blade. A second module control unit is incorporated in the packaging module, for controlling the packaging robots. A CPU is connected with the first and second module control units removably by a component network, for controlling the cutter module and the packaging module in synchronism.

9 Claims, 43 Drawing Sheets

U.S. PATENT DOCUMENTS 3,422,969 A 1/1969 Miller et al.
4,022,332 A 5/1977 Freakes et al.
4,884,698 A 12/1989 Tutamane et al.
4,939,888 A 7/1990 Katz et al.
5,282,350 A 2/1994 Crowley
5,352,085 A 10/1994 Sargent et al.
5,365,817 A 11/1994 Maeda et al.
5,452,564 A 9/1995 Staats
5,706,627 A 1/1998 Kirka et al.
5,771,657 A 6/1998 Lasher et al.
5,810,487 A 9/1998 Kano et al.
5,878,554 A 3/1999 Loree et al.
5,915,611 A * 6/1999 Baldoni et al. ..... 226/19
5,921,067 A * 7/1999 Fujiwara et al. ..... 53/550
6,070,398 A 6/2000 Neri
6,155,025 A 12/2000 Komiya et al.
6,409,462 B2 6/2002 Newsome et al.
6,484,475 B1 11/2002 Neagle et al.
6,612,100 B1 * 9/2003 Morimoto et al. ..... 53/540
6,640,156 B1 10/2003 Brooks et al.
6,643,997 B1 * 11/2003 Schwenke et al. ..... 53/482
6,740,018 B2 * 5/2004 Heide ..... 493/151

FOREIGN PATENT DOCUMENTS

JP 2001-80609 3/2001

* cited by examiner

SHEET PACKAGE PRODUCING SYSTEM, SHEET HANDLING DEVICE, AND FILLET FOLDING DEVICE

This is a divisional of application Ser. No. 11/069,564 filed Mar. 2, 2005, now U.S. Pat. No. 7,069,708, issued on Jul. 4, 2006, which is a divisional of application Ser. No. 10/189,404, filed Jul. 8, 2002, now U.S. Pat. No. 6,907,711, issued on Jun. 21, 2005. The entire disclosures of the prior application Ser. Nos. 11/069,564 and 10/189,404 are hereby incorporated by reference.

BACKGROUND OF THE INVENTION

1. Field of the Invention

The present invention relates to a sheet package producing system, a sheet handling device, and a fillet folding device. More particularly, the present invention relates to a sheet package producing system, a sheet handling device, and a fillet folding device in which efficiency in producing a sheet package can be high, and also which is compatible to plural types of sheet-shaped products.

2. Description Related to the Prior Art

X-ray films are included in various recording sheets or any sheet-shaped products. Plural sheets are stacked together, and packaged and shipped in a form of sheet package. To obtain the X-ray films, web having a great width is slitted into continuous sheet material having a width of the X-ray films. Then the continuous sheet material is unwound from a roll, and cut into the sheets. The sheets are stacked in a predetermined number. A protective cover is placed on the sheets to obtain a cover-fitted sheet stack in which the protective cover protects the sheets from damages or scratches. The cover-fitted sheet stack is inserted into and enclosed tightly in a packaging bag with light-tightness. The packaging bag with the sheet package is inserted in a decorative box, and shipped.

Although plural types of the X-ray films exist, the total number of the available types is not very high. A system for producing the sheet package of the X-ray films is designed in a manner specialized for one particular type or size of the X-ray films. A known example of control of the producing system is a central processing type, according to which a central control device includes one CPU, and plural controllers connected with the CPU and with plural component devices in the producing system. The central control device effects overall control of the producing system. One advantage of the central processing type of control consists in considerable highness in the communication speed, because the controllers are connected with the CPU by means of direction connection between circuit boards.

The central processing type has problems in difficulty in modifying the system, and in lack of suitability for easy inspection and maintenance. As disclosed in JP-B 2506244 (corresponding to JP-A 5-053620), a distributed processing type of control is known in contrast with the central processing type of the control. According to the distributed processing control in the prior document, the system is constituted by plural component devices, which include respectively CPUs for control of the component devices. Signals or control information is sent and received between the CPUs, the control information including information of completion of the processing, and results of the processing. The component devices are interconnected by the general-purpose interface such as SCSI and RS232C, which are used for communication between the CPUs. Control programs are designed for the respective component devices. Thus, each program can have a small scale, and can be modified easily if desired.

However, there is a problem in that the amount of control information to be sent and received is considerably high between the CPUs, because the plural CPUs are operated for overall control of the producing system. The interface of a general-purpose type is used in sending of the control information between the CPUs, and has a problem in low speed of communication. The processing speed of the producing system cannot be high because of the low communication speed. Among the producing steps, steps of handling sheets or parts requires high speed for the purpose of efficiency. However, the low communication speed is inconsistent to improvement in efficiency.

There are a number of known sheet handling devices for use with the sheets or a sheet stack which should not be handled with extreme pressure. U.S. Pat. No. 5,365,817 (corresponding to JP-A 5-169396) discloses a use of a vacuum chamber with which surplus air in the sheet stack is ejected. Also, U.S. Pat. No. 5,352,085 (corresponding to JP-A 7-144778) discloses a conveyor device for feeding the sheet stack between plural stations. The conveyor device includes at least three conveyor mechanisms connected in series. Among the conveyor mechanisms, a first one is inclined upwards. A second one is oriented horizontally. A third one is inclined downwards. The first is disposed to extend to a position under some of a plurality of the sheet stacks. All of the conveyor mechanisms are driven to feed some of the sheet stacks to an upper position of the conveyor device. After this, the conveyor device is transferred to the vicinity of a supply position. Again, the conveyor mechanisms are actuated, to feed the sheet stack to the supply position.

However, the device of U.S. Pat. No. 5,365,817 has a shortcoming in that time for the operation is considerably long to lower the speed, because the vacuum chamber must operate by keeping the sheet stack separate from external air. Also, the device of U.S. Pat. No. 5,352,085 has a problem in that the conveyor device has a considerably large size, and has a complicated structure, and raises the manufacturing cost. If the speed of driving the conveyor mechanisms is set very high, downfall or disorder is likely to occur in the train of the plurality of the sheet stacks. The device is unsuitable for raising the efficiency.

JP-A 2001-080609 discloses an example of fillet folding device for use with a packaging bag to fold front and rear fillets. In a process of packaging the cover-fitted sheet stack or sheet stack, a bag material for forming a bag body is supplied. At first, a corner positioning plate is set in a bending position of the front fillet, and keeps the cover-fitted sheet stack or sheet stack stationary in the bag body. Then the rear fillet is bent back and folded to lie on the outside of the bag body. After this, the front fillet, which is defined between a front edge and the bending position, is moved up at a predetermined height. The corner positioning plate is moved away, before the front fillet is bent back and caused to overlap on the rear fillet. Finally, a sticker is provided, and attaches the front edge of the front fillet to the rear fillet.

However, the plural types of the X-ray films exist, and are different in the size. Accordingly, the area and shape of the bag body, and the size of the front and rear fillets are different between the types of the X-ray films according to the size. In the above-described device of the prior art, an amount of protruding a movable rod is predetermined and invariable. An amount of sliding of a cylinder is also invariable. Thus, the device is not compatible to the plural types between which the sheet size is different. Also, a problem arises in that the known device cannot produce a sheet package in which the sizes of the front and rear fillets are changed if desired.

SUMMARY OF THE INVENTION

In view of the foregoing problems, an object of the present invention is to provide a sheet package producing system, a sheet handling device, and a fillet folding device in which efficiency in producing a sheet package can be high.

Another object of the present invention is to provide a sheet package producing system, a sheet handling device, and a fillet folding device which is compatible to plural types of sheet-shaped products.

In order to achieve the above and other objects and advantages of this invention, a sheet package producing system includes a cutter module having a cutter mechanism, for producing sheets by cutting a continuous sheet material, and a packaging module having a packaging mechanism, for producing a sheet package by packaging the sheets stacked on one another. The sheet package producing system comprises a first module control unit, incorporated in the cutter module, for controlling the cutter mechanism. A second module control unit is incorporated in the packaging module, for controlling the packaging mechanism. A CPU is connected with the first and second module control units removably by a component network, for controlling the cutter module and the packaging module in synchronism.

Furthermore, there is at least one first auxiliary module for operation in a sub-process prior or subsequent to cutting of the cutter module, to constitute a cutting device with the cutter module. There is at least one second auxiliary module for operation in a sub-process prior or subsequent to packaging of the packaging module, to constitute a packaging device with the packaging module. The CPU is connected with the first and second auxiliary modules removably by the component network, for controlling the cutting device and the packaging device in synchronism.

Furthermore, a cover-fitted sheet stack producing machine is disposed downstream from the cutting device, controlled by the CPU, for producing a cover-fitted sheet stack by loading a protective cover with the sheets being stacked, to supply the packaging device therewith.

The cutter device and the packaging device are controlled by a program, and the program is written according to structured programming in a separate manner between the cutter module, the packaging module and the first and second auxiliary modules.

At least one of the cutter module, the packaging module and the first and second auxiliary modules includes an error detector for detecting occurrence of abnormality in the cutter mechanism or the packaging mechanism or in the sub-processes.

Consequently, the sheet package producing system is compatible to plural types of sheet-shaped products, because the single CPU is used in connection with the component network, and allows easy modification of the cutter module and the packaging module.

According to another aspect of the invention, a sheet handling device comprises at least one support plate for supporting plural sheets stacked on one another. A moving mechanism moves the support plate along a moving path. An orientation changer adjusts an orientation of the support plate, to prevent the sheets from being offset by influence of inertia on the support plate while the moving mechanism moves the support plate.

Furthermore, a control unit controls the moving mechanism, initially to move the support plate in acceleration in an accelerating step, next to move the support plate at a regular speed in an regular speed step, and then to move the support plate in deceleration in an decelerating step.

The orientation changer includes a first rotating mechanism for rotating the support plate about a first axis extending in an extending direction in which the support plate extends from the moving mechanism, the first rotating mechanism being controlled by the control unit, actuated in the accelerating step, for inclining the support plate to position an upstream edge higher with reference to the moving path, and actuated in the decelerating step, for inclining the support plate to position a downstream edge higher with reference to the moving path.

The orientation changer further includes a second rotating mechanism for rotating the support plate about a second axis extending in a direction of the moving path, the second rotating mechanism being controlled by the control unit, actuated in the regular speed step, for inclining the support plate to position higher a front end thereof with reference to the extending direction of the support plate.

The at least one support plate comprises first and second support plates for clamping the sheets stacked on one another.

The moving mechanism is a rotational moving mechanism, and the moving path is in an arc shape.

According to still another aspect of the invention, a fillet folding device for a packaging bag is provided. The packaging bag includes a bag body for wrapping a sheet stack including plural stacked sheets, and front and rear fillets, formed to protrude forwards and backwards from the bag body, for being folded back on an outside of the bag body, to tighten a wrapped state of the packaging bag. In the fillet folding device, a conveyor feeds the packaging bag forwards in a feeding direction. A centering mechanism is supplied with the packaging bag by the conveyor, for centering the packaging bag by pressing first and second sides thereof with reference to a crosswise direction crosswise to the feeding direction. A pair of chucks are arranged in the crosswise direction, for clamping first and second end portions of a first fillet selected from the front and rear fillets. A chuck moving mechanism moves the pair of the chucks in synchronism, to fold the first fillet, the first fillet thereby extending and being kept from twisting.

Furthermore, a position detector detects an edge position of the first fillet after operation of the centering mechanism. Before clamping of the pair of the chucks, the chuck moving mechanism sets the pair of the chucks at the first and second end portions of the first fillet according to the edge position being detected.

Furthermore, a position calculating unit calculates a bendback position of the first fillet according to the edge position being detected. The chuck moving mechanism moves the pair of the chucks according to the bendback position.

Furthermore, a control unit controls the chuck moving mechanism, and initially swings the pair of the chucks at a first radius adapted to movement to the bendback position, to bend back the first fillet. Then the control unit moves the pair of the chucks in the feeding direction farther than the bendback position by a predetermined over-stroke, to tighten a bending state relative to the sheet stack by pulling the first fillet.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
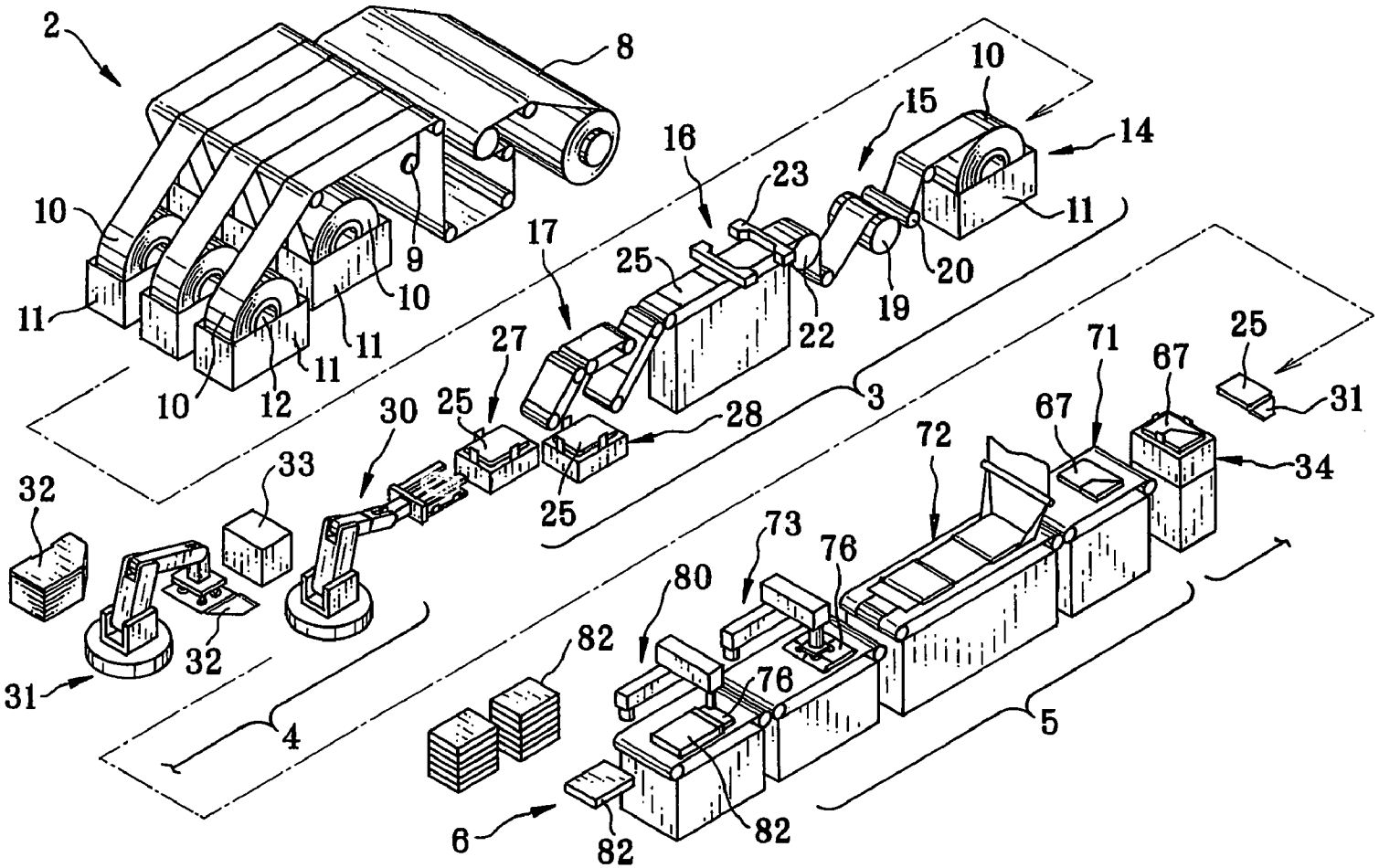
FIG. 1 is a perspective illustrating a sheet package producing system.

In FIG. 1, a sheet package producing system for producing a package of X-ray films is illustrated. The producing system includes a slitting device 2, a cutting device 3, a cover-fitted sheet stack producing machine 4, a packaging device 5, and a box inserting device 6 arranged in sequence. Those are connected in series with one another, and constructed so that the balance of capacity in the line is regularized between those. Consequently, there occurs no intermediate reservation of the continuous sheet material or sheets between the devices. Furthermore, the devices from the slitting device 2 to the packaging device 5 are arranged in a dark room and shielded from ambient light.

Web 8 of X-ray film having a great width is fed through the slitting device 2. Slitting blades 9 of the slitting device 2 slit the web 8 at a width of a single sheet of X-ray film. Continuous sheet material 10 is obtained. Roll containers 11 accommodate respectively spools 12, on each of which the continuous sheet material 10 is wound. After the continuous sheet material 10 is wound and contained in each of the roll containers 11, the roll containers 11 are removed from the slitting device 2 and respectively set in the cutting device 3.

The cutting device 3 cuts the continuous sheet material 10 and forms sheets as products, which are stacked in a plurality. The cutting/stacking process is constituted by plural sub-processes, which include a supplying step of supplying the continuous sheet material 10 by drawing from a roll, an uncurling step of uncurling the continuous sheet material 10 being supplied, a cutting step of cutting the continuous sheet material 10 into sheets, and a stacking step of stacking the sheets.

The cutting device 3 is constituted by a plurality of modules associated with sub-processes, including a conveyor module 14, a decurler module 15, a cutter module 16 and a stacker module 17. Those other than the cutter module 16 are auxiliary to the cutter module 16. Each of the modules is a minimum unit that can be added, removed or exchanged easily to modify system partially. Also, the modules make it possible to inspect and maintain the system efficiently.

The conveyor module 14 is loaded with the roll containers 11 containing the continuous sheet material 10. A constant tension control mechanism applies to the continuous sheet material 10 in the roll container 11, from which the continuous sheet material 10 is drawn out. In the conveyor module 14, a splicing mechanism is disposed for connecting a rear end of the continuous sheet material 10 being used to a front end of the continuous sheet material 10 newly added when the remainder of the first continuous sheet material 10 is coming down to zero.

The decurler module 15 includes heating rollers 19 and a cooler. The heating rollers 19 generate heat at a temperature which is high but short of influencing the performance of X-ray films. In the decurler module 15, the heating rollers 19 are caused to contact the continuous sheet material 10 in a direction reverse to the turns of the continuous sheet material 10, to eliminate a curling tendency from the continuous sheet material 10. After the continuous sheet material 10 is uncurled, the continuous sheet material 10 is cooled in a stabilized state. Dancer rollers 20 are disposed upstream from the heating rollers 19, and absorb minute changes in tension applied to the continuous sheet material 10.

Figure 2:
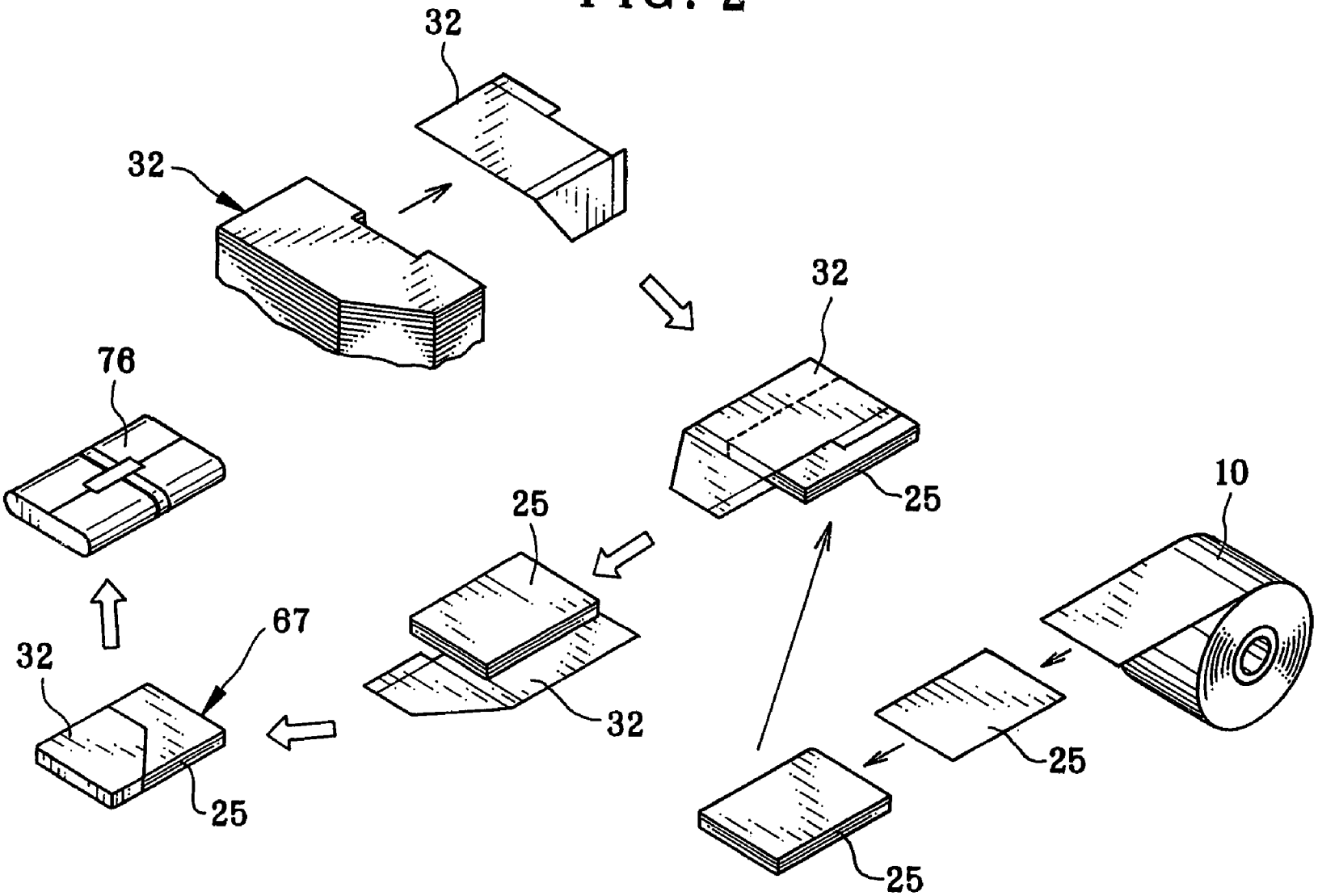
FIG. 2 is an explanatory view in perspective illustrating a process of producing a cover-fitted sheet stack.

The cutter module 16 includes a suction drum 22 and a rotary oscillation cutter 23. The suction drum 22 conveys the continuous sheet material 10 by a regular amount. The rotary oscillation cutter 23 is synchronized with the suction drum 22 electrically and mechanically. The regular feeding of the continuous sheet material 10 causes the rotary oscillation cutter 23 to cut the continuous sheet material 10 at a regular length. A plurality of sheets are obtained as a sheet stack 25. See FIG. 2. Then corners of the sheets are rounded by an additional cutting operation.

Figure 3:
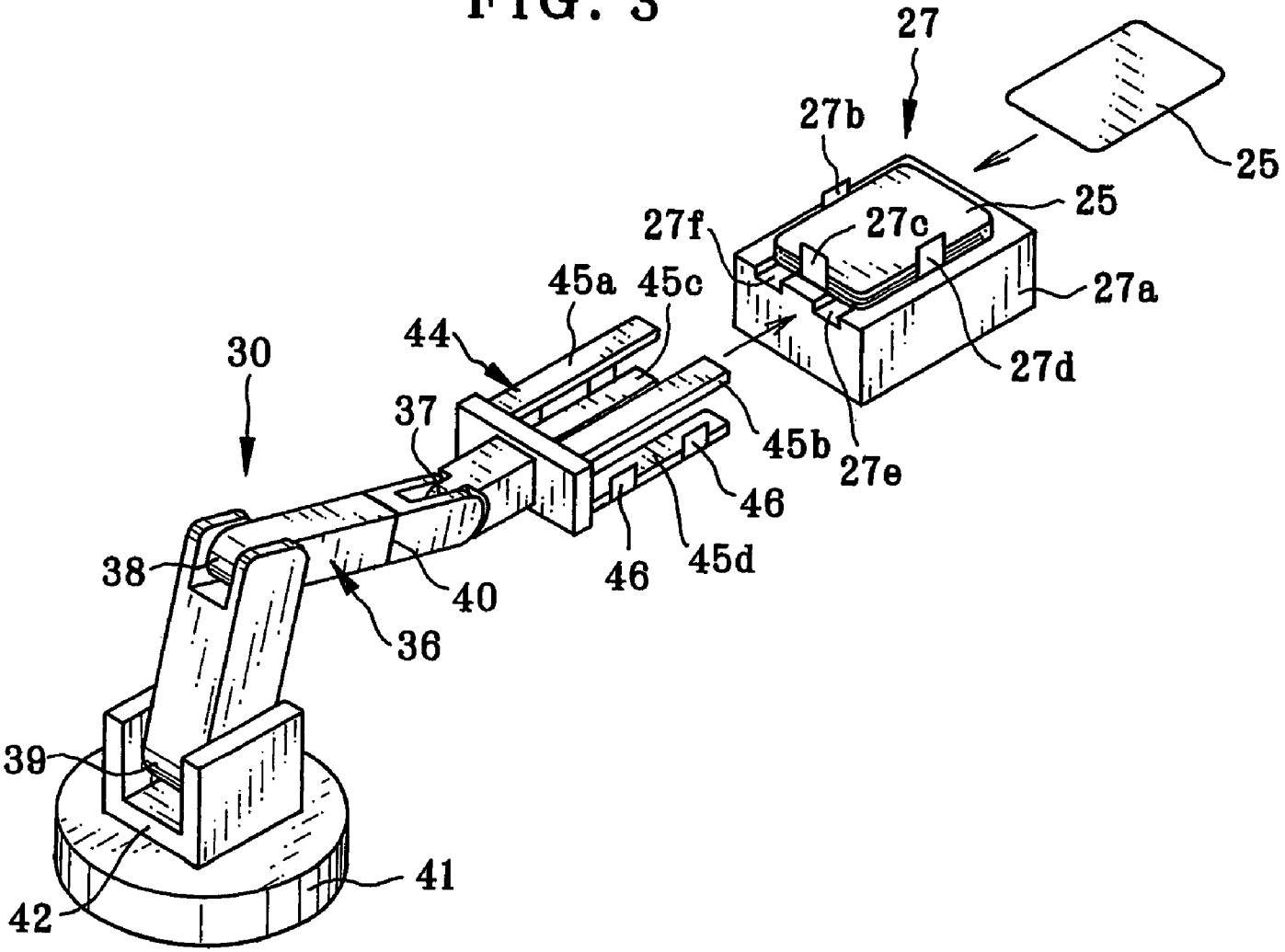
FIG. 3 is a perspective illustrating a stacker module and a sheet handling module at the time of sheet removing.

The stacker module 17 includes sheet stacking frames 27 and 28 and a sorting gate. The sheet stacking frames 27 and 28 stack the sheets obtained by cutting in the cutter module 16. The sorting gate sorts the sheets to a selected one of the sheet stacking frames 27 and 28. In FIG. 3, the sheet stacking frame 27 includes a support 27*a* and guide plates 27*b*, 27*c* and 27*d*. The support 27*a* receives the sheet stack 25 placed thereon. The guide plates 27*b*-27*d* contact and neaten three side lines of the sheet stack 25 on the support 27*a*. The sheet stacking frame 28 has the same structure as the sheet stacking frame 27. Also, the stacker module 17 includes a rejection gate for rejecting sheets of sizes other than the predetermined sizes from the producing system.

Each of the conveyor module 14, the decurler module 15, the cutter module 16 and the stacker module 17 has a pallet or base plate having a common size determined in consideration of the expected maximum size of an X-ray film. Each of the modules can be added, removed or exchanged easily by retention with bolts.

A drive motor as drive power source is disposed in the cutter module 16 for driving the cutting device 3. A drive main shaft is included in the cutter module 16, and connected with the motor. Drive main shafts are disposed in respectively the conveyor module 14, the decurler module 15 and the stacker module 17, and have such an arrangement that a size of a space occupied by those is equal. Flexible couplings or transmission couplings as synchronizing unit are provided, and interconnect respectively two adjacent shafts included in the drive main shafts. Thus, the force of driving of the motor is transmitted to the conveyor module 14, the decurler module 15 and the stacker module 17, which can be synchronized. Note that the conveyor, decurler, cutter and stacker modules 14-17 may be synchronized by other constructions than the flexible couplings and the drive main shafts. To this end, a motor can be incorporated in each of the conveyor, decurler, cutter and stacker modules 14-17. A synchronizing unit may operate for control between invertors, and synchronizes the plurality of the motors electrically.

The cover-fitted sheet stack producing machine 4 is constituted by plural modules to which sub-processes are respectively assigned, in a manner similar to the cutting device 3. Specifically, the cover-fitted sheet stack producing machine 4 includes a sheet handling module 30 or device, a cover handling module 31, a pre-bender module 33 and a cover folding module 34. The sheet handling module 30 removes the sheet stack 25 out of the stacker module 17 in the cutting device 3. The cover handling module 31 retains a protective cover 32. The pre-bender module 33 pre-bends the protective cover 32. The cover folding module 34 folds the protective cover 32 loaded with the sheet stack 25.

In FIG. 3, the sheet handling module 30 is a general-purpose type of robot, and has an extendable arm 36 or moving mechanism. The sheet handling module 30 has a support 41. The extendable arm 36 includes a first joint 37, a second joint 38, a third joint 39, a rotating mechanism 40 and a lower pivot 42. The lower pivot 42 is connected with the support 41. A chuck 44 is disposed on an end of the extendable arm 36 for grasping and handling the sheet stack 25. In the chuck 44, four support plates 45*a*, 45*b*, 45*c* and 45*d* contact front and rear surfaces of the sheet stack 25. Protective projections 46 protrude from edges of the support plates 45*c* and 45*d*, and contact and regulate lateral edges of the sheet stack 25. The support plates 45*a* and 45*b* are movable toward and away from the support plates 45*c* and 45*d* disposed under those.

There are grooves 27*e* and 27*f* formed in the support 27*a* of the sheet stacking frame 27 in the stacker module 17. The sheet handling module 30 inserts the support plates 45*c* and 45*d* into the grooves 27*e* and 27*f*. Then the support plates 45*a* and 45*b* are shifted down toward the support plates 45*c* and 45*d*, to squeeze the sheet stack 25. The joints of the extendable arm 36 are actuated, to remove the sheet stack 25 up from the sheet stacking frame 27.

Figure 4:
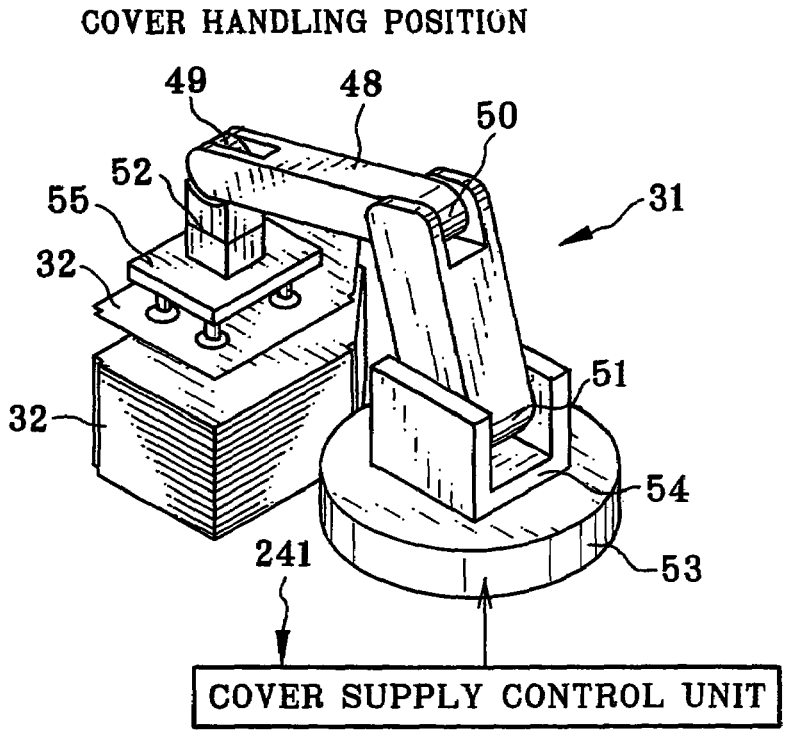
FIG. 4 is a perspective illustrating handling of a protective cover in a cover handling module.

In FIG. 4, the cover handling module 31 is a general-purpose type of robot, and has an extendable arm 48 or moving mechanism. The cover handling module 31 has a support 53. The extendable arm 48 includes a first joint 49, a second joint 50, a third joint 51, a first pivot 52 and a second pivot 54. Suction pads 55 are disposed on an end of the extendable arm 48. An uppermost one of stacked protective covers 32 is picked by suction of the suction pads 55, and retained thereon. Note that the cover handling module 31 may be constructed by partially modifying the sheet handling module 30. In other words, the cover handling module 31 may have basically the same portions as those of the sheet handling module 30 but include the suction pads 55 in place of the chuck 44.

The protective cover 32 is formed from fibreboard or cardboard having sufficient strength and rigidity. A great number of cardboard material sheets in a quadrilateral shape are prepared as raw material, and worked and cut to obtain the protective cover 32 in a trapezoidal shape of FIG. 2. The protective cover 32 is bent along four lines, and becomes formed to cover front, rear and lateral surfaces of the sheet stack 25.

Figure 5:
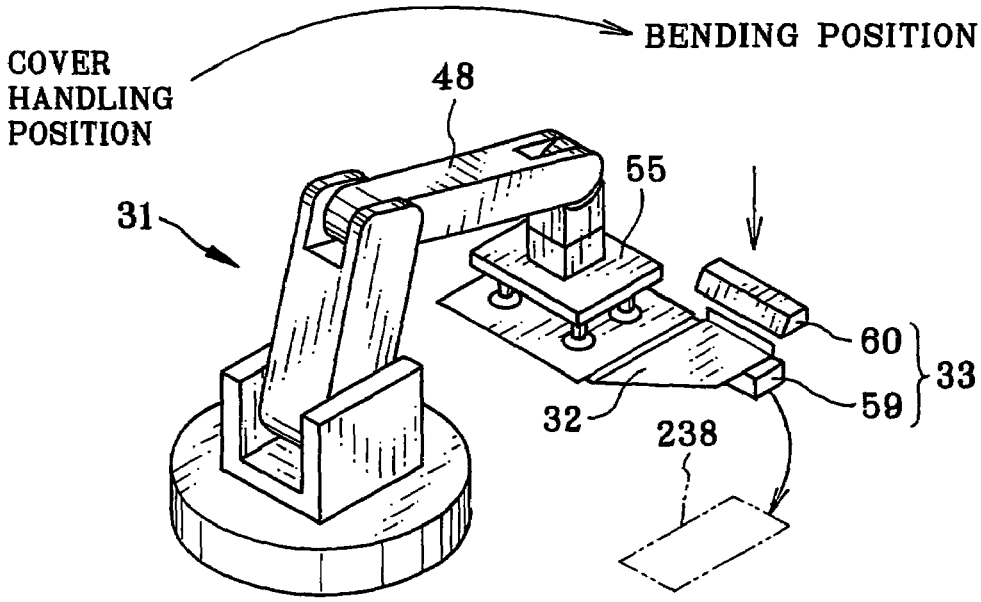
FIG. 5 is a perspective illustrating pre-bending of the protective cover in the cover handling module and pre-bending module.

In FIG. 5, the pre-bender module 33 includes a base plate 59, a bender mechanism 60 and a moving mechanism (not shown). The base plate 59 contacts a lower surface of the protective cover 32. The bender mechanism 60 moves down in a path opposed to the base plate 59. The moving mechanism moves the bender mechanism 60. The cover handling module 31 moves bending portions of the protective cover 32 to the base plate 59 of the pre-bender module 33, and positions the same. The bender mechanism 60 moves down to the base plate 59, to pre-bend the bending portions. Similarly, the cover handling module 31 sets the bending portions of the protective covers 32 one after another. All the protective covers 32 are subjected to pre-bending in the pre-bender module 33.

Figure 6:
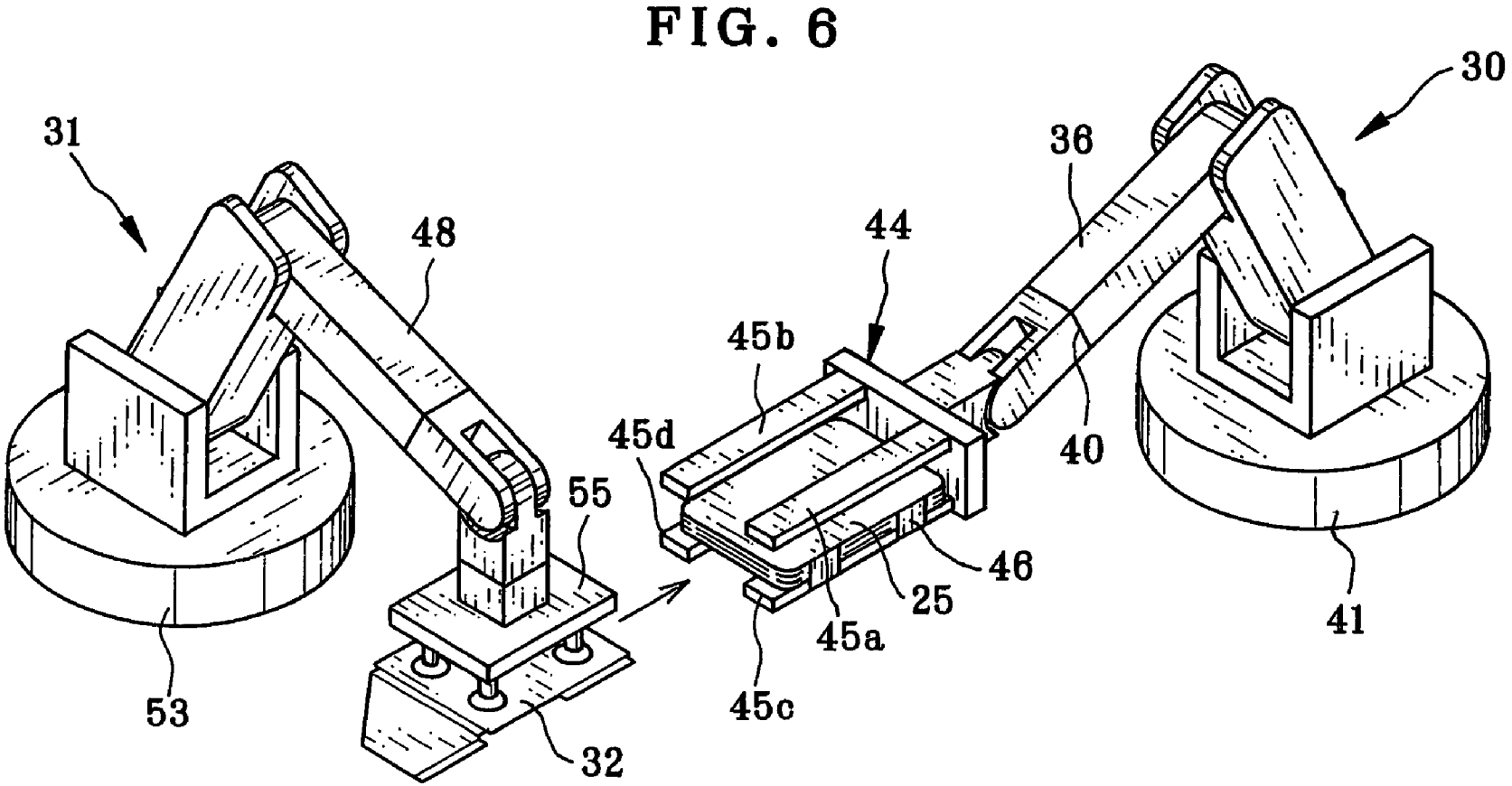
FIG. 6 is a perspective illustrating insertion of the protective cover into said sheet handling module.
Figure 7:
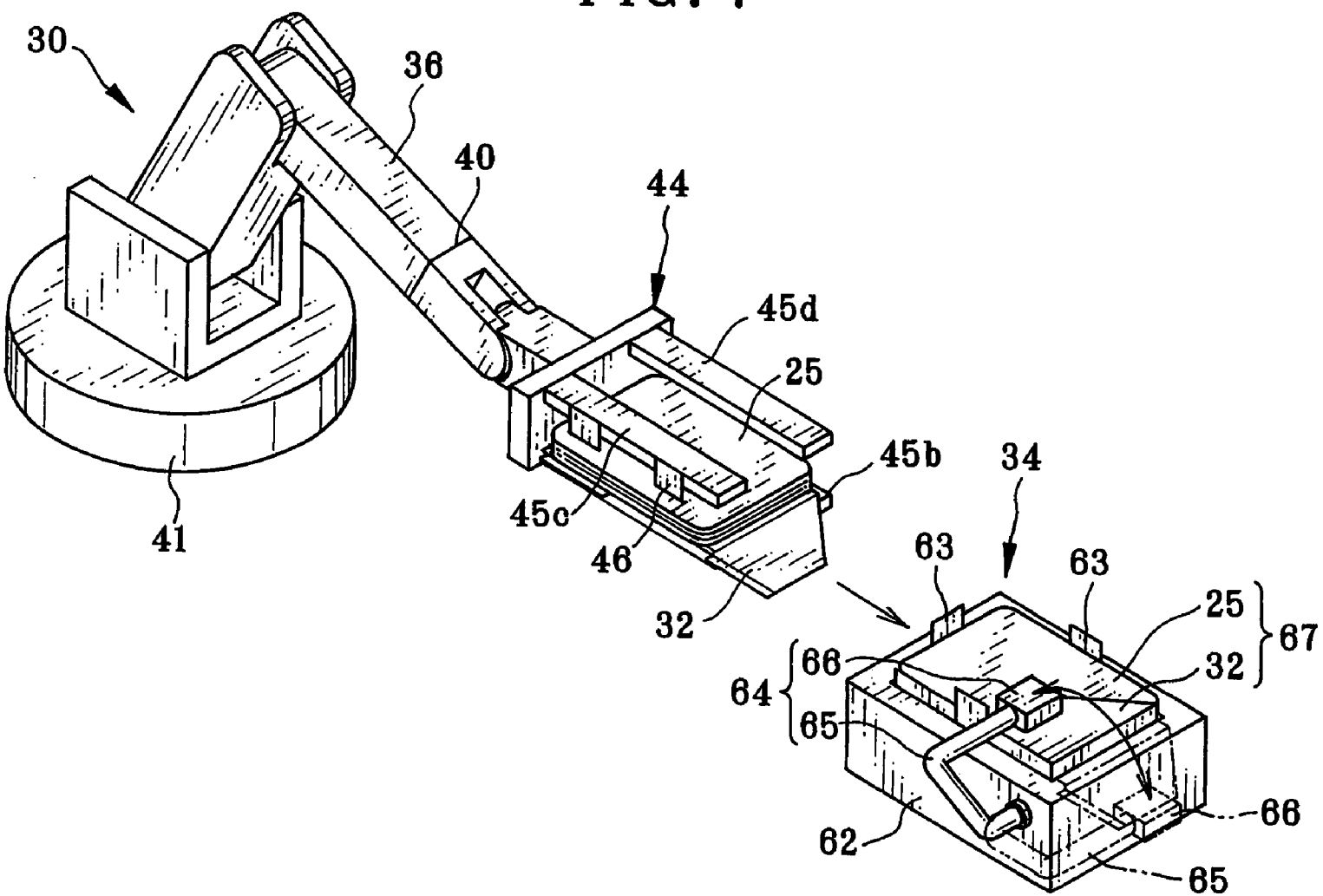
FIG. 7 is a perspective illustrating supply of the cover-fitted sheet stack to a cover folding module.

In FIG. 6, the protective cover 32 being pre-bent is placed by the cover handling module 31 on the sheet stack 25 grasped by the chuck 44 of the sheet handling module 30. The sheet handling module 30 drives again the chuck 44 to grasp the sheet stack 25 and the protective cover 32 together. As illustrated in FIG. 7, the chuck 44 is rotated by the rotating mechanism 40 to turn the sheet stack 25 and the protective cover 32 upside down. The sheet stack 25 and the protective cover 32 are supplied to the cover folding module 34.

The cover folding module 34 includes a quadrilateral base plate 62, guide plates 63 and a folder arm 64. The base plate 62 receives the sheet stack 25 and the protective cover 32 placed thereon. The guide plates 63 contacts and neatens three side lines of the sheet stack 25 and the protective cover 32. The folder arm 64 folds the protective cover 32 to squeeze the sheet stack 25. The folder arm 64 includes an arm portion 65 and a pad 66. The arm portion 65 has a channel shape, and has a first end portion rotatably secured to a wall of the base plate 62. The pad 66 is secured to a second end portion of the arm portion 65. When the arm portion 65 rotates from a first position of the phantom line to a second position of the solid line, the pad 66 pushes the protective cover 32 to fold the bending portion of the protective cover 32 to the sheet stack 25.

Figure 8:
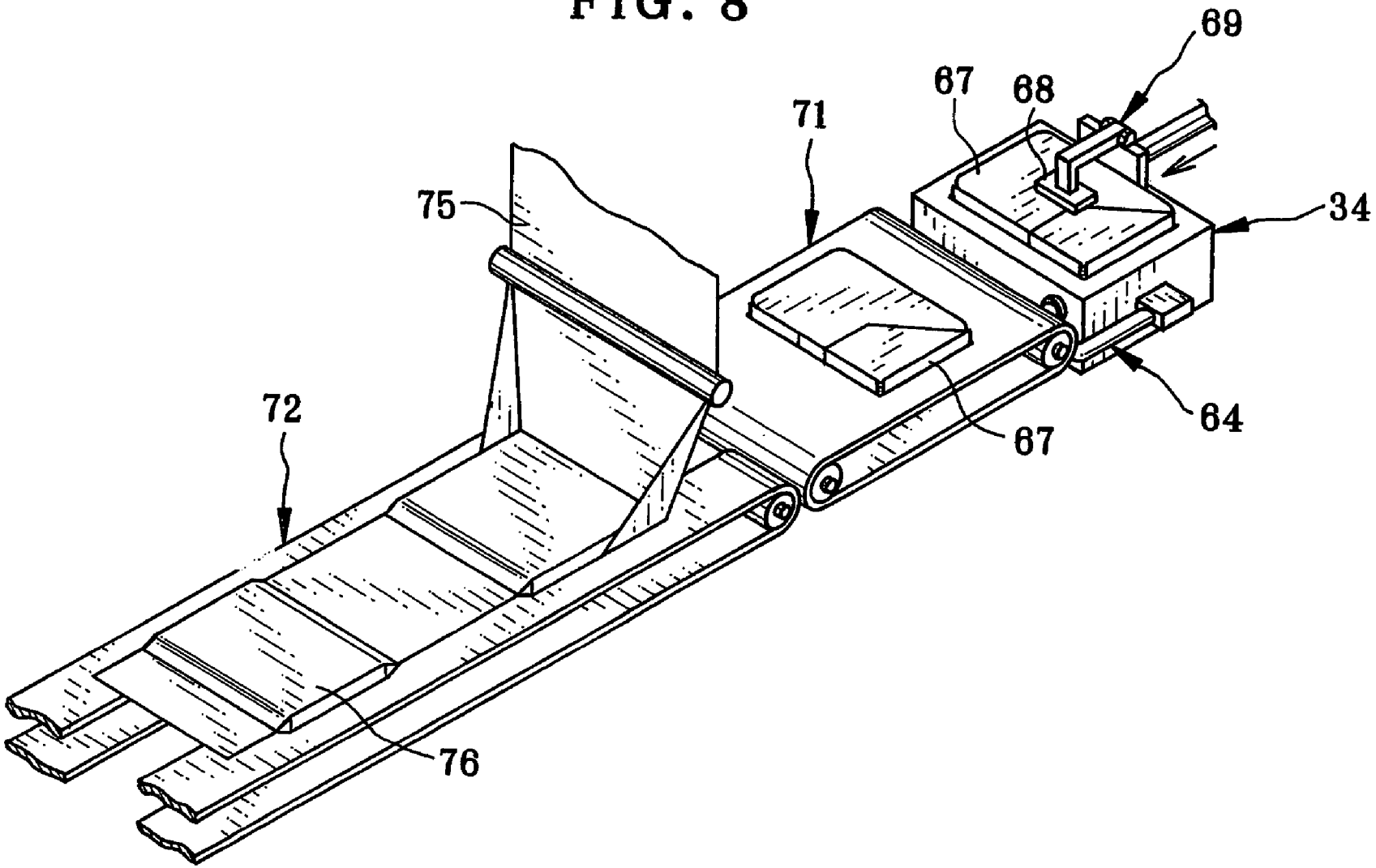
FIG. 8 is a perspective illustrating a construction of the cover folding module and a packaging module.

A cover-fitted sheet stack 67 is formed as a combination of the protective cover 32 and the sheet stack 25. In FIG. 8, a pusher 69 includes a retention pad 68, which contacts an upper surface of the cover-fitted sheet stack 67 to keep the protective cover 32 from opening. Thus, the pusher 69 sends the cover-fitted sheet stack 67 to the packaging device 5. While the cover-fitted sheet stack 67 is moved, the guide plates 63 are kept retracted in the base plate 62.

Each of the pre-bender module 33 and the cover folding module 34 has a pallet or base plate having a common size determined in consideration of the expected maximum size of an X-ray film. Each of the modules can be added, removed or exchanged by fastening and unfastening bolts, easily to modify system partially. In the robots constituting the sheet handling module 30 and the cover handling module 31, the chuck 44 and the suction pads 55 can be exchanged in consideration of X-ray films to be produced. So the robots can be adjusted or rearranged for any of plural types and plural sizes of the products.

The packaging device 5 includes a cover-fitted sheet stack conveyor module 71, a packaging module 72 having a packaging mechanism, and a package sealer module 73 as auxiliary module. The cover-fitted sheet stack conveyor module 71 receives the cover-fitted sheet stack 67 from the cover-fitted sheet stack producing machine 4, and feeds the cover-fitted sheet stack 67. The packaging module 72 packages the cover-fitted sheet stack 67 according to a technique of the pillow packaging. An example of the cover-fitted sheet stack conveyor module 71 is a conveyor belt, and transfers the cover-fitted sheet stack 67 to the packaging module 72. Note that the cover-fitted sheet stack conveyor module 71 may have a structure other than the conveyor belt, for example, may include a chain having a feeding hooks.

Figure 9:
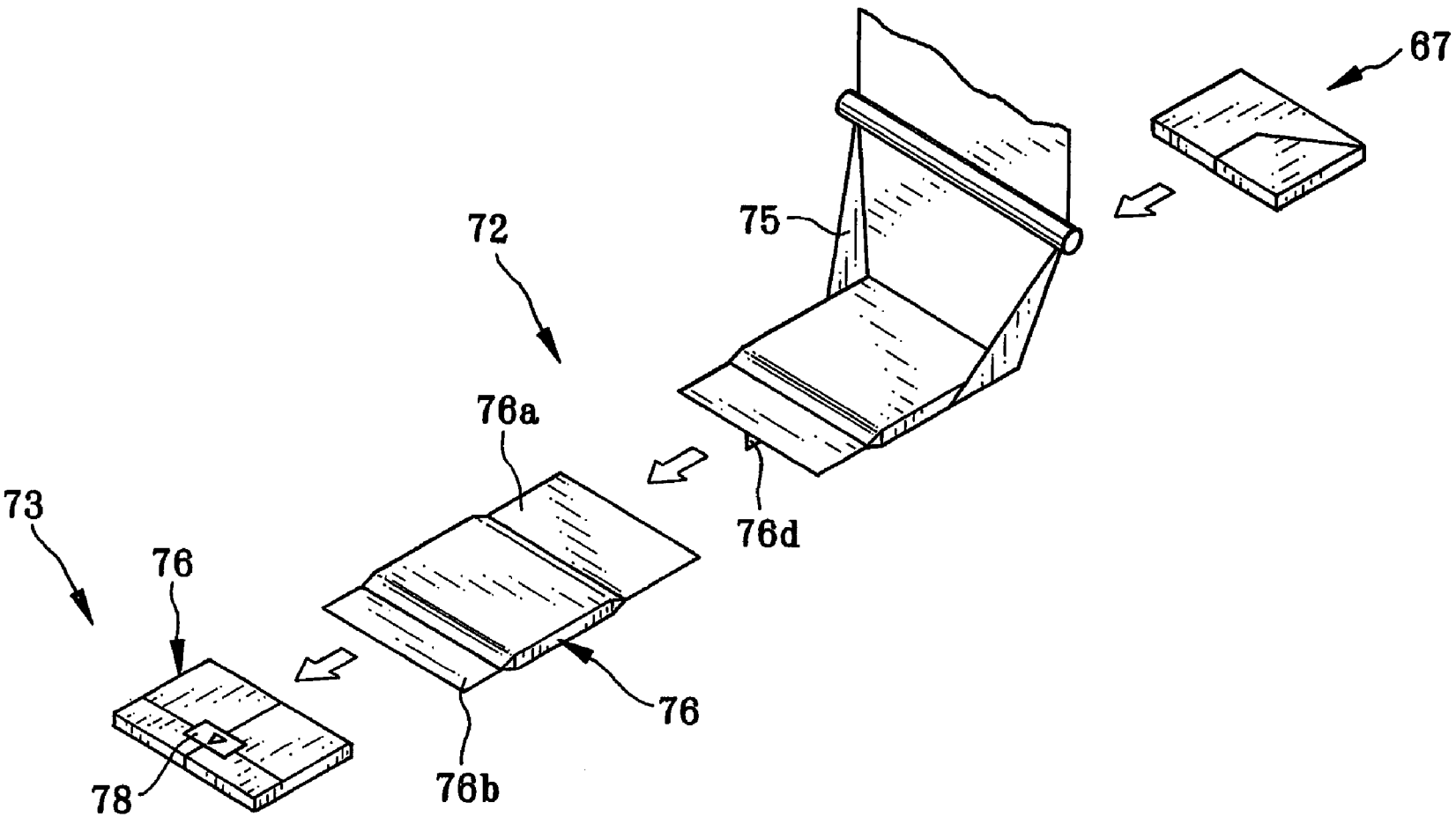
FIG. 9 is an explanatory view in perspective illustrating a process of forming the packaging bag.

In FIGS. 8 and 9, light-tight film or packaging bag material 75 is fed in the packaging module 72, and includes a plastic layer and an aluminum foil layer overlaid thereon. The packaging module 72 forms the packaging bag material 75 in a tubular shape. A pair of junction portions **76*d* of the packaging bag material 75 are opposed to one another as two edges. A center sealer is driven to heat and weld the junction portions to one another while the cover-fitted sheet stack 67 is wrapped in the packaging bag material 75. Then cross sealers are driven to heat and weld front and rear portions of the packaging bag material 75. Cutter blades are actuated to cut the front and rear portions. An air removing pipe is used to remove air from the inside of the packaging bag material 75. Then a packaging bag 76 is formed to enclose the cover-fitted sheet stack 67** in a tightly packaged manner.

The package sealer module 73 has a fillet folder machine of a general-purpose type. A rear fillet **76*a* is a portion of the packaging bag 76 protruding backwards. A robot hand in a vertically moving robot of the package sealer module 73 grasps corners of the rear fillet 76*a*. The rear fillet 76*a* is folded while tension is applied by the robot hand to the corners to prevent occurrence of wrinkles. A front fillet 76*b* is a portion of the packaging bag 76 protruding forwards, and is folded similarly. The rear and front fillets 76*a* and 76*b* are kept closed by a retention mechanism for contact with an upper surface of the packaging bag 76. Finally, a sticker 78 or label is attached to fix the rear and front fillets 76*a* and 76*b* to the body of the packaging bag 76**.

Each of the cover-fitted sheet stack conveyor module 71, the packaging module 72 and the package sealer module 73 has a pallet or base plate having a common size determined in consideration of the expected maximum size of an X-ray film. Each of the modules can be added, removed or exchanged by fastening and unfastening bolts.

Figure 10:
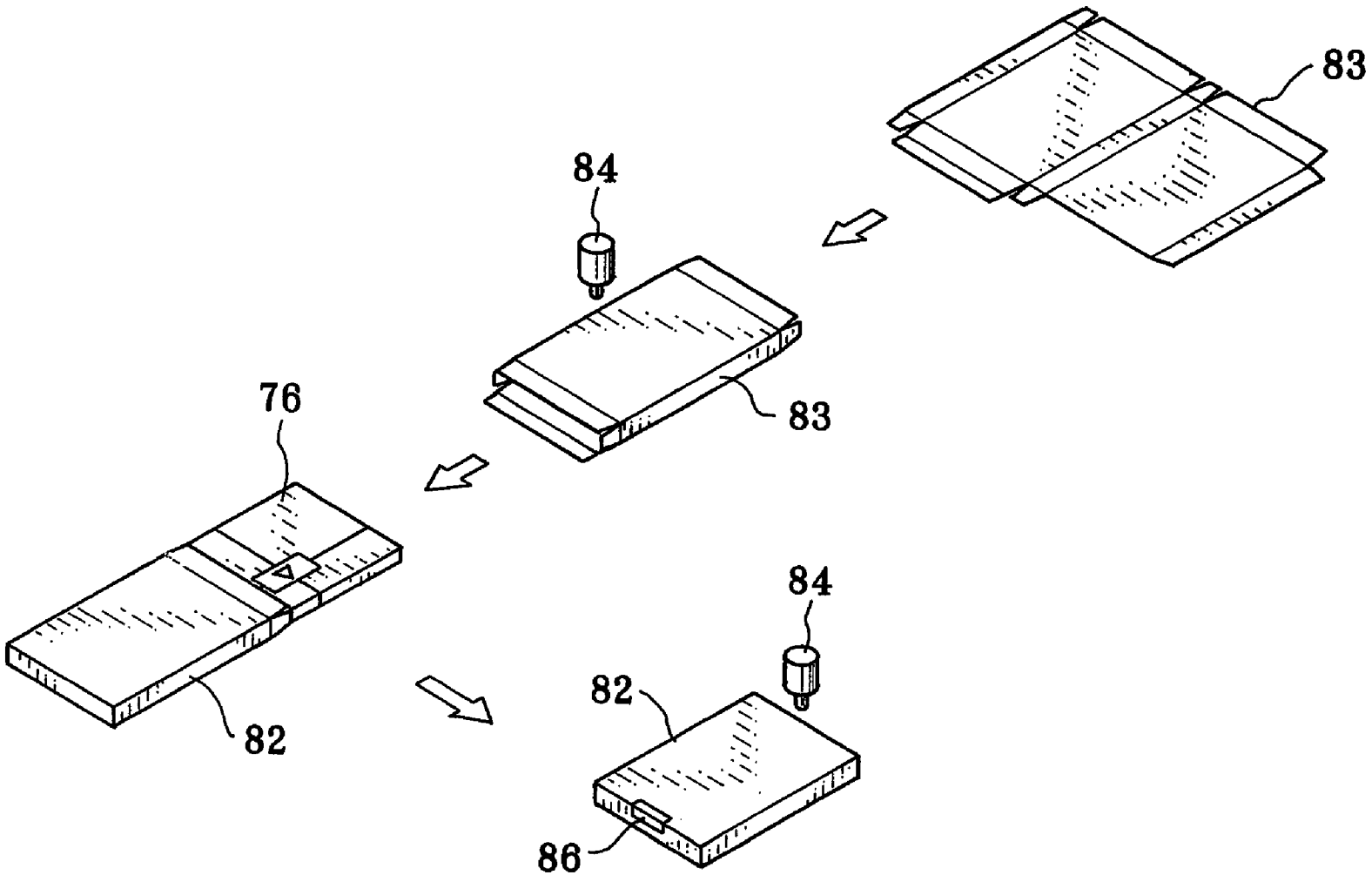
FIG. 10 is an explanatory view in perspective illustrating a process of forming a decorative box.

The box inserting device 6 includes a box producing module, a box inserting module 80 and a cardboard caser. The box producing module is a general-purpose robot (not shown) similar to the cover handling module 31. In FIG. 10, a blank sheet 83 for a decorative box 82 is handled by the general-purpose robot at a board bending station, and are pre-bent at its bending portions, to form the decorative box 82. Furthermore, a hot-melt gun 84 is disposed in the board bending station, ejects hot-melt adhesive agent for attaching juncture portions of the decorative box 82 to one another.

The box inserting module 80 inserts a guide plate into the decorative box 82, to load the decorative box 82 with the packaging bag 76 enclosing the cover-fitted sheet stack 67. Then the box inserting module 80 closes a lid of the decorative box 82. A sticker 86 or label is attached to the lid of the decorative box 82. Information including a lot number is printed on the decorative box 82 in the box inserting module 80. An image processing section picks up an image of the decorative box 82, for the purpose of inspecting attachment of the sticker and the printed state.

The cardboard caser includes a general-purpose type of multi-joint robot for handling the decorative box 82, and operates for inserting five boxes 82 into a single cardboard box.

Each of the above-described box producing module, the box inserting module 80 and the cardboard caser has a pallet or base plate having a common size determined in consideration of the expected maximum size of an X-ray film. Each of the modules can be added, removed or exchanged by fastening and unfastening bolts.

Figure 11:
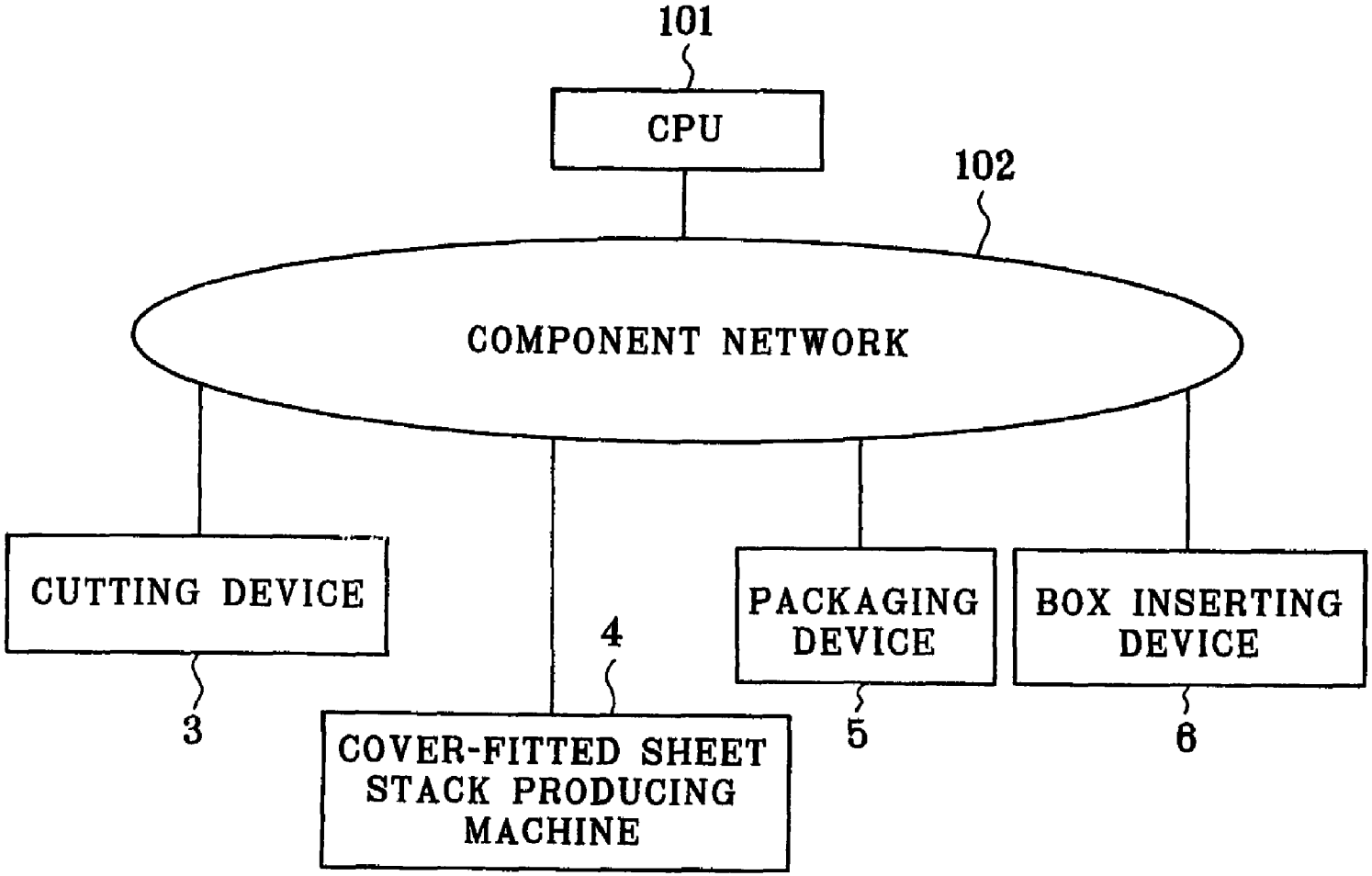
FIG. 11 is a block diagram illustrating connection of a CPU with various component devices.

In FIG. 11, connection between a CPU 101 or controller and other components is illustrated, the components including the cutting device 3, the cover-fitted sheet stack producing machine 4, the packaging device 5 and the box inserting device 6. Each of the cutting device 3, the cover-fitted sheet stack producing machine 4, the packaging device 5 and the box inserting device 6 includes plural modules as described above. Separate control units are incorporated in respectively the modules. The CPU 101 is connected with each of the control units in a removable manner by means of a component network 102.

The component network 102 is a network for connecting the CPU 101 with various devices such as actuators, sensor, and the like. The component network 102 can operate at a higher communication speed than conventional interface such as RS232C or SCSI. A preferable example of the component network 102 is DeviceNet (trade name) which is multi-bender network of which specifics of connection have been published. This is advantageous in extensibility of the system, great ease in availability of parts and the like.

The component network 102 is constituted by a specialized cable 103, a communication board and the like, the communication board being called an I/O terminal 104. Devices or instruments for being connected to the component network 102 are provided with a specialized connector connectable with the specialized cable 103 or the I/O terminal 104. There are standards of a shape of the connector, a voltage level of a signal line within the specialized cable 103, and communication protocol. As the component network 102 is DeviceNet (trade name), the connector can be disconnected easily. Accordingly, the devices or instruments can be rearranged, exchanged or eliminated with great ease. If a user desires addition of external devices, the addition is very easy because of adding a specialized distributor or cable.

Figure 12:
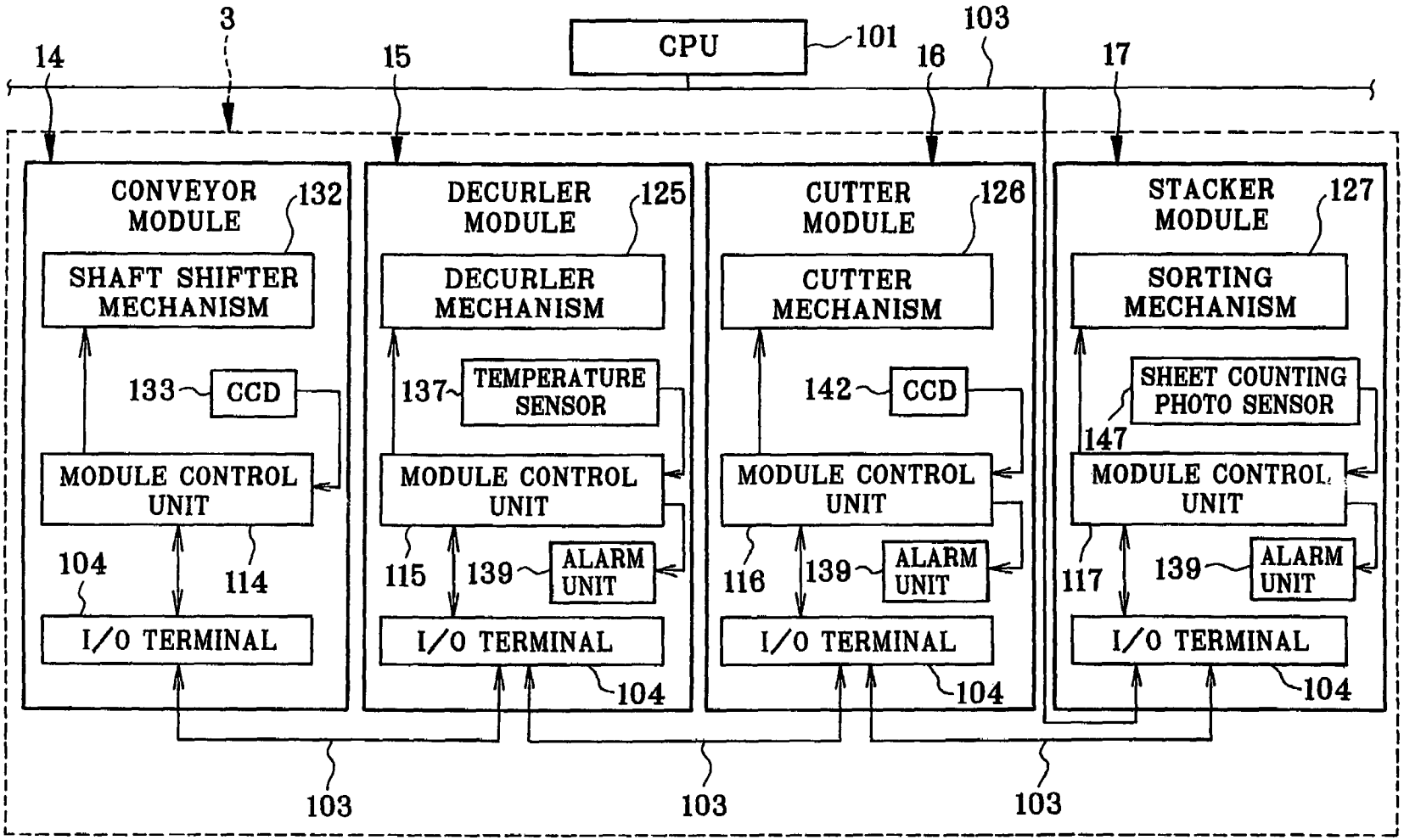
FIG. 12 is a block diagram illustrating connection of the CPU with the modules in the cutting device.

In FIG. 12, the conveyor, decurler, cutter and stacker modules 14-17 in the cutting device 3 and the CPU 101 are illustrated. Module control units 114, 115, 116 and 117 are incorporated in respectively the conveyor module 14, the decurler module 15, the cutter module 16 and the stacker module 17, and control respectively a shaft shifter mechanism 132, a decurler mechanism 125, a cutter mechanism 126 and a sorting mechanism 127 in the modules. The CPU 101 is connected with each of the module control units 114-117 by the I/O terminal 104 and the specialized cable 103 in a removable manner.

The CPU 101 sends a start signal, stop signal, speed command signal and the like to the module control units 114-117 via the component network 102. For operations other than the start, stop, speed control and the like, the module control units 114-117 effect control of distributed processing individually without being controlled by the CPU 101. The module control units 114-117 do not send results of processing of the modules to any of the other modules and the CPU 101. However, it is essentially important to check normality of operation of the conveyor, decurler, cutter and stacker modules 14-17 in the course of the producing process of the producing line. In the present embodiment, the conveyor, decurler, cutter and stacker modules 14-17 are provided with a construction for control in a normal state in relation to various operations, and a construction for externally informing abnormality if an abnormal state is detected.

Figure 13:
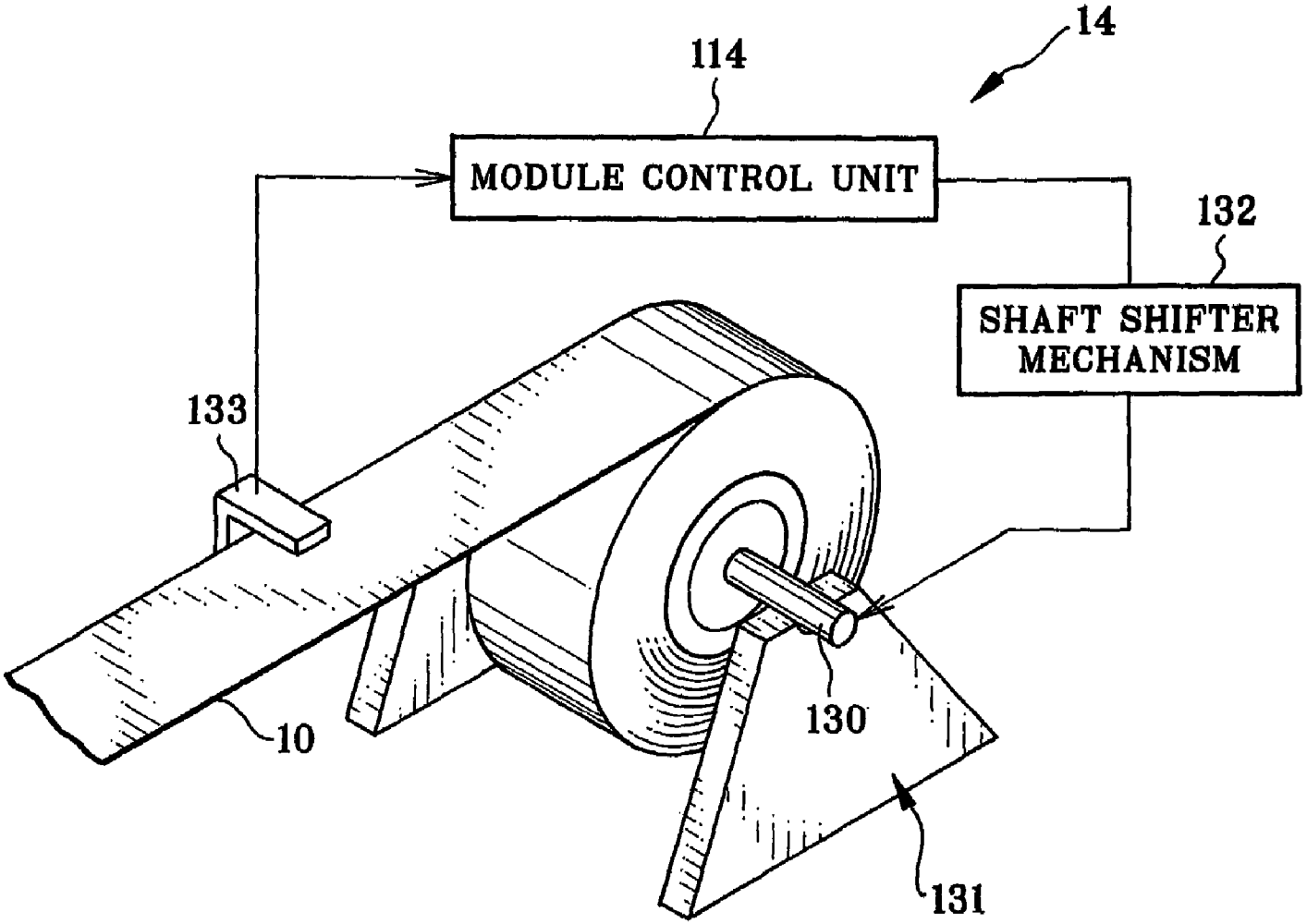
FIG. 13 is a perspective with a block diagram illustrating a conveyor module.

In FIG. 13, a construction for control of the conveyor module 14 is illustrated. There is a roll support 131, on which a drive shaft 130 for a roll is supplied both in a rotatable manner and in an axially movable manner. The shaft shifter mechanism 132 is used for absorbing a zigzag movement of the continuous sheet material 10 by shifting the drive shaft 130 of the roll axially. The module control unit 114 includes a drive circuit for driving the shaft shifter mechanism 132, a zigzag offset amount detection circuit and a control circuit for control of those. An image area sensor 133 as error detector is disposed on a path of feeding the continuous sheet material 10. The image area sensor 133 sends a video signal to the module control unit 114. The module control unit 114 detects a zigzag offset amount by processing the video signal in the zigzag offset amount detection circuit, and operates the shaft shifter mechanism 132 according to the detected zigzag offset amount. Thus, the conveyor module 14 is controlled and caused to operate normally.

Figure 14:
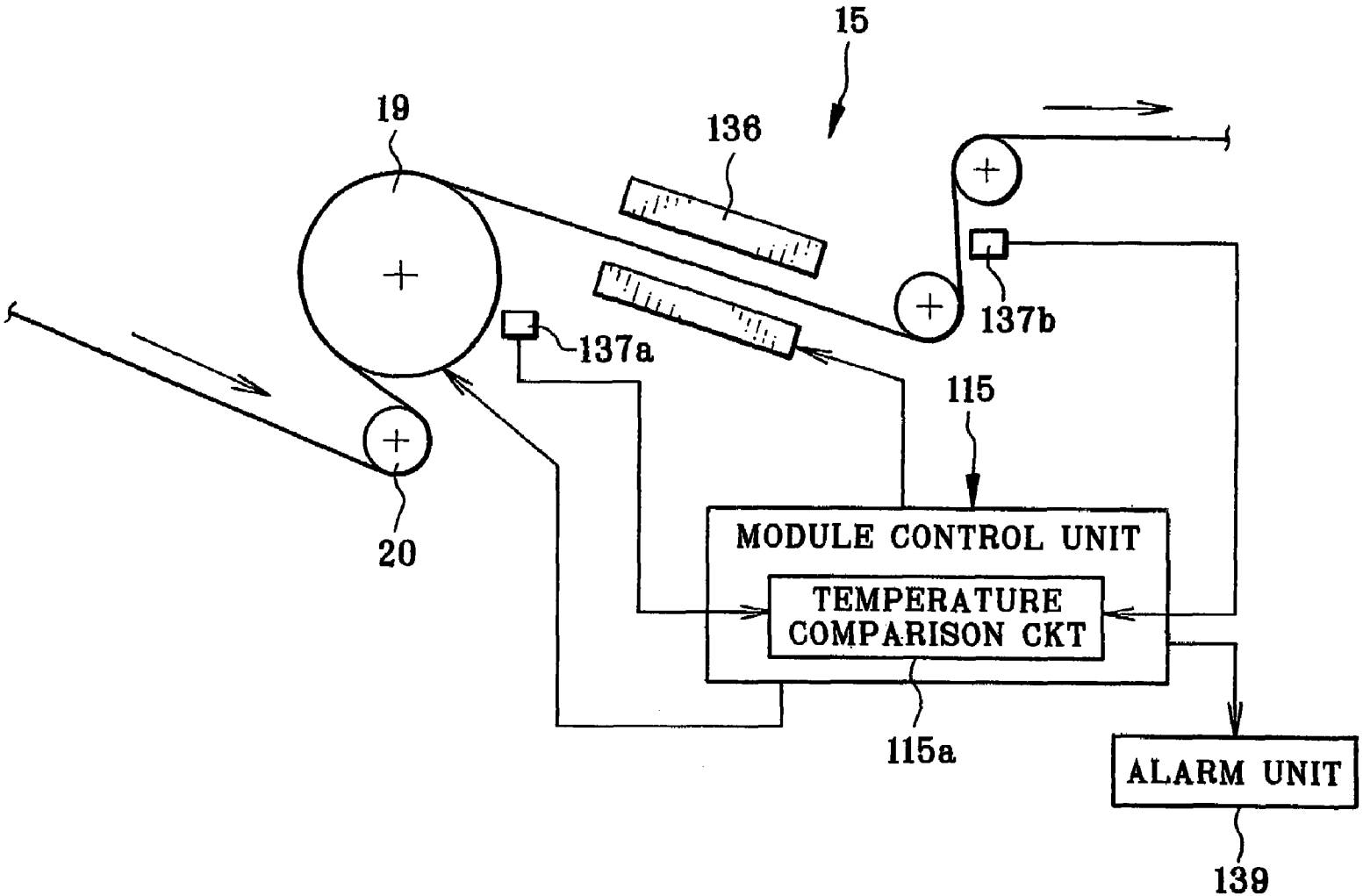
FIG. 14 is an explanatory view with a block diagram illustrating a decurler module.

In FIG. 14, a construction for control in the decurler module 15 is illustrated. The decurler mechanism 125 includes the heating rollers 19 and a cooler 136. A temperature sensor 137*a* as error detector measures the temperature of the heating rollers 19. A temperature sensor 137*b* as error detector measures the temperature of a portion of the continuous sheet material 10 after passing the cooler 136. The module control unit 115 includes a heater drive circuit, a cooler drive circuit, a temperature comparison circuit 115*a* as error detector, and a control circuit. The heater drive circuit drives a heater in the heating rollers 19. The cooler drive circuit drives the cooler 136. The temperature comparison circuit 115*a* obtains temperatures according signals from the temperature sensors 137*a* and 137*b*. The control circuit controls those elements.

The module control unit 115 compares the temperature detected by the temperature comparison circuit 115*a* with a reference range or tolerable normal temperature. If the detected temperature is not within the reference range, an alarm unit 139 is driven to generate a warning signal of informing accident or error in the particular module. The warning signal of the alarm unit 139 may be sound or any acoustic signal, and also may be illumination or any visible signal.

Figure 15:
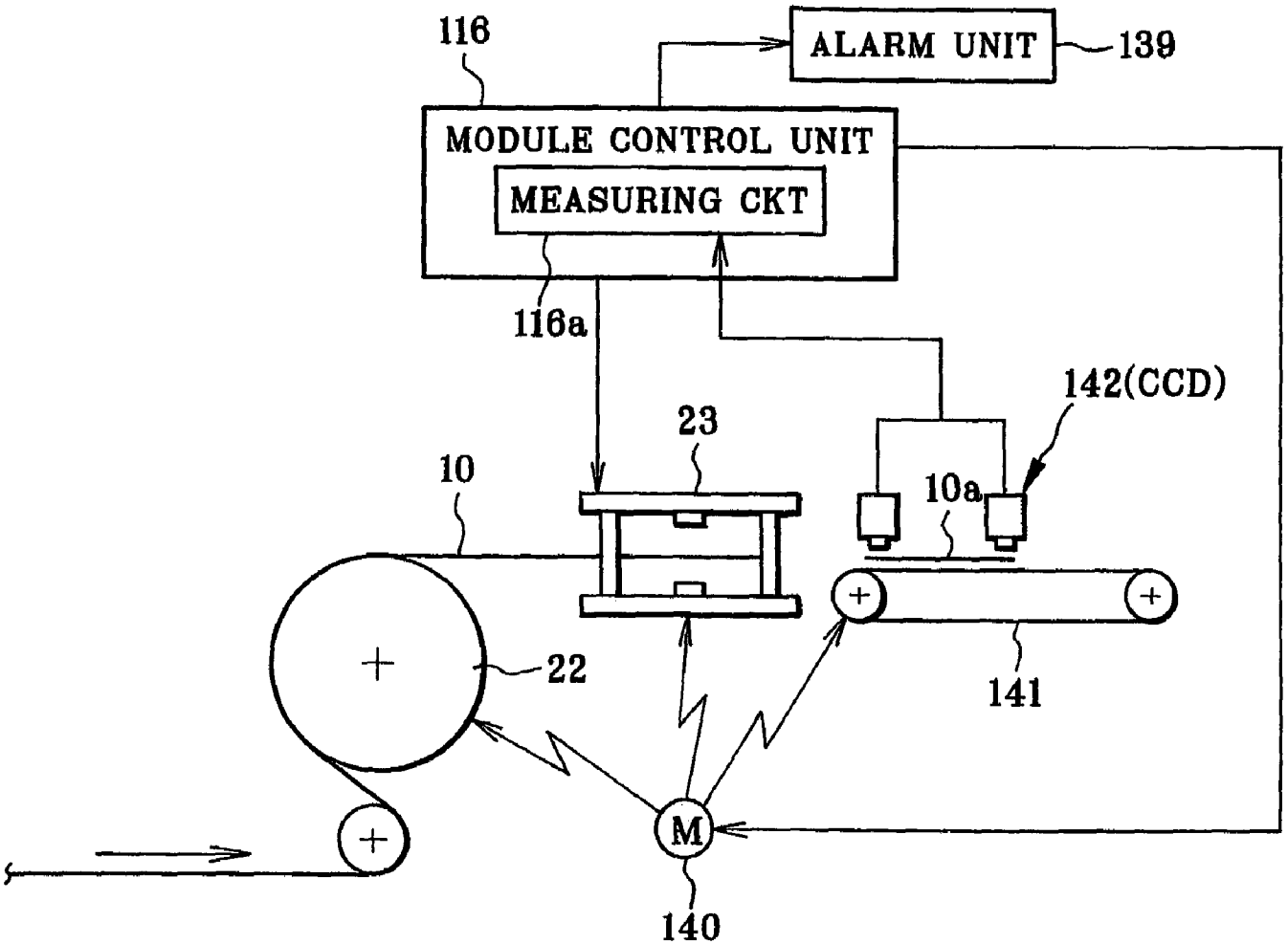
FIG. 15 is an explanatory view with a block diagram illustrating a cutter module.

In FIG. 15, a control mechanism for the cutter module 16 is illustrated. The cutter mechanism 126 includes a cutter motor 140, the rotary oscillation cutter 23 and the suction drum 22. Rotation of the cutter motor 140 is transmitted to each of the conveyor module 14, the decurler module 15 and the stacker module 17 by a drive main shaft and flexible coupling.

A sheet or X-ray sheet film 10*a* is obtained by cutting. A conveyor mechanism 141 feeds the sheet 10*a*. An image area sensor 142 as error detector is disposed on the path of feeding of the conveyor mechanism 141. The image area sensor 142 picks up an image of the sheet 10*a* for checking a cut shape of the sheet 10*a*. A video signal from the image area sensor 142 is sent to the module control unit 116. The module control unit 116 includes a cutter drive circuit, a measuring circuit 116*a* as error detector, and a control circuit for controlling those. The module control unit 116 receives the video signal from the image area sensor 142, and checks whether the sheet 10*a* being obtained has the predetermined size. If not, then the alarm unit 139 is driven for generating a warning signal.

Figure 16:
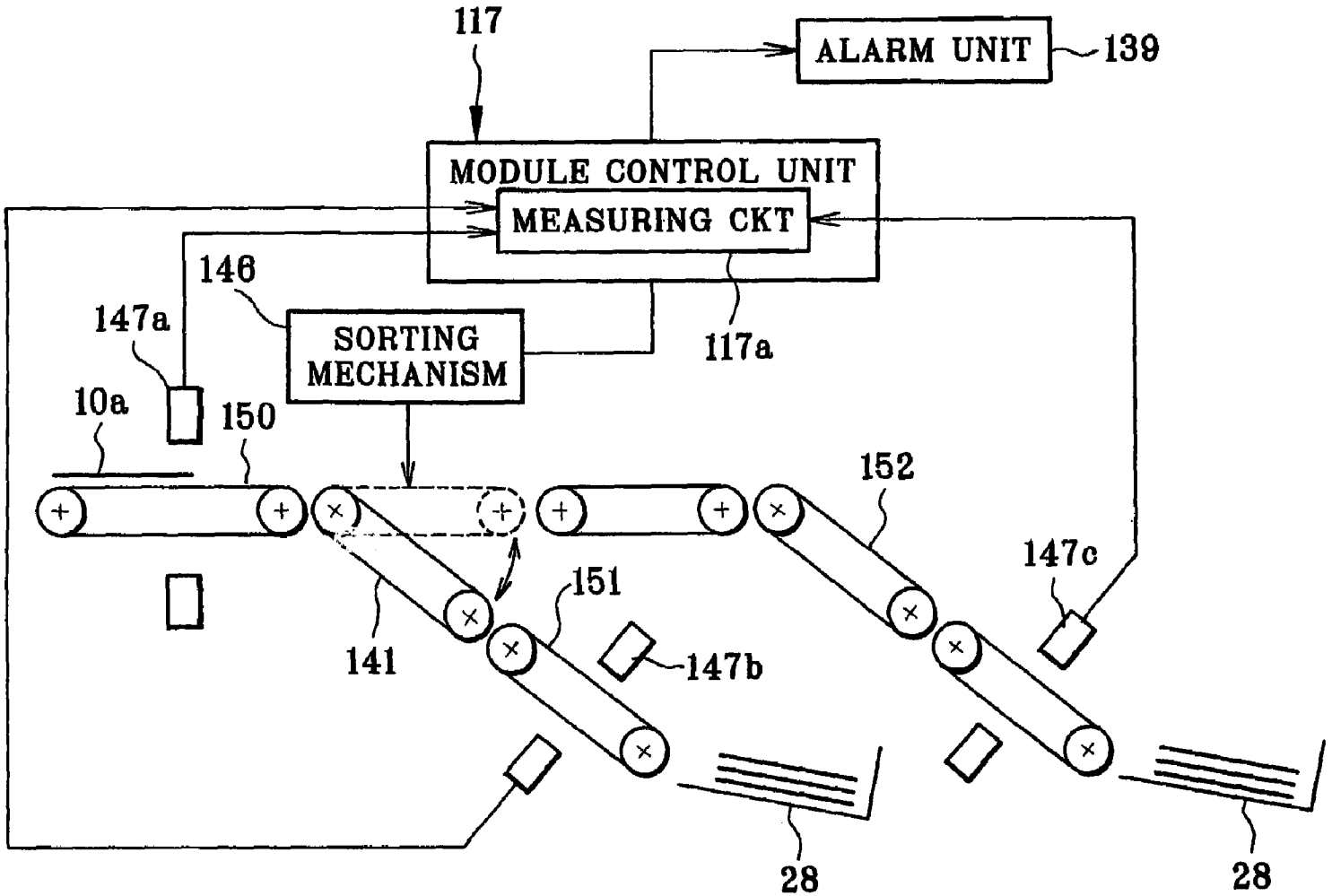
FIG. 16 is an explanatory view with a block diagram illustrating a stacker module.

In FIG. 16, a control mechanism of the stacker module 17 is illustrated. A sorting mechanism 146 pivotally moves the conveyor mechanism 141, and changes over feeding of the sheet 10*a* to one of a first path 151 and a second path 152. Sheet counting photo sensors 147*a*, 147*b* and 147*c* as error detector are disposed in respectively the first path 151, the second path 152 and a conveying path 150 which lies before the sorting mechanism 146. Any of the sheet counting photo sensors 147*a*-147*c* counts the sheet 10*a* passing the paths 150-152, and sends the module control unit 117 a detection signal upon passage of the sheet 10*a*.

The module control unit 117 includes a driving circuit, a measuring circuit 117*a* as error detector, and a control circuit. The driving circuit drives the sorting mechanism 146. The measuring circuit 117*a* receives detection signals from the sheet counting photo sensors 147*a*-147*c*, and counts a sheet number of sheet having passed. The control circuit controls those. The module control unit 117 evaluates detection signals from the sheet counting photo sensors 147*a*-147*c*, according to which the measuring circuit 117*a* counts the first number of sheets having passed the conveying path 150. Also, the number of sheets having passed the first and second paths 151 and 152 are counted, and are compared with the first number of the sheets, so the module control unit 117 checks whether an error has occurred in the sorting for the first and second paths 151 and 152. If an error has occurred, then the alarm unit 139 is driven to generate a signal.

In a manner similar to the cutting device 3 described heretofore, each of the cover-fitted sheet stack producing machine 4, the packaging device 5 and the box inserting device 6 includes the modules respectively having a construction for control in a normal state and an externally informing construction.

Figure 17:
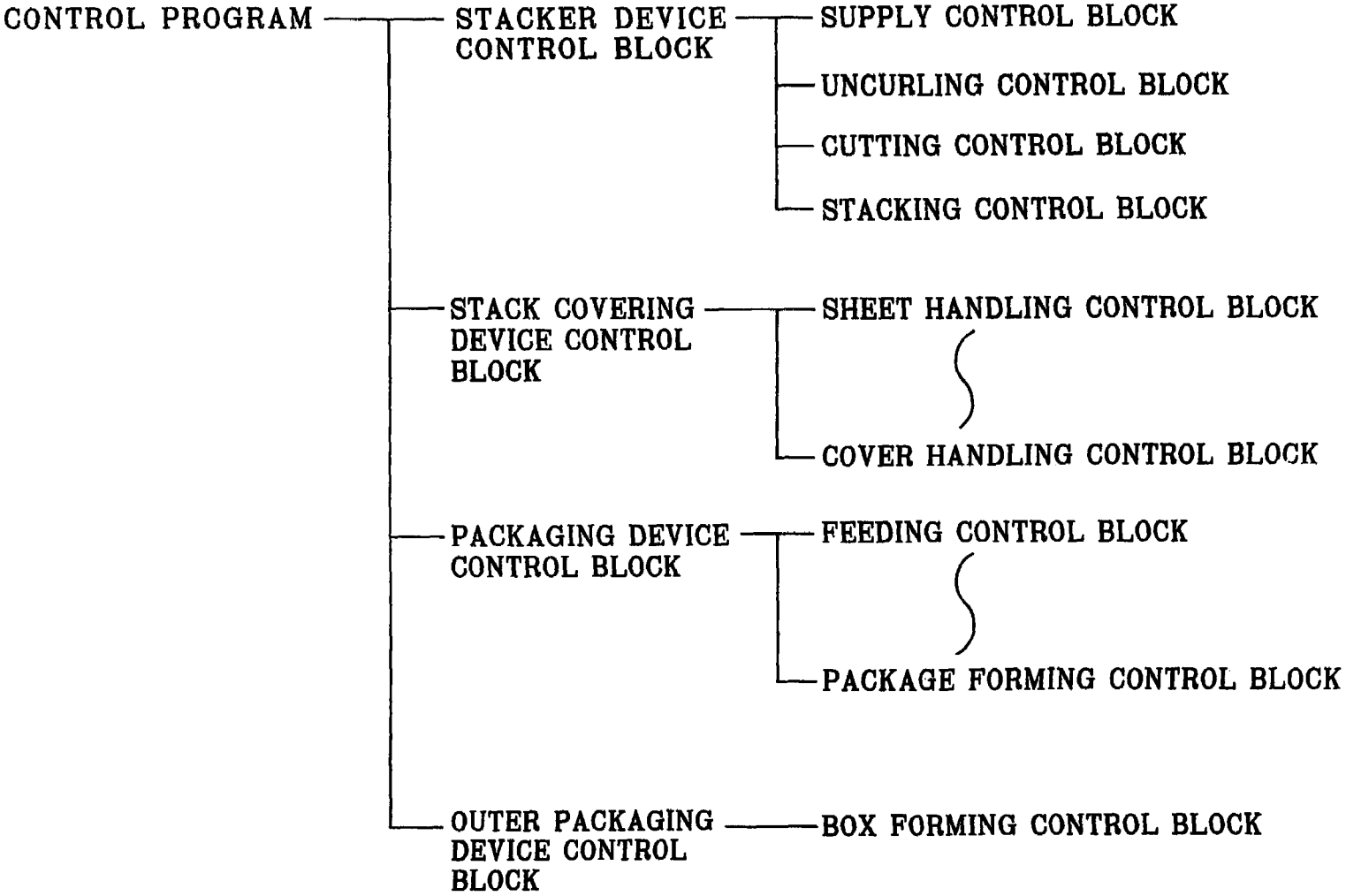
FIG. 17 is an explanatory chart illustrating a layered construction of a control program.

As illustrated in FIG. 17, the control program or software for controlling the sheet package producing system is written in a manner of structured programming. The structured programming is a programming technique in which common portions to be read repeatedly in plural processes are divided into plural parts or modules, and the plural parts or modules are combined in a layered structure, to systemize relations and layers of the processes efficiently.

The control program is structured in a hierarchy of three levels which are a system level, device level, and module level. In the device level, a part of the program is specified as a block (part) for each of the device. In the module level, a part of the program is specified as a block (part) for each of the module. As the program is written in such a manner, changes in the software can be easy if there are changes in the system in the level of hardware.

Figure 18:
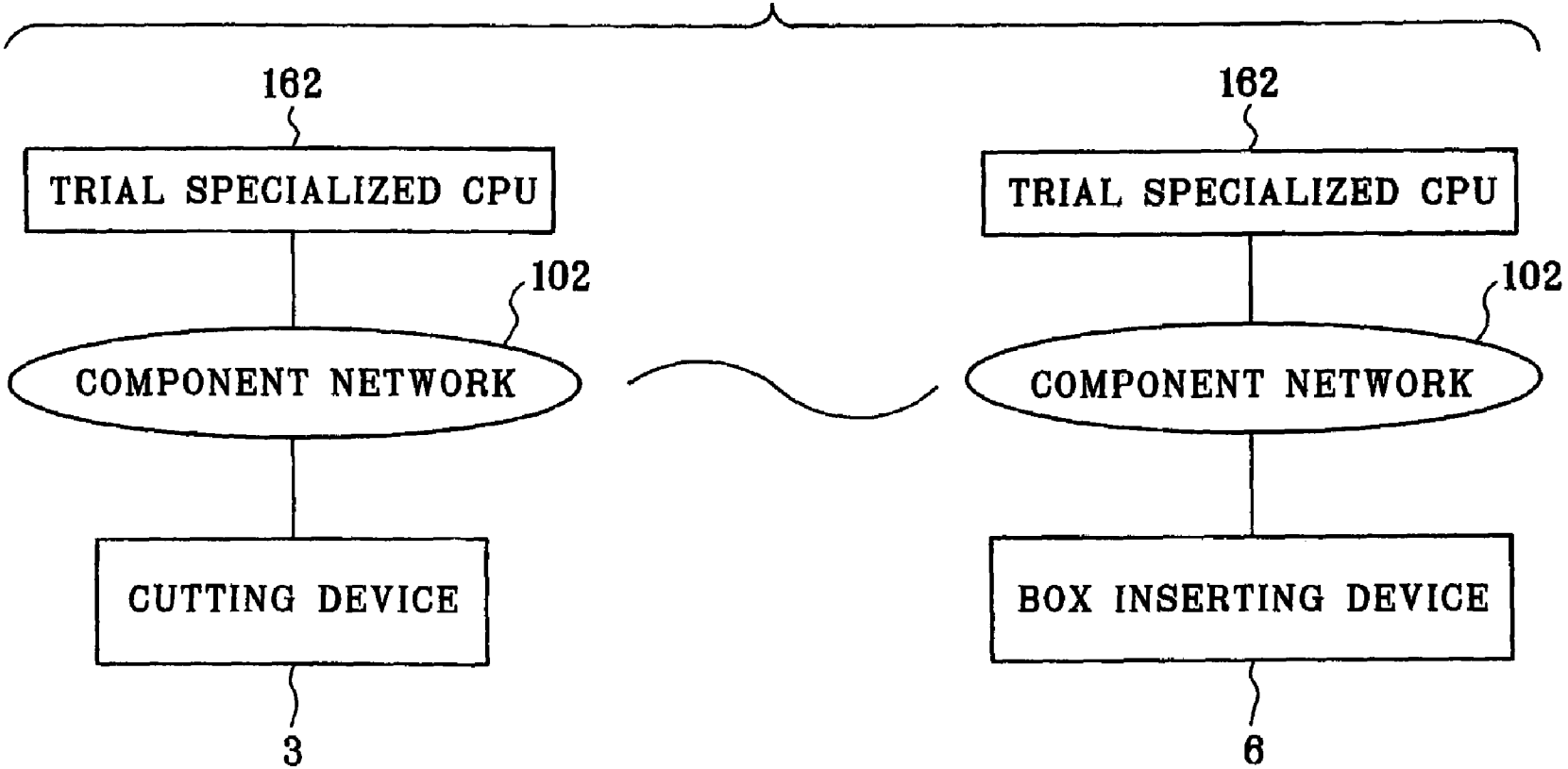
FIG. 18 is a block diagram illustrating a construction of a system for trial run of the sheet package producing system.

In FIG. 18, a trial specialized CPU 162 is connected with the respective slitting, cutting, cover-fitted sheet stack producing, packaging, and box inserting devices at the time of starting the producing system for running the devices in trial. The trial specialized CPU 162 is a controller for sending a start signal and a stop signal for operation to each of the modules. At the time of trial run, each of the devices is disconnected from the CPU 101, and connected with the trial specialized CPU 162. The connection with the trial specialized CPU 162 is effected also by the component network 102, and thus can be easy. Note that a plurality of the trial specified CPUs 162 can be used and may be connected with respectively the devices in a separate manner. This makes it possible to run the devices in a manner separate from one another. Therefore, the time for the trial run can be shortened, to reduce the time required for start of the system. If an error occurs, the alarm unit 139 is driven. It is easy to determine one of the modules where the error has occurred.

A trial run program executed by the trial specialized CPU 162 is set by partially using the above-described control program for portions required by each of the device. As the control program is structured, portions of the control program are easy to be used separately. Thus, it is effective in lowering the cost for the preparing the trial run program.

The operation of the embodiment is described now. When the producing system is started, the trial specialized CPU 162 is connected with the slitting, cutting, cover-fitted sheet stack producing, packaging, and box inserting devices, and causes those to operate in trial run. If an error occurs in any of those, the alarm unit 139 is actuated to inform the error. After the trial run, the system is started for production. In FIG. 1, the web 8 with a great width is set in the slitting device 2, and slitted by the slitting blades 9 at the width of the product. The continuous sheet material 10 is obtained, and wound about each of the spools 12 set in the roll containers 11.

The roll container 11 containing the continuous sheet material 10 is removed from the slitting device 2, and set into the cutting device 3. The constant tension control mechanism applies to the continuous sheet material 10, while the continuous sheet material 10 is drawn out and supplied. The continuous sheet material 10 is uncurled by the heating rollers 19 and the cooler in the decurler module 15.

The continuous sheet material 10 after being uncurled is fed by the suction drum 22 in the cutter module 16 by a regular amount. The rotary oscillation cutter 23 is synchronized with the suction drum 22 electrically and mechanically, and cuts the continuous sheet material 10 to form the sheets 10*a*. See FIG. 2. The sheets 10*a* are fed by a conveyor in the stacker module 17, and stacked on the sheet stacking frames 27 and 28 as the sheet stack 25.

In FIG. 3, the sheet handling module 30 inserts the support plates 45*c* and 45*d* into the grooves 27*e* and 27*f* at the support 27*a*. Then the support plates 45*a* and 45*b* are moved down toward the support plates 45*c* and 45*d*, to squeeze the sheet stack 25. The joints of the extendable arm 36 are driven, to pick up and remove the sheet stack 25 from the sheet stacking frame 27.

At the same time as producing and stacking the sheet stack 25, the protective cover 32 is pre-bent. Cardboard sheets in a quadrilateral shape as raw material are cut to obtain the protective cover 32 in a trapezoidal shape. In FIG. 4, the cover handling module 31 retains the protective cover 32 by means of suction of the suction pads 55.

In FIG. 5, the protective cover 32 is fed to the pre-bender module 33. The pre-bent portion of the protective cover 32 is inserted between the base plate 59 and the bender mechanism 60. A moving mechanism (not shown) moves down the bender mechanism 60, which squeezes the protective cover 32 together with the base plate 59, and pre-bends the protective cover 32. For remaining ones of the plurality of the protective cover 32, the cover handling module 31 sets the bending portions of the protective cover 32 at the pre-bender module 33 one after another.

In FIG. 6, the protective cover 32 being pre-bent is placed on the sheet stack 25 by the cover handling module 31, the sheet stack 25 being positioned inside the chuck 44 of the sheet handling module 30. The sheet handling module 30 causes the chuck 44 to squeeze the sheet stack 25 and the protective cover 32. In FIG. 7, the chuck 44 is rotated by the rotating mechanism 40, to turn over the chuck 44 to locate the protective cover 32 under the sheet stack 25. Then the sheet stack 25 and the protective cover 32 are supplied to the cover folding module 34.

In the cover folding module 34, the arm portion 65 rotates from the position of the phantom line to the position of the solid line. The pad 66 pushes the protective cover 32, and folds the portion of the protective cover 32 after being pre-bent. The cover-fitted sheet stack 67 is obtained in combination of the protective cover 32 and the sheet stack 25. In FIG. 8, the pusher 69 with the retention pad 68 transfers the cover-fitted sheet stack 67 to the packaging device 5 with the protective cover 32 kept closed by the retention pad 68 in contact with the upper surface. At the time of feeding the cover-fitted sheet stack 67, the guide plates 63 are drawn inside the base plate 62 without protrusion over the base plate 62.

In the packaging device 5, the cover-fitted sheet stack conveyor module 71 feeds the cover-fitted sheet stack 67 from the cover-fitted sheet stack producing machine 4 toward the packaging module 72. In FIGS. 8 and 9, the packaging module 72 forms the packaging bag material 75 into a tubular shape. The center sealer is driven to weld the junction portions 76*d* together to contain the cover-fitted sheet stack 67 in the packaging bag material 75. Then the cross sealer is driven to weld and cut the front and rear portions of the packaging bag material 75. Air is removed from the packaging bag by an air removing pipe, to enclose the cover-fitted sheet stack 67 in the packaging bag 76.

In the package sealer module 73, a robot hand grasps the corners of the rear fillet 76*a* of the packaging bag 76. The fillet folding device of a general-purpose type folds the rear fillet 76*a* while the robot hand applies tension to the rear fillet 76*a* to prevent wrinkles. The front fillet 76*b* of the packaging bag 76 is folded similarly. The rear and front fillets 76*a* and 76*b* are kept from opening by the retention mechanism for contacting the packaging bag 76. Finally, the sticker 78 is attached to the packaging bag 76, to enclose the packaging bag 76 tightly.

In the box inserting device 6, a general-purpose robot of a box forming module pre-bends the blank sheet 83. See FIG. 10. After the pre-bending, the hot-melt gun 84 applies hot-melt adhesive agent to the bending portions, to form the decorative box 82 by attaching those portions.

In the box inserting module 80, a guide plate is inserted into the decorative box 82 being suitably shaped, to insert the packaging bag 76 with the cover-fitted sheet stack 67 into the decorative box 82. Then a lid of the decorative box 82 is closed, to attach the sticker 86. Also, various information is printed on the decorative box 82, such as a lot number. Then the decorative box 82 is subjected to inspection of appearance by use of an image processing device, to check attachment of the sticker, the printed state, and the like.

The decorative box 82 containing the packaging bag 76 is handled by the cardboard caser, which inserts five (5) decorative boxes 82 into a cardboard box. Of course, the number of the decorative boxes 82 may be more than five (5), or less than five (5).

Each of the devices is constituted by plural modules, which are connected by means of the component network 102 with the CPU 101 controlling the entirety of the system. Each of the modules has a pallet or base plate having a common size determined in consideration of the expected maximum size of an X-ray film. Each of the modules can be added, removed or exchanged easily to modify system partially. Furthermore, the control program is designed according to the structured programming, so the software can be changed if there are changes in the hardware.

In the present embodiment, the CPU 101 as a single unit is used in combination with the component network 102, for control of plural modules in the distributed processing. It is possible to lower the manufacturing cost with the single CPU in comparison with plural CPUs for the purpose of distributed precessing. Also, the use of the component network 102 is effective in sending and receiving signals at a very high speed between the CPU 101 and the module control units.

Figure 19:
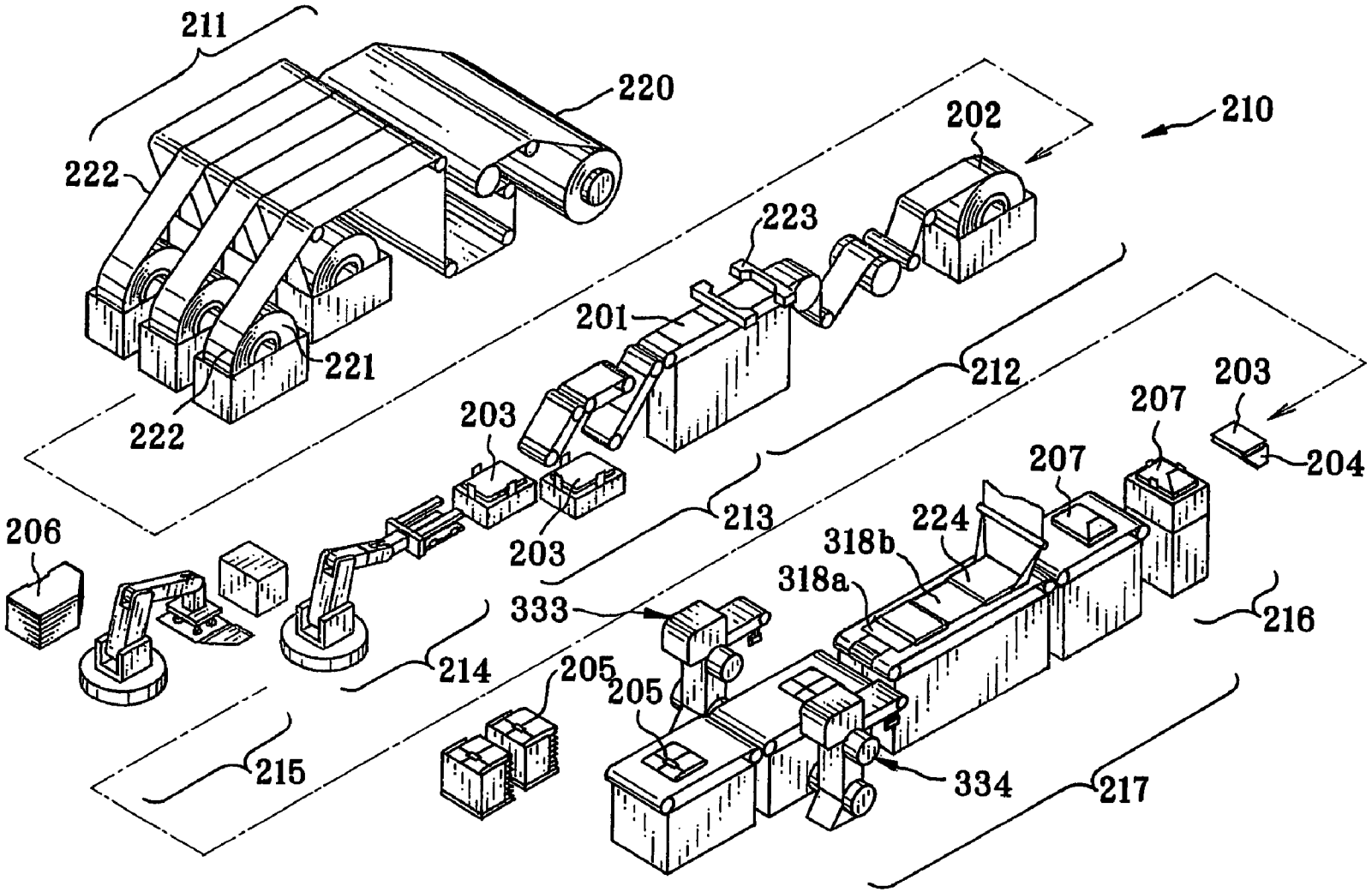
FIG. 19 is a perspective illustrating another preferred embodiment of sheet package producing system.

A sheet handling device according to a preferred embodiment of the invention is described now with reference to FIGS. 19-31, in which plural stacked sheets can be rapidly handled. In FIG. 19, sheets or X-ray sheet films 201 can be formed by cutting continuous sheet material 202 unwound from a roll. Plural sheets are stacked in a form of a sheet stack 203. A protective cover 204 of paper is partially fitted on the sheet stack 203, to form a cover-fitted sheet stack 207, which is wrapped by a packaging bag 205 before shipment. To handle the protective cover 204, plural protective covers 206 in an unfolded state are stacked and prepared. The protective cover 204 is picked up from the top of the plural protective covers 206 one after another, and placed on the sheet stack 203. Then the sheet stack 203 with the protective cover 204 is turned upside down. Portions of the protective cover 204 are bent to cover portions of the sheet stack 203.

In FIG. 19, a sheet package producing system 210 includes a slitting device 211, a cutting device 212 with a cutter module, a stacking device 213 with a stacking module, a sheet handling device 214 or module, a cover handling device 215 or module, a cover folding device 216 or module, and a packaging device 217 with a packaging module. Those devices are connected in series with one another.

Web 220 with a great width is unwound from a roll. A slitter 221 in the slitting device 211 slits the web 220 at a predetermined width of the X-ray film. Continuous sheet material 222 is obtained, and wound in a roll form. After the winding, the continuous sheet material 222 is supplied to the cutting device 212.

The cutting device 212 unwinds the continuous sheet material 222, feeds the same at a regular distance corresponding to the film width. A cutter mechanism 223 in the cutting device 212 cuts the continuous sheet material 222 into sheets. The stacking device 213 stacks the sheets 201 on one another, to form the sheet stack 203 with the sheets 201 of the predetermined number. The cover handling device 215 is actuated in synchronism with the sheet handling device 214. So the sheet handling device 214 handles the sheet stack 203 at the same time as the cover handling device 215 handles the protective cover 204. After this, the sheet stack 203 and the protective cover 204 are moved to a common operation region assigned for both of the sheet handling device 214 and the cover handling device 215. The protective cover 204 is placed on the sheet stack 203 handled by the sheet handling device 214 at the common operation region. Then the sheet handling device 214 turns over its robot hand, orients the protective cover 204 under the sheet stack 203, and supplies those to the cover folding device 216.

The cover folding device 216 folds the protective cover 204, and causes the protective cover 204 to cover the sheet stack 203 partially. The cover-fitted sheet stack 207 is transferred to the packaging device 217. A pillow type of packaging mechanism 224 in the packaging device 217 wraps the cover-fitted sheet stack 207 in a light-tight packaging bag material. Front and rear fillet are folded to obtain the packaging bag 205 in a compact form. The packaging bags 205 are placed on the inside of a magazine by a unit amount of a predetermined number, and are transferred to a succeeding station. Elements from the slitting device 211 to the packaging device 217 are disposed in a dark room.

Figure 20:
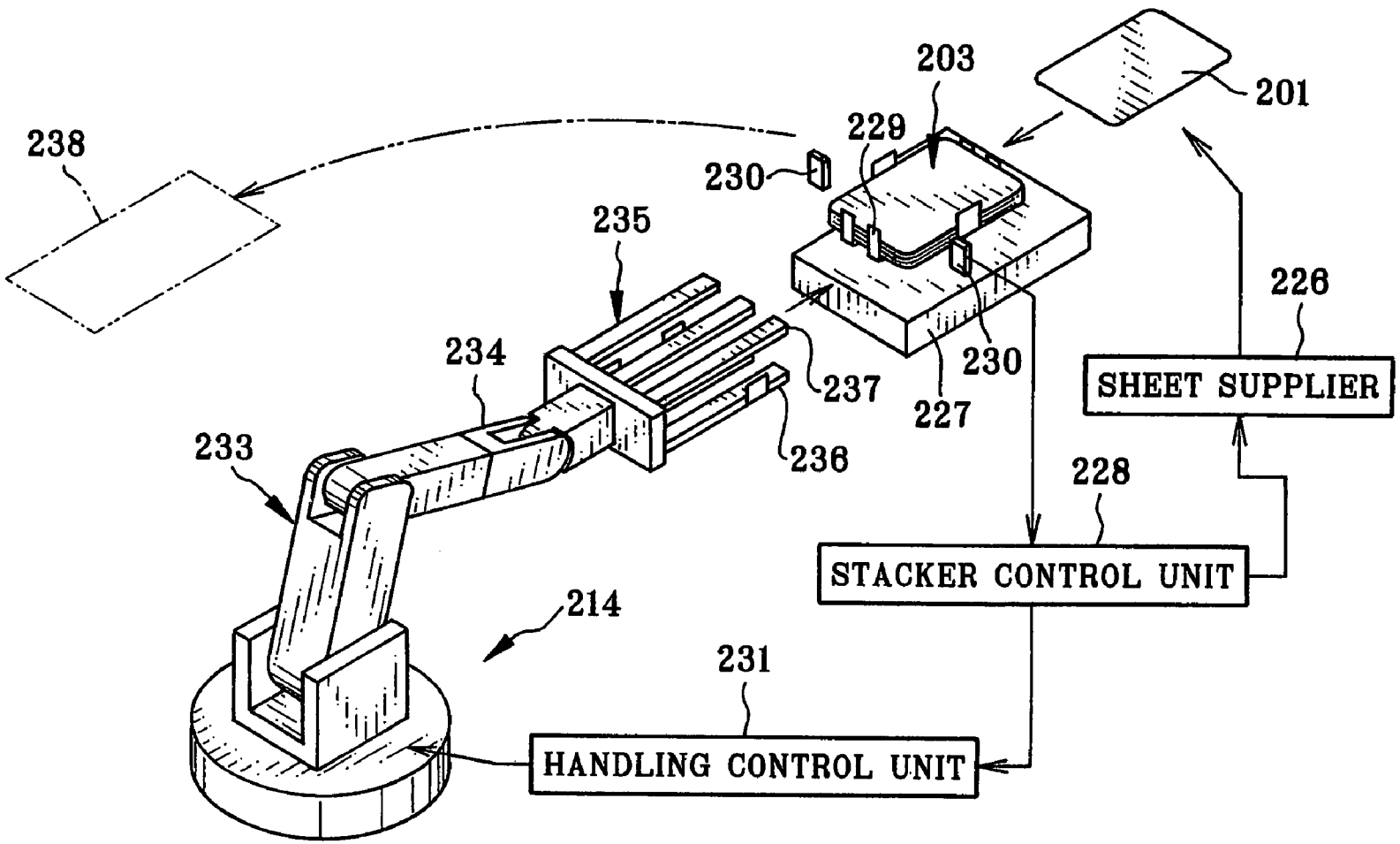
FIG. 20 is a perspective with a block diagram illustrating handling of a handling robot for a stack of sheets.

In FIG. 20, the stacking device 213 is constituted by a sheet supplier 226, a stacking station 227 and a stacker control unit 228 or CPU. The sheet supplier 226 feeds the sheets toward the stacking station 227 one after another. A stacking frame 229 is disposed at the stacking station 227, and receives the sheets 201 stacked one after another. A photo interrupter 230 as a photo sensor is disposed at the stacking frame 229, and monitors the thickness of the sheet stack, detects that the number of the sheets 201 being stacked comes up to a reference number, to send a stacking end signal to the stacker control unit 228. The stacker control unit 228, upon receiving the stacking end signal, controls the sheet supplier 226 and stops supply of the sheets. When the sheet handling device 214 handles the sheet stack 203 from the stacking frame 229, the stacker control unit 228 causes the sheet supplier 226 to restart supplying the sheets 201. In response to the stacking end signal, a handling control unit 231 is supplied the stacker control unit 228 with a handling ready signal, which will be described later.

The sheet handling device 214 is constituted by a sheet handling rotational moving mechanism 233, namely a six-axis multi-joint robot, and the handling control unit 231. A chuck 235 is disposed on an end of a rotational moving arm 234 of the sheet handling rotational moving mechanism 233. The chuck 235 includes a pair of support plates 236 and 237, which are moved in parallel by a hydraulic or pneumatic control. If the sheet stack 203 is pressed with excessive force, there occurs pressure fogging, scratch or other damages because of the X-ray film. Therefore, the support plates 236 and 237 are driven by a control in a hydraulic or pneumatic technique, and clamp the sheet stack 203 lightly in a vertical direction.

The handling control unit 231 causes the chuck 235 to clamp the sheet stack 203 in response to the handling ready signal, and move the sheet stack 203 to a transfer position, which is included in an operation region 238 common between the sheet handling device 214 and the cover handling device 215. The sheet stack 203 stands by until the protective cover 204 from the cover handling device 215 is placed on the sheet stack 203. Then the chuck 235 is turned upside down, and is controlled for feeding to the cover folding device 216. The chuck 235 is supported in a manner rotatable at the end of the rotational moving arm 234, and is controlled for its orientation to prevent offsetting the sheet stack 203 according to the control of the rotational direction about the axis of the chuck 235, and control of the movement on remaining five (5) axes.

The handling control unit 231 stores a program for a sequential operation synchronized with the stacker control unit 228, the cover handling device 215, and the cover folding device 216.

Figure 21:
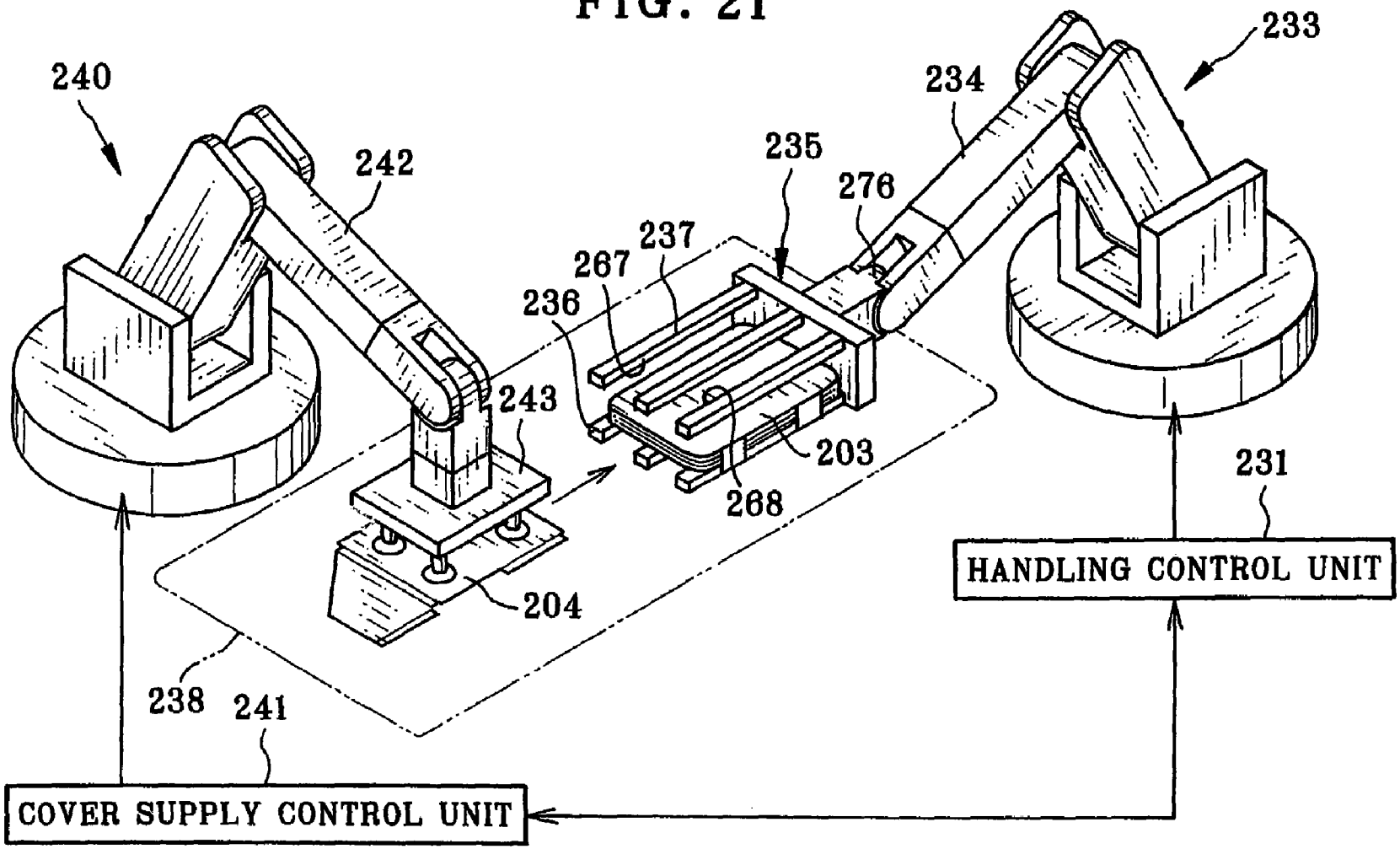
FIG. 21 is a perspective illustrating operation of placing a protective cover on the sheet stack.

In FIG. 21, the cover handling device 215 of FIG. 19 includes a cover handling robot 240 and a cover supply control unit 241. The cover handling robot 240 is a six-axis multi-joint robot. The cover supply control unit 241 controls the cover handling robot 240. A robot arm 242 is included in the cover handling robot 240. A chuck 243 is disposed at an end of the robot arm 242. The chuck 243 includes plural suction pads for retaining the protective cover 204 by suction. As illustrated in FIG. 4, there is stacked protective covers, from which the chuck 243 captures an uppermost one, and moves the protective cover 204 to a pre-bending station one after another. See FIG. 5 at the bender mechanism 60 and the base plate 59. A pre-bending pad is disposed in the pre-bending station. The chuck 243 moves down at a pre-bending position, and presses the bending portion of the protective cover 204 against the pre-bending pad, to pre-bend the bending portion. After this, the protective cover 204 is moved to a ready position defined in the operation region 238 which the sheet handling rotational moving mechanism 233 will access.

In FIG. 21, the chuck 235 of the sheet handling rotational moving mechanism 233 stands by at the operation region 238. The chuck 235 is moved to a transfer position, before the support plates 236 and 237 are opened. The chuck 235 is oriented to keep the sheet stack 203 horizontally extended. The cover handling robot 240 moves the chuck 243 to the ready position in the operation region 238. When the cover handling robot 240 receives a ready signal from the handling control unit 231, the cover handling robot 240 moves the chuck 243 to the transfer position for the protective cover 204 to lie on the sheet stack 203. After the movement, the suction for retention is discontinued, to place the protective cover 204 on the sheet stack 203. After the placement, the chuck 243 is returned to the ready position. Thus, the cover supply control unit 241 sends an end signal to the handling control unit 231. Upon receiving the end signal, the handling control unit 231 moves the chuck 235 to a position for supply to the cover folding device 216.

Figure 22:
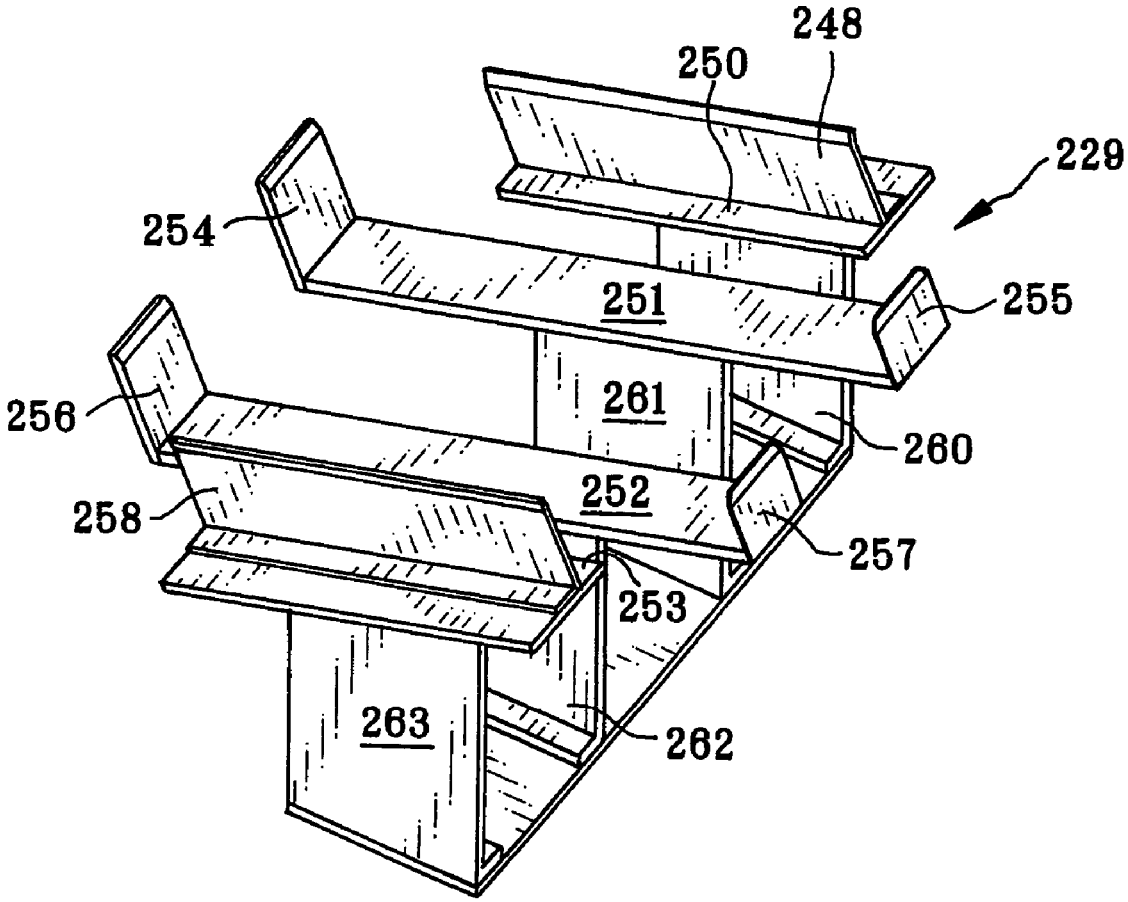
FIG. 22 is a perspective illustrating a sheet stacking frame.
Figure 23:
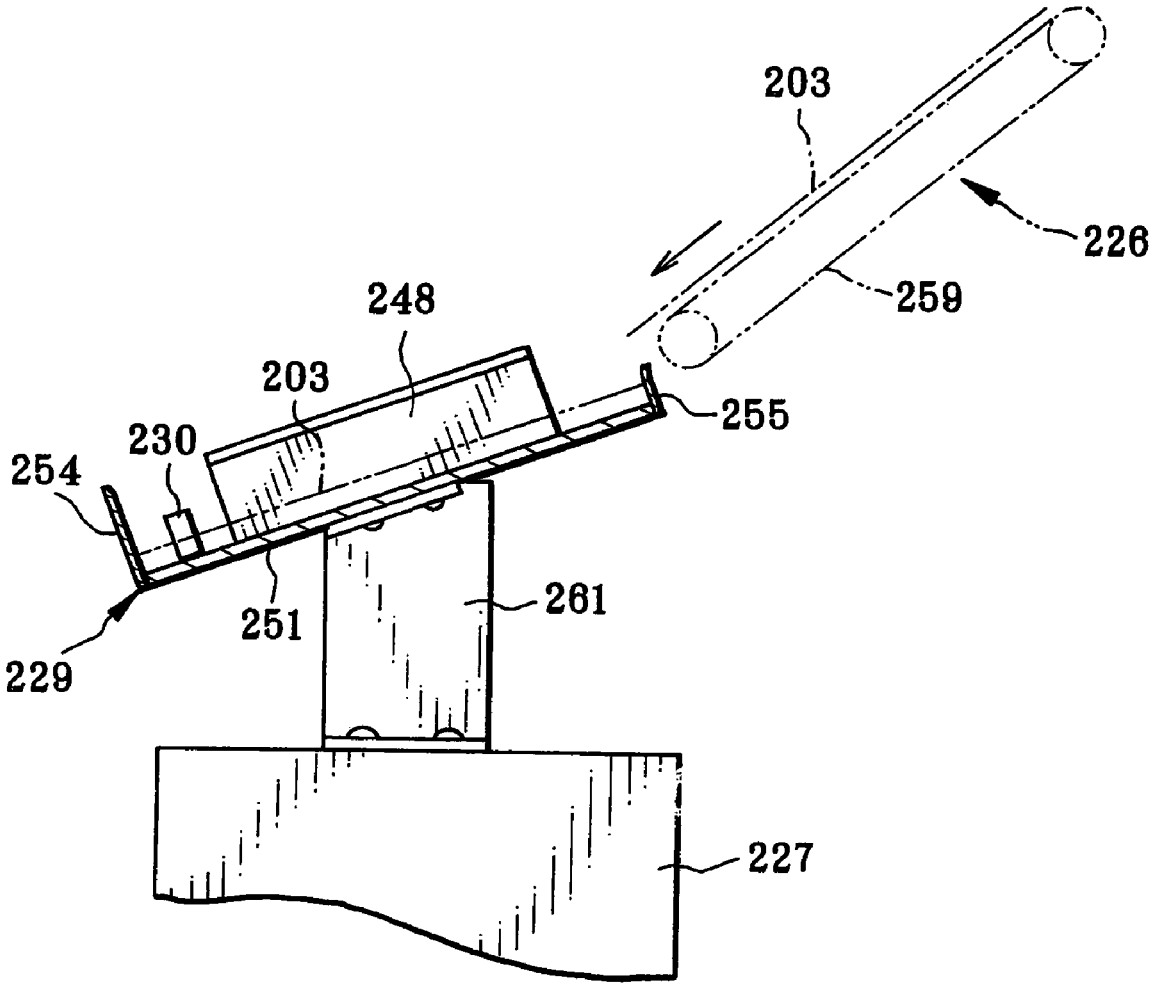
FIG. 23 is an explanatory view in elevation illustrating stacking of sheets on the stacking frame.

In FIGS. 22 and 23, the stacking frame 229 is constituted by inclined middle support plates 251 and 252, inclined lateral support plates 250 and 253, front and rear guide walls 254, 255, 256 and 257, and lateral guide walls 248 and 258. The sheets 201 are stacked on the stacking frame 229. A conveyor 259 in the sheet supplier 226 feeds the sheets 201. The conveyor 259 is supported with an inclination to come down in the feeding direction. Erect panels 260, 261, 262 and 263 support the inclined support plates 250-253 kept at predetermined intervals. The inclined support plates 250-253 are inclined in the same direction as the conveyor 259.

The inclined middle support plates 251 and 252 among the inclined support plates 250-253 have as great a size in the longitudinal direction as a size of the sheet stack 203 in the feeding direction. The front and rear guide walls 254-257 protrude erectly in the L-shape at ends of the inclined middle support plates 251 and 252. The inclined lateral support plates 250 and 253 have a length for partially supporting a lower face of the sheet stack 203 at lateral ends. The lateral guide walls 248 and 258 protrude erectly from the inclined lateral support plates 250 and 253 in the L-shape, and guide lateral edges of the sheet stack 203. The erect panels 260-263 extend vertically for keeping a space for insertion of the chuck 235 of the sheet handling rotational moving mechanism 233.

Figure 24:
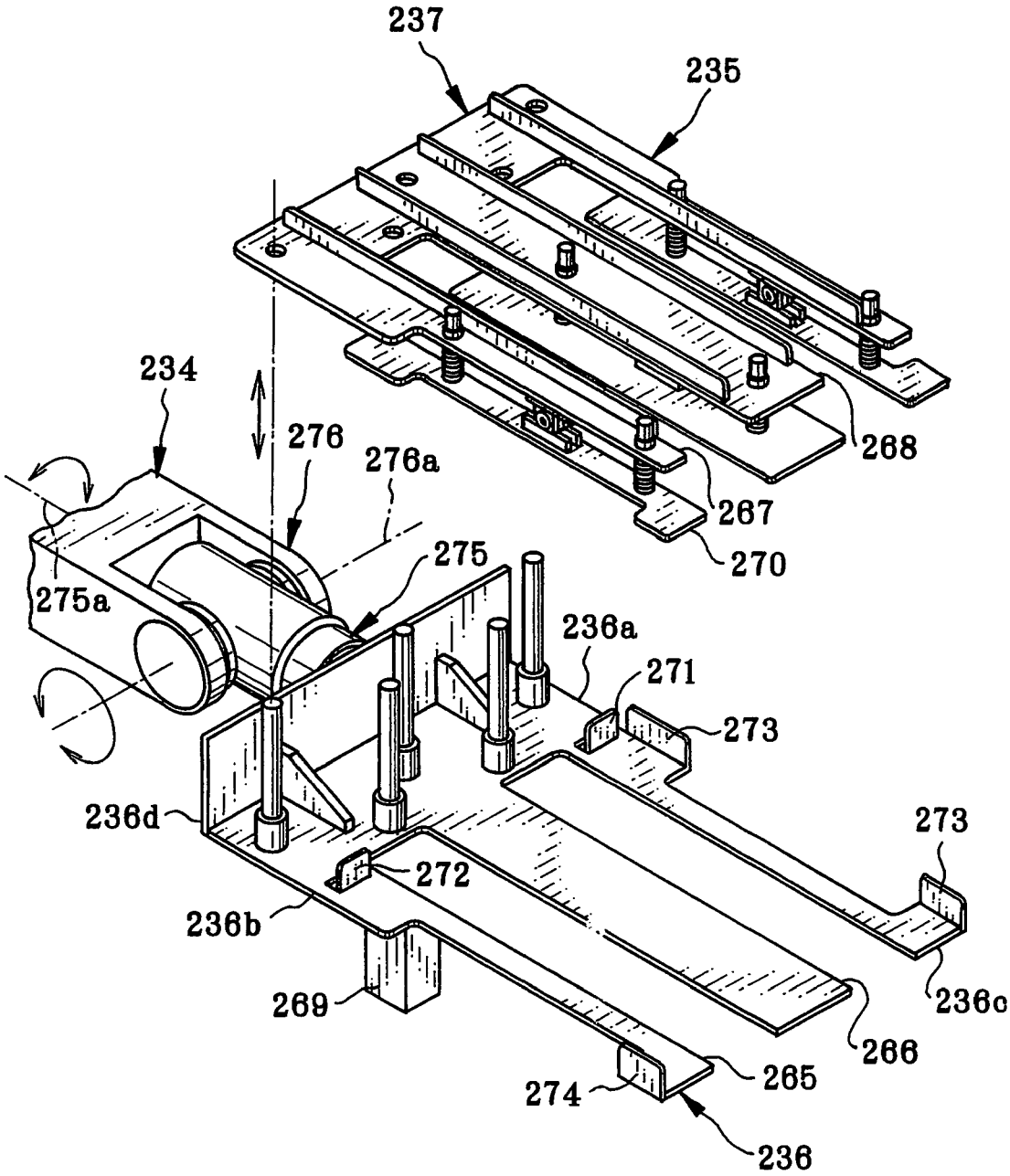
FIG. 24 is an exploded perspective illustrating a chuck.

In FIG. 24, the support plates 236 and 237 in the sheet handling rotational moving mechanism 233 move up and down in parallel. Slots 265 and 266 are formed in the support plate 236. Slots 267 and 268 are formed in the support plate 237. The support plates 236 and 237 have a fork shape, and become inserted in spaces between the inclined support plates 250-253. The support plate 237 is supported in a manner movable in a direction to clamp the sheet stack 203 toward the support plate 236. A cylinder 269 is disposed at the support plate 236, has a hydraulically or pneumatically driven structure, and moves the support plate 237 between clamping and releasing positions. A retention plate 270 is secured on a lower surface of the support plate 237, is biased by springs in a downward direction. The retention plate 270 includes three plate elements arranged in a fork shape the same as the support plates 236 and 237. Even when there occurs irregularity in parallel movement of the support plate 237 to the clamping position or irregularity in the thickness of the sheet stack 203, resiliency of the springs at each of the plate elements can absorb the irregularity, so that the sheet stack 203 can be pressed at a regularized surface pressure.

The support plate 236 is connected with the rotational moving arm 234 by a wrist mechanism or orientation changer. Stopper projections 271 and 272 protrude from the support plate 236 for guiding an advancing edge of the sheet stack 203. End guide projections 273 and 274 protrude from the support plate 236 for guiding lateral edges of the sheet stack 203.

The wrist mechanism or orientation changer includes a first rotating mechanism 275 and a second rotating mechanism 276. The first rotating mechanism 275 causes the support plate 236 to rotate about a first axis 275*a* that extends in the extending direction of the rotational moving arm 234. The second rotating mechanism 276 causes the support plate 236 to rotate about a second axis 276*a* that is perpendicular to the first axis 275*a* and passes on the plane of swing of the support plate 236. The handling control unit 231 controls the first and second rotating mechanisms 275 and 276 to incline the support plate 236 in the course of horizontal swing of the sheet stack 203 toward the operation region 238 in order to keep the sheets 201 from being offset even under conditions of centrifugal force and inertia.

Figure 25:
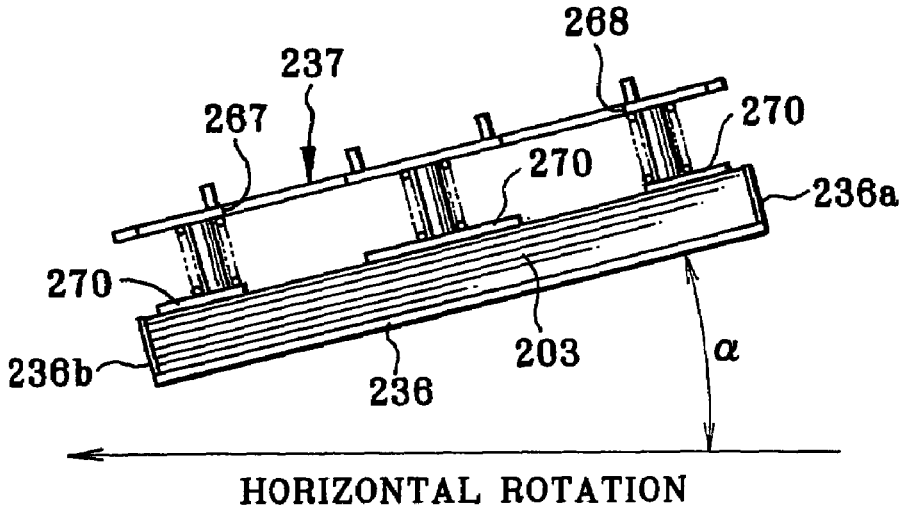
FIG. 25 is an explanatory view in side elevation illustrating an orientation control of the chuck as viewed in a radial direction of the horizontal swing.
Figure 26:
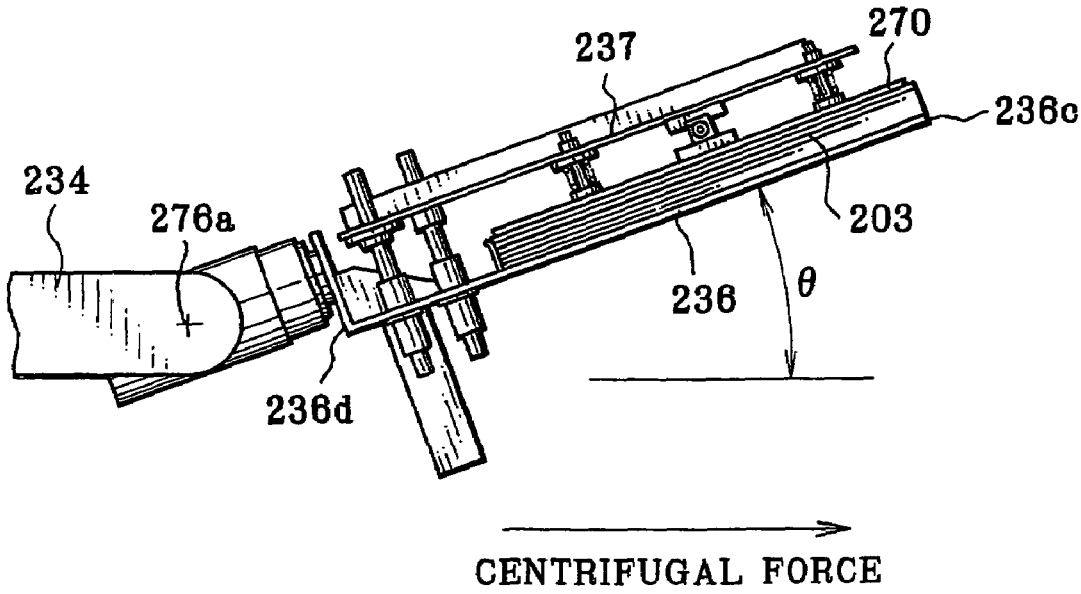
FIG. 26 is an explanatory view in front elevation illustrating a further orientation control of the chuck as viewed in a direction perpendicular to that of FIG. 25.
Figure 27:
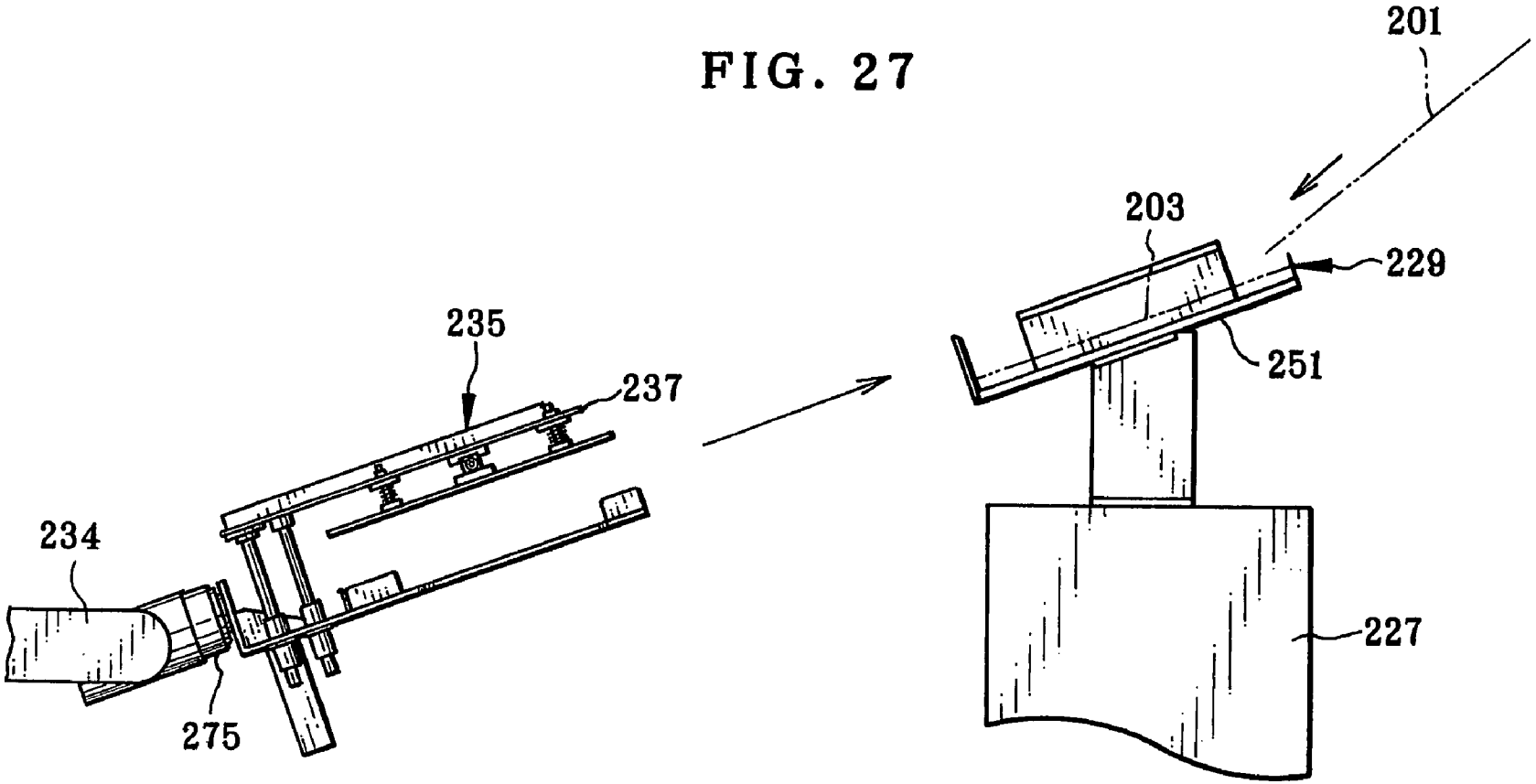
FIG. 27 is an explanatory view in elevation illustrating an orientation control of the chuck in handling the sheet stack.

A path of horizontal rotational movement is divided according to the speed of the chuck 235 into three sections, which are an accelerating path section, regular speed path section and decelerating path section. In the accelerating path section, the support plates 236 and 237 are inclined as depicted in FIG. 25. An upstream edge 236*a* of the support plate 236 as viewed in the moving direction is oriented higher than a downstream edge 236*b* by an angle $\alpha$ of an inclination, in order to prevent inertia of the sheet stack 203 from offsetting the sheet stack 203 in a direction reverse to the moving direction. In the regular speed path section, the support plates 236 and 237 are inclined longitudinally as depicted in FIG. 26. A front end 236*c* of the support plate 236 farther from the second axis 276*a* is oriented higher than a rear end 236*d* by an angle $\theta$ of an inclination, in order to prevent centrifugal force of the sheet stack 203 from offsetting the sheet stack 203 in a radial direction. In the decelerating path section, the support plates 236 and 237 are inclined in reverse to the direction set in the accelerating path section. The downstream edge 236*b* as viewed in the moving direction is oriented higher than the upstream edge 236*a* by the angle $\alpha$, in order to prevent inertia of the sheet stack 203 from offsetting the sheet stack 203 in the moving direction. Note that the inclination to orient the front end 236*c* higher may be used also in the accelerating and decelerating path sections additionally, to prevent offsetting due to the centrifugal force.

The operation of the sheet handling device of the embodiment is described now. The sheets 201 are cut from the web 220, and stacked on the stacking frame 229. When the number of the sheets 201 on the stacking frame 229 comes up to a predetermined number, then the photo interrupter 230 sends a stacking end signal to the stacker control unit 228. When the stacker control unit 228 receives the stacking end signal, the stacker control unit 228 stops the sheet supplier 226 from supplying the sheets 201, and sends a handling ready signal to the handling control unit 231.

Figure 28:
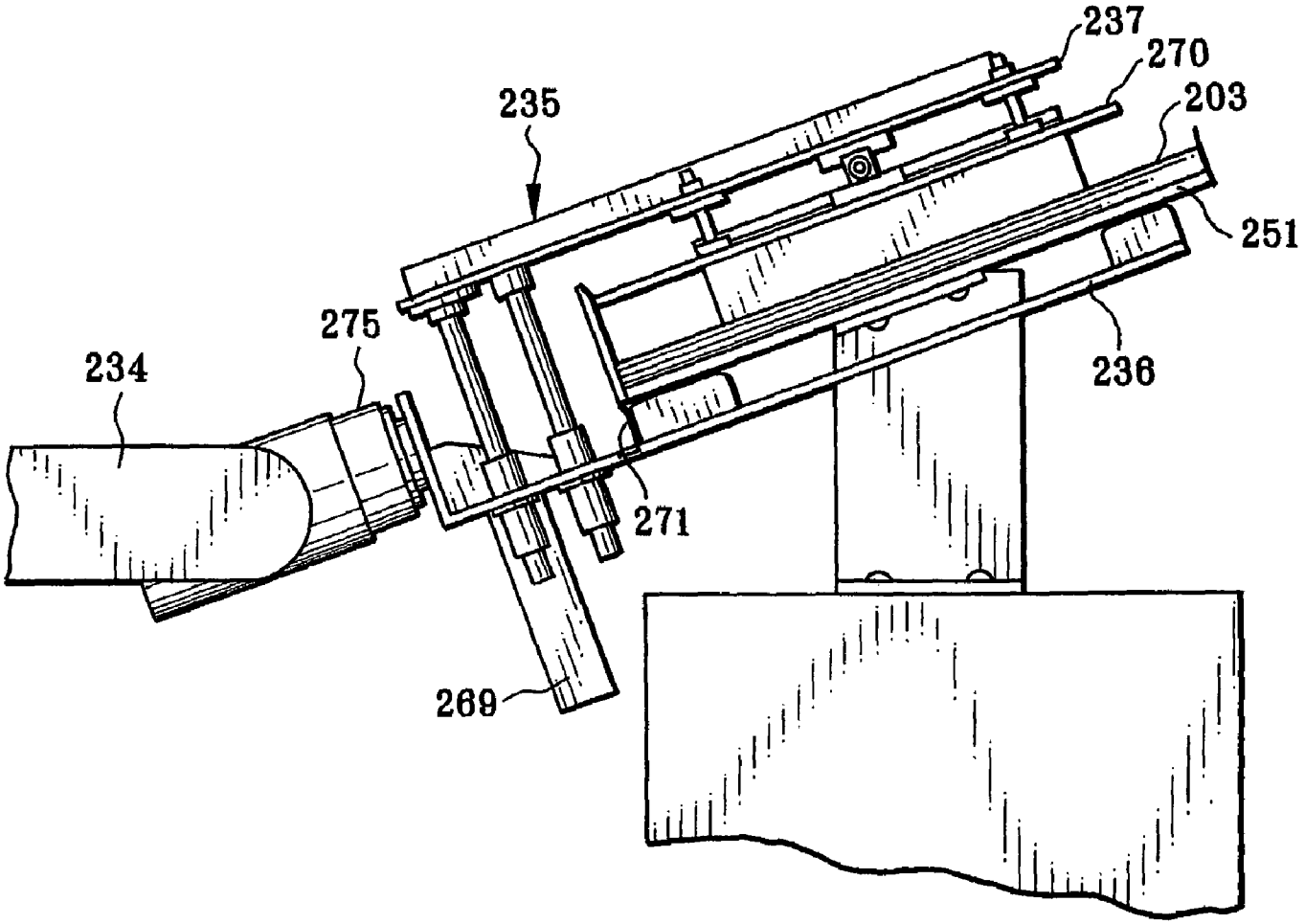
FIG. 28 is an explanatory view in elevation illustrating entry of the chuck into the stacking frame.

The handling control unit 231 controls the sheet handling rotational moving mechanism 233 to move the chuck 235 from the retracted position to the handling position. In the chuck 235 of the sheet handling rotational moving mechanism 233, the support plate 237 is in a released position. The orientation of the chuck 235 is set in a state of FIG. 27. In other words, the chuck 235 is set with an inclination the same as that of the inclined support plates 250-253 of the stacking frame 229. In FIG. 28, the chuck 235 moves to insert the support plate 236 in a space under the inclined support plates 250-253 in the height direction, and to insert extending portions of the support plates 236 and 237 and the retention plate 270 to spaces between the inclined support plates 250-253.

Figure 29:
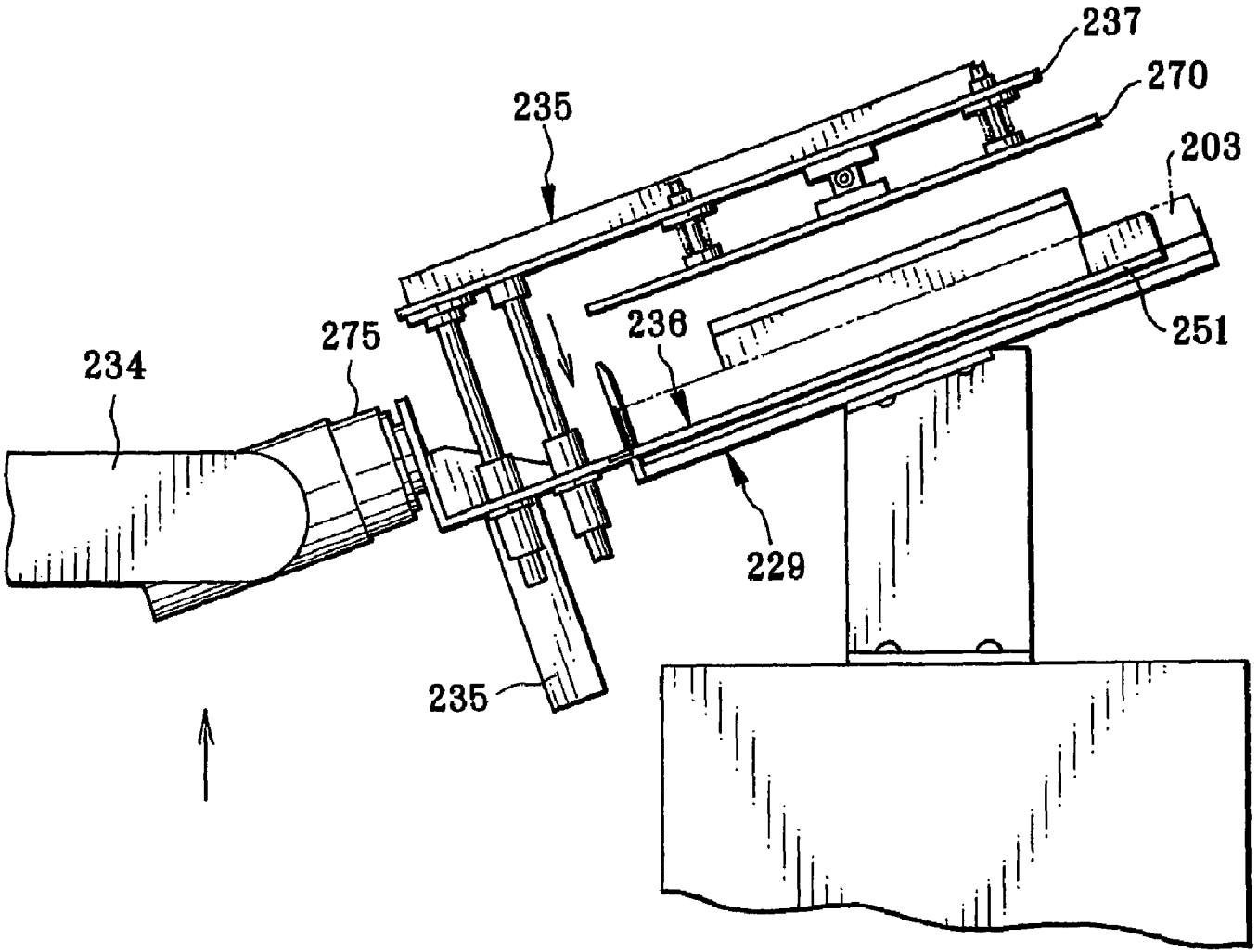
FIG. 29 is an explanatory view in elevation illustrating a state of the sheet stack picked up by the chuck.
Figure 30:
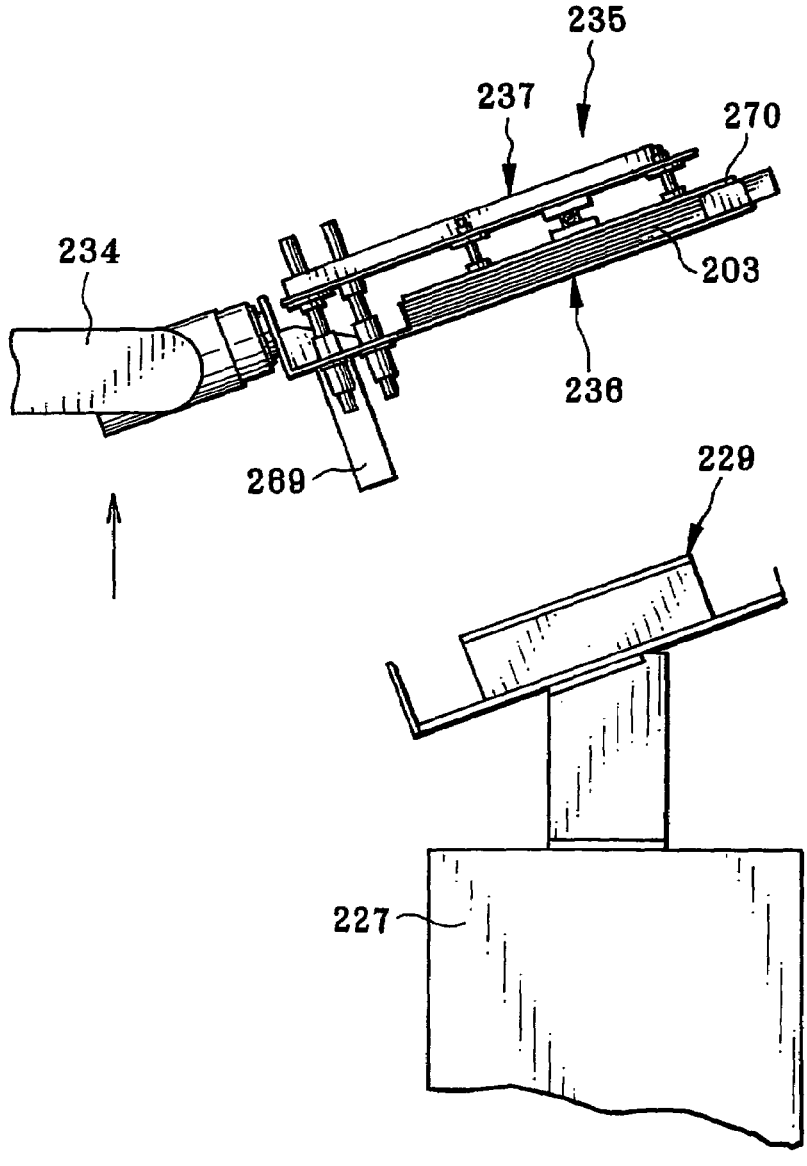
FIG. 30 is an explanatory view in elevation illustrating a picked state of the sheet stack after clamping.
Figure 31:
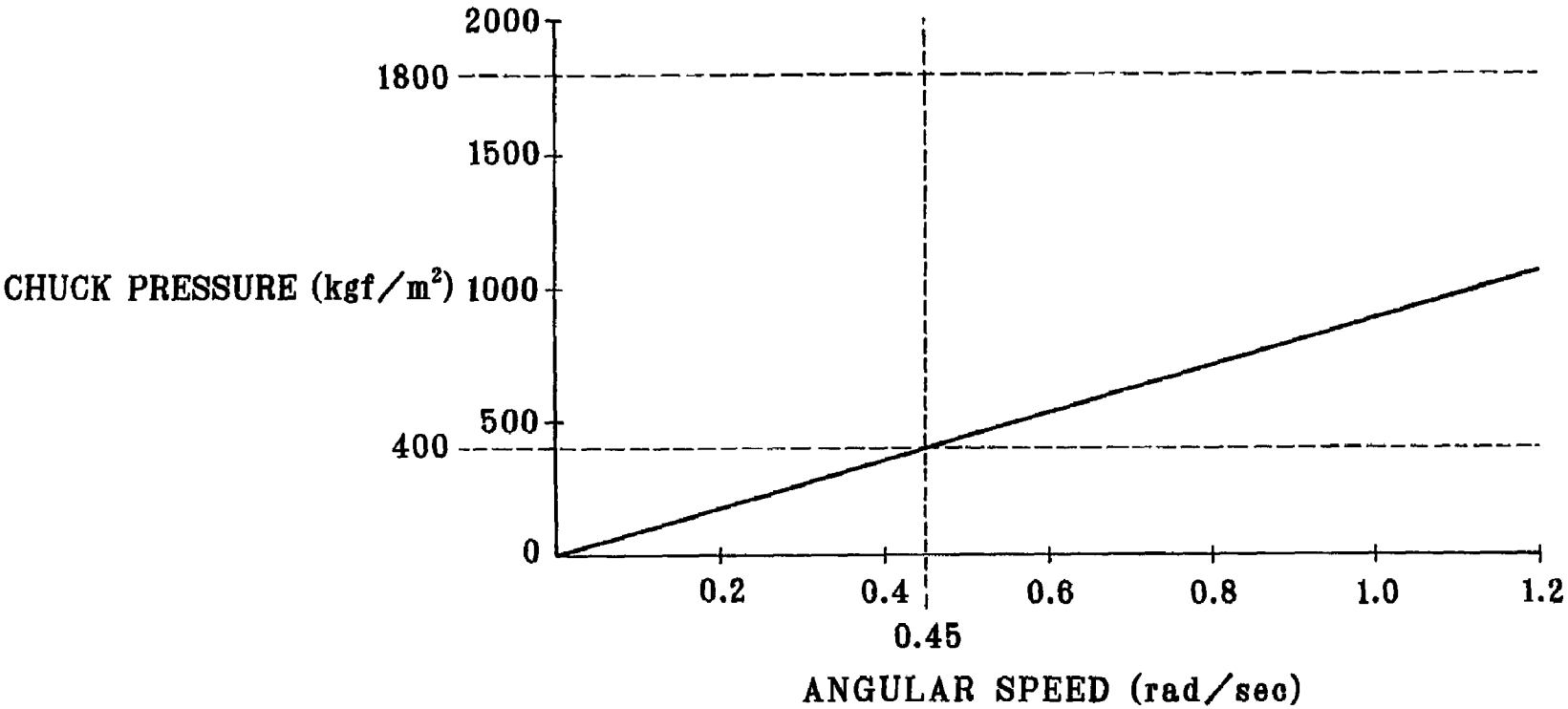
FIG. 31 is a graph illustrating a relationship between an angular speed and control of the orientation.
Figure 32:
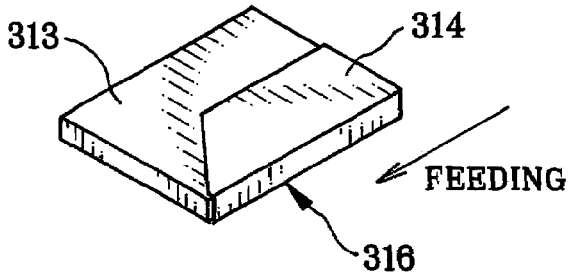
FIG. 32 is a perspective illustrating a sheet stack.

The chuck 235, while kept inclined, is moved from the inclined support plates 250-253 to a small extent, to pick up the sheet stack 203 from the stacking frame 229. After this, the chuck 235 is stopped. In FIG. 29, the cylinder 269 is driven to move down the support plate 237 to a predetermined extent. The retention plate 270 is pressed against the upside of the sheet stack 203 to clamp the same between the retention plate 270 and the support plate 236. In FIG. 30, the chuck 235 is moved vertically to a position without interference between the stacking frame 229 and the chuck 235. Then the chuck 235 is swung horizontally. In the course of moving the chuck 235, the stopper projections 271 and 272 at the support plate 236 prevent the sheet stack 203 from being offset.

After the sheet stack 203 are picked up completely, the rotational moving arm 234 is swung horizontally to move the sheet stack 203 to the operation region 238. In the course of the swing, the handling control unit 231 controls inclinations of the chuck 235 in a time-sequential manner to prevent offsetting of the sheets 201. At first, the support plates 236 and 237 in the accelerating path section are inclined with the angle $\alpha$ to position the upstream edge 236*a* higher than the downstream edge 236*b*. See FIG. 25. The sheets 201 are prevented from deviation in a direction reverse to the horizontal moving direction of the rotational moving arm 234.

In the regular speed path section, the support plate 236 is inclined at the angle $\theta$ to raise the front end 236*c* of the support plate 236 farther from the second axis 276*a* higher than the rear end 236*d* closer to the second axis 276*a*. See FIG. 26. The sheets 201 are prevented from being offset by influence of centrifugal force in the horizontal swing. In the decelerating path section, the support plates 236 and 237 are inclined with the angle $\alpha$ to position the upstream edge 236*a* lower than the downstream edge 236*b*. The sheets 201 are prevented from deviation in the horizontal moving direction of the rotational moving arm 234. The chuck 235 is moved to the transfer position in the operation region 238 in the course of the control of the orientation. When the chuck 235 is set in the transfer position after completing the movement, the support plates 236 and 237 are kept oriented horizontally. Then the cylinder 269 is driven to shift the support plate 237 to the releasing position.

After the chuck 243 of the sheet handling device 214 moves to the operation region 238, the handling control unit 231 sends the end signal to the cover supply control unit 241.

The cover handling robot 240 is now ready in the ready position in the operation region 238, and keeps the protective cover 204 retained on the chuck 235 by suction. The cover supply control unit 241 responds to the stacking end signal from the handling control unit 231, and starts moving the chuck 235 to the transfer position. The chuck 243 includes four columnar projections disposed in a 2×2 matrix form, and the four suction pads secured on ends of the columnar projections, for retaining the protective cover 204 by suction. When the chuck 243 comes to the transfer position, the columnar projections enter the slots 267 and 268 in the support plate 237 and in a space between the support plate 237 and the retention plate 270. The protective cover 204 is positioned at the sheet stack 203. The suction pads are changed over and released from suction, so the protective cover 204 is placed on the sheet stack 203. After this, the chuck 243 of the cover handling robot 240 is moved back to the ready position. The cover supply control unit 241 sends the stacking end signal to the handling control unit 231. In response to this, the handling control unit 231 moves the support plate 237 to the clamping position. The first rotating mechanism 275 is caused to rotate and turns the chuck 235 upside down about the first axis 275*a*. The chuck 235 is moved to the cover folding device, to transfer the protective cover 204 and the sheet stack 203 thereto.

The cover folding device folds the protective cover 204 under the sheet stack 203, and covers the sheet stack 203 partially with the protective cover 204. The cover-fitted sheet stack 207 is sent to a packaging station, is packaged neatly, and then shipped.

EXAMPLES

The angles at which the chuck 235 in the sheet handling device 214 is inclined by sequential control are found according to hereinafter described Examples. To calculate the angle α of the inclination in FIG. 25, the following formulae and equation are used:

Inertia: $mr\omega/t \cos \alpha$

Gravity: $-mg \sin \alpha$ $\alpha = \mathrm{Tan}^{-1}(r\omega/gt)$

To calculate the angle θ of the inclination in FIG. 26, the following formulae and equation are used:

Centrifugal force: $mr\omega^2 \cos \theta$

Gravity: $-mg \sin \theta$ $\theta = \mathrm{Tan}^{-1}(r\omega^2/g)$

Among the symbols in the above formulae, r expresses a radius of the horizontal rotation or a distance defined between the rotational axis and the sheet stack 203, m expresses weight of the sheet stack 203, t expresses time of the acceleration or deceleration, and ω expresses angular speed.

For example, specific values are given for the respective symbols as follows:

Rotational radius r=0.815 m

Weight m=4 kgf

Accelerating or decelerating time t=0.5 sec

Angular speed ω=1.6 rad/sec

In consideration of the above equations, angles α and θ are obtained as:

α=14.9 degrees in the accelerating path section

θ=12.0 degrees in the regular speed path section

α=−14.9 degrees in the decelerating path section

Note that, although the stopper projections 271 and 272 and the end guide projections 273 and 274 exist in the above embodiment, it is possible not to dispose the stopper projections 271 and 272 and the end guide projections 273 and 274 on the support plate 236 according to the present invention. Note that the above orienting control based on the theoretically obtained results of heretofore described Examples only reduces the offsetting, but cannot eliminate it in an ideal manner. So it is desirable to use the stopper projections 271 and 272 and the end guide projections 273 and 274 to minimize the offsetting in a manner additional to the orienting control. In spite of the theoretically obtained results in Examples, it is remarkably preferable to use the angles compensated for by addition of an angle in a range from 1 degree to 50 degrees.

According to the characteristics of the sheets 201 as an X-ray film, pressure fogging occurs when the sheets 201 are clamped with a surface pressure equal to or higher than 1,800 kgf/m$^2$. Scratches occur when the sheets 201 are clamped with a surface pressure equal to or higher than 400 kgf/m$^2$ (40 gf/mm$^2$). Therefore, it is preferable to clamp the sheets 201 with a surface pressure under 400 kgf/m$^2$.

The control of the orientation is required if the angular speed is sufficiently high in the horizontal rotation of the sheet stack.

Specific conditions are given as follows:

Rotational radius r=0.815 m

Weight m=4 kgf

Accelerating or decelerating time t=0.5 sec chuck clamping area A=0.075 m$^2$ frictional coefficient between sheets μ=0.1

The clamping pressure free from offsetting the sheet stack 203 can be obtained according to the following formula:

$$[(mr\omega^2)^2+(mr\omega/t)^2]^{1/2}\mu/A$$

In addition to this, the limit pressure levels mentioned above are considered, including the limit clamping pressure 1,800 kgf/m$^2$ resistant to fogging, and the limit clamping pressure 400 kgf/m$^2$ resistant to scratches. It has been found in view of the graph of FIG. 31 that the orienting control is required if the angular speed of horizontal rotation of the sheet stack 203 is 0.45 rad/sec or higher.

In the above embodiment, the sheet stack 203 is clamped lightly between the support plates 236 and 237. However, the sheet stack 203 may be supported only by the support plate 236 without using the support plate 237. A support mechanism for the sheet stack 203 can be constituted only by the support plate 236 or other simple structures. In the above embodiment, the multi-joint robot is used. However, combined mechanisms may be used for straight movement in three directions of X, Y and Z-coordinates in a three-dimensional system. In such a structure, it is possible only to consider the inertia exerted to the sheet stack 203 without considering the centrifugal force.

Figure 33:
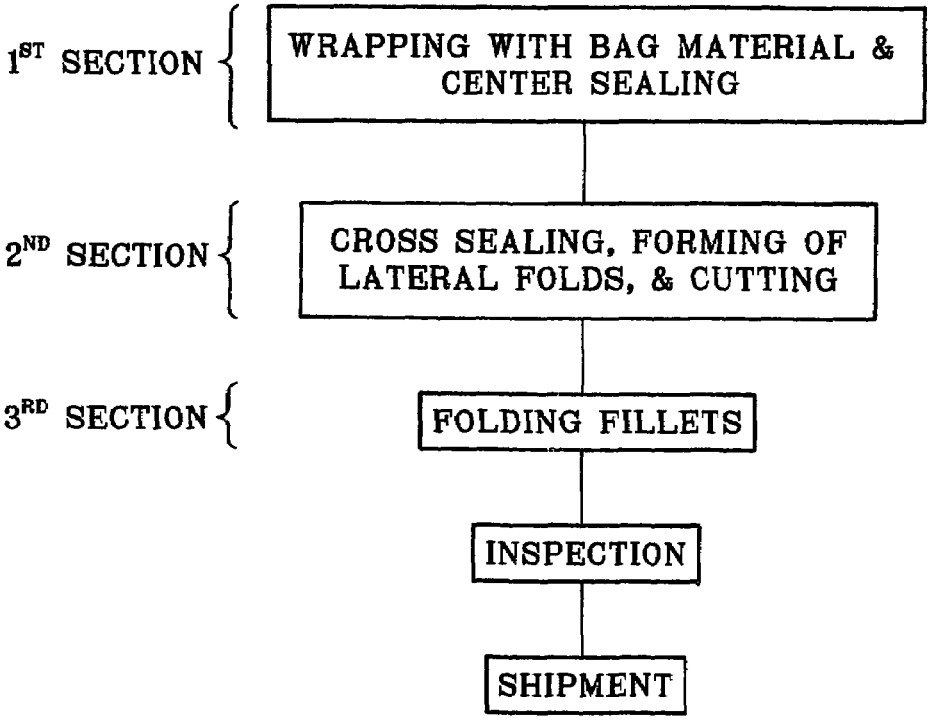
FIG. 33 is a flow chart illustrating steps in operation of the packaging device.

A fillet folding device of a preferred embodiment is described now with reference to FIGS. 32-50, which has a compact size and also can efficiently fold fillets of a packaging bag. In FIG. 33, a packaging device is illustrated, in which first, second and third sections are connected in series with one another.

Figure 34:
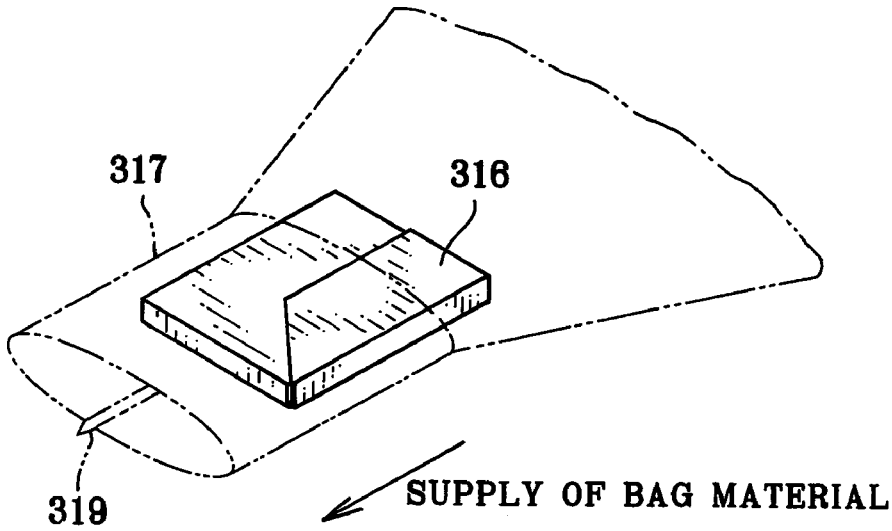
FIG. 34 is a perspective illustrating steps of unwinding continuous bag material and forming a bag body around a sheet stack.

A cover-fitted sheet stack 316 is oriented regularly, and supplied to the first section. The first section is constituted by a conveyor, a supply mechanism, a former mechanism and a center sealer. The conveyor feeds the cover-fitted sheet stack 316 in a feeding path at a regular length. The supply mechanism draws belt-shaped packaging bag material 317 of a thermoplastic resin with light-tightness in synchronism with the regular feeding of the conveyor. The former mechanism, as illustrated in FIG. 34, forms the packaging bag material 317 in a tubular shape to wrap the cover-fitted sheet stack 316. Edge portions 319 are included in the packaging bag material 317, extend in the feeding direction, and are overlapped on each other. The center sealer includes a heater, heats and welds the edge portions 319 together. The center sealer seals the edge portions 319 so tightly that the cover-fitted sheet stack 316 is fitted in the packaging bag material 317. An interval between two succeeding stacks of the sheets can be changed by changing the regular feeding amount and a drawing amount of the supply mechanism. According to a size of the cover-fitted sheet stack 316, it is possible to change the tubular shape defined by the former mechanism, and a sealed width of the center sealer.

Figure 35:
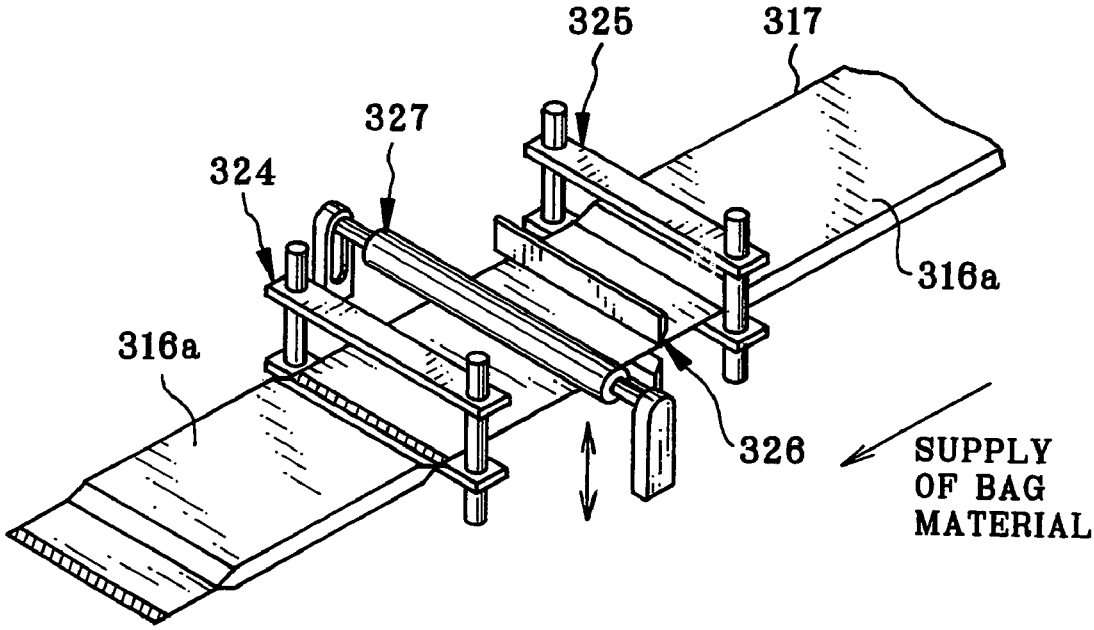
FIG. 35 is a perspective illustrating a second one of sections in the packaging device inclusive of heaters, a heating roller and a cutter.
Figure 36:
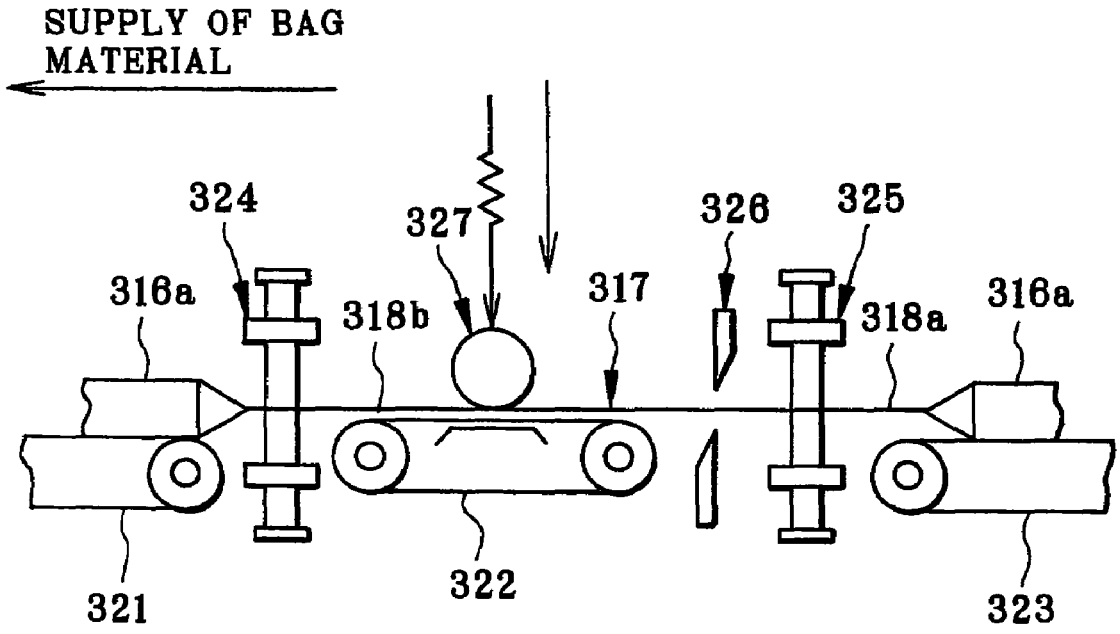
FIG. 36 is an explanatory view in elevation illustrating the second section illustrated in FIG. 35.

In FIGS. 35 and 36, the second section is depicted. Conveyors 321, 322 and 323 feed the packaging bag material 317 at a regular length together with the cover-fitted sheet stack 316 in a direction of drawing the packaging bag material 317. Package sealing heaters 324 and 325 are heaters for cross sealing for thermally welding and sealing front and rear portions of a bag body 316*a* for wrapping the cover-fitted sheet stack 316. The package sealing heaters 324 and 325 are arranged at a distance in the feeding direction of the conveyors 321-323. A cutter 326 is actuated after the cross sealing, and cuts a packaging bag 318 from the packaging bag material 317 at the regular length. A heating roller 327 is disposed between the package sealing heaters 324 and 325.

Each of the package sealing heaters 324 and 325 includes upper and lower heaters for nipping the packaging bag material 317. During the feeding at the regular amount, the heaters are retracted in positions for allowing passage of the packaging bag material 317. The heating roller 327 is movable vertically between lower and upper positions, and when in the lower position, contacts a front fillet 318*a* and a rear fillet 318*b*, and when in the upper position, is away from those. A spring or the like biases the heating roller 327 to the lower position. When the bag body 316*a* moves past the heating roller 327, the heating roller 327 is set in the upper position. While the front and rear fillets 318*a* and 318*b* are moved past the heating roller 327, the heating roller 327 is set in the lower position, pressurizes and heats the packaging bag material 317, to form folds along lateral edges tightly. After the regular feeding, two portions of the packaging bag material 317 between two succeeding bag bodies 316*a* become opposed to the package sealing heaters 324 and 325. In other words, the portions are defined at a rear fillet of a first bag body 316*a* and a front fillet of a second bag body 316*a* succeeding to the first.

Figure 37:
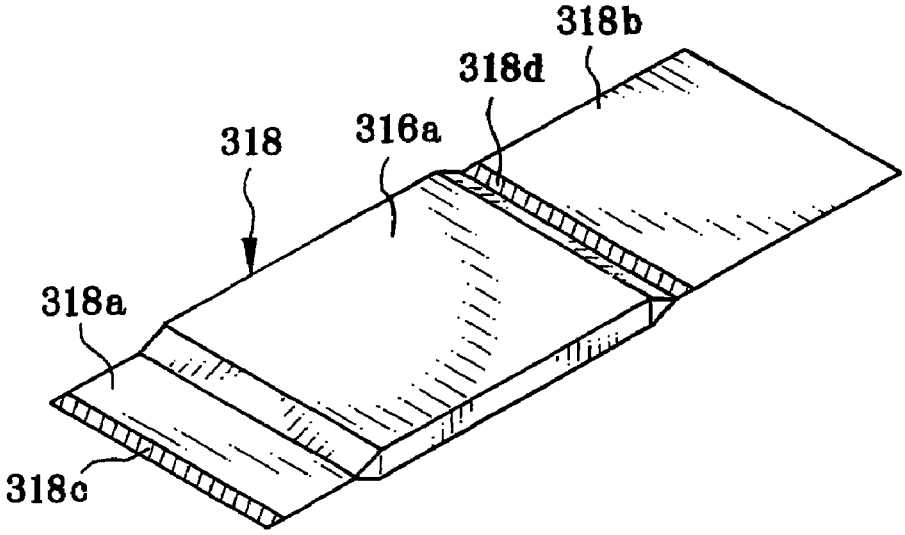
FIG. 37 is a perspective illustrating the bag material sealed in the second section and cut to form a packaging bag.

The package sealing heater 324 encloses a rear portion of an advancing one of the bag bodies 316*a*. The package sealing heater 325 encloses a front portion of a second one of the bag bodies 316*a* succeeding to the advancing bag body 316*a*. While the packaging bag material 317 is stopped, the package sealing heaters 324 and 325 are actuated. After the cross sealing operation, the cutter 326 is actuated in a position upstream from the package sealing heater 324, to cut the advancing bag body 316*a*. Then the front and rear fillets 318*a* and 318*b* are formed with the bag body 316*a* as illustrated in FIG. 37. In the present embodiment, the rear fillet 318*b* has a greater size in the feeding direction than the front fillet 318*a* for the purpose of folding the rear fillet 318*b* in an overlapped manner. The sum of the lengths of the front and rear fillets 318*a* and 318*b* corresponds to an interval between the bag bodies 316*a*. A rear cross sealed portion 318*d* is formed at an end of the bag body 316*a*. A front cross sealed portion 318*c* is formed at an end of the front fillet 318*a*. The package sealing heaters 324 and 325 and the cutter 326 are respectively movable in the feeding direction, and are positioned for the lengths of the front and rear fillets 318*a* and 318*b*.

Figure 38:
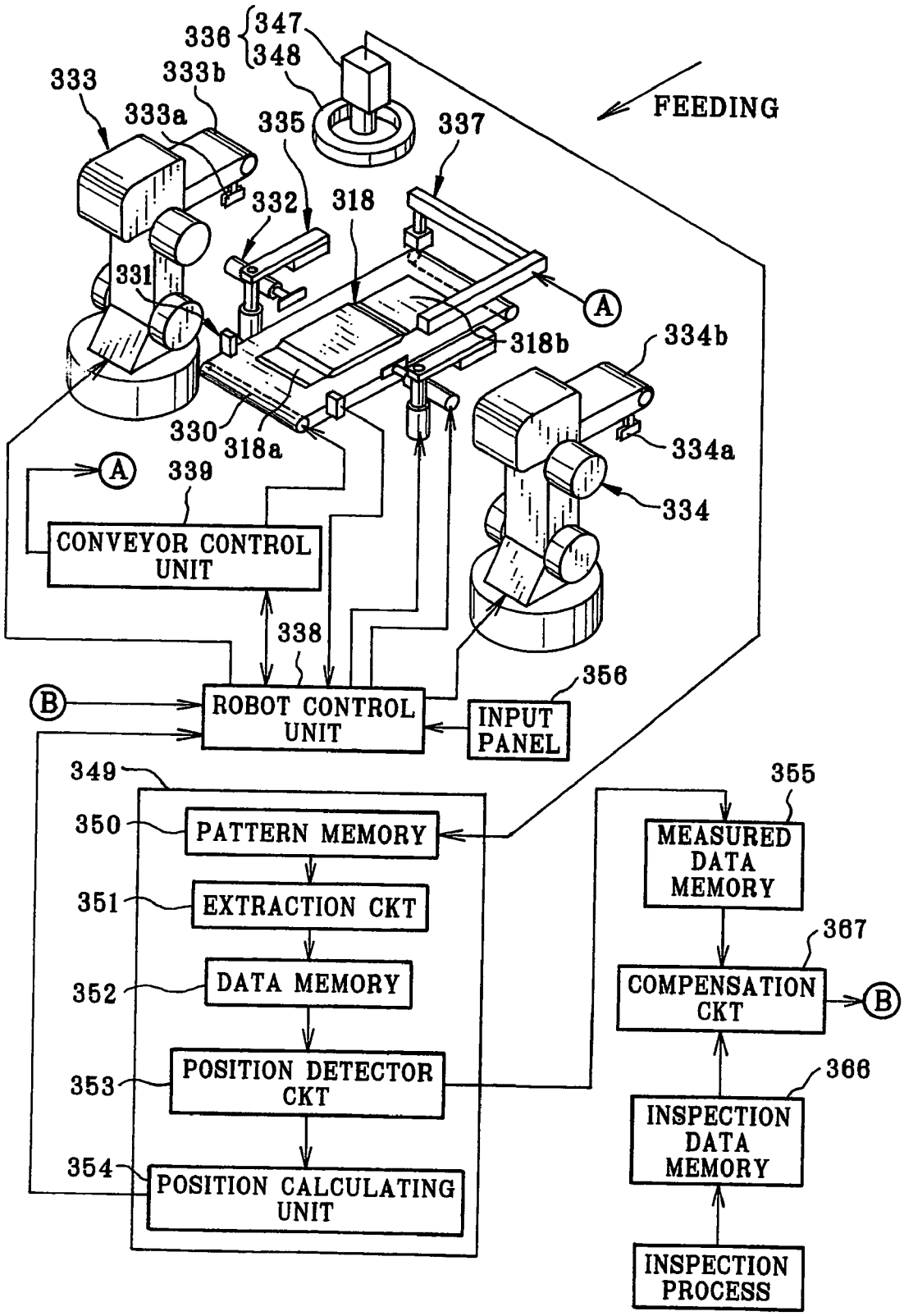
FIG. 38 is a perspective with a block diagram illustrating various mechanisms included in a third one of the sections.

In the third section, the sheet package is supplied one after another. The third section includes the fillet folding device. In FIG. 38, the fillet folding device is constituted by a conveyor 330, a bag detector 331, a centering mechanism 332, a six-axis multi-joint robots 333 and 334 as a module, a pair of retention mechanisms 335, a fillet position detector 336, a sticker attacher 337 as a module, a robot control unit 338 and a conveyor control unit 339. The conveyor control unit 339 controls the conveyor 330 to feed the packaging bag 318 in the predetermined orientation. The bag detector 331 consists of a photo interrupter, detects a reach of the packaging bag 318 to a predetermined position, and sends a detection signal to the robot control unit 338.

Figure 39:
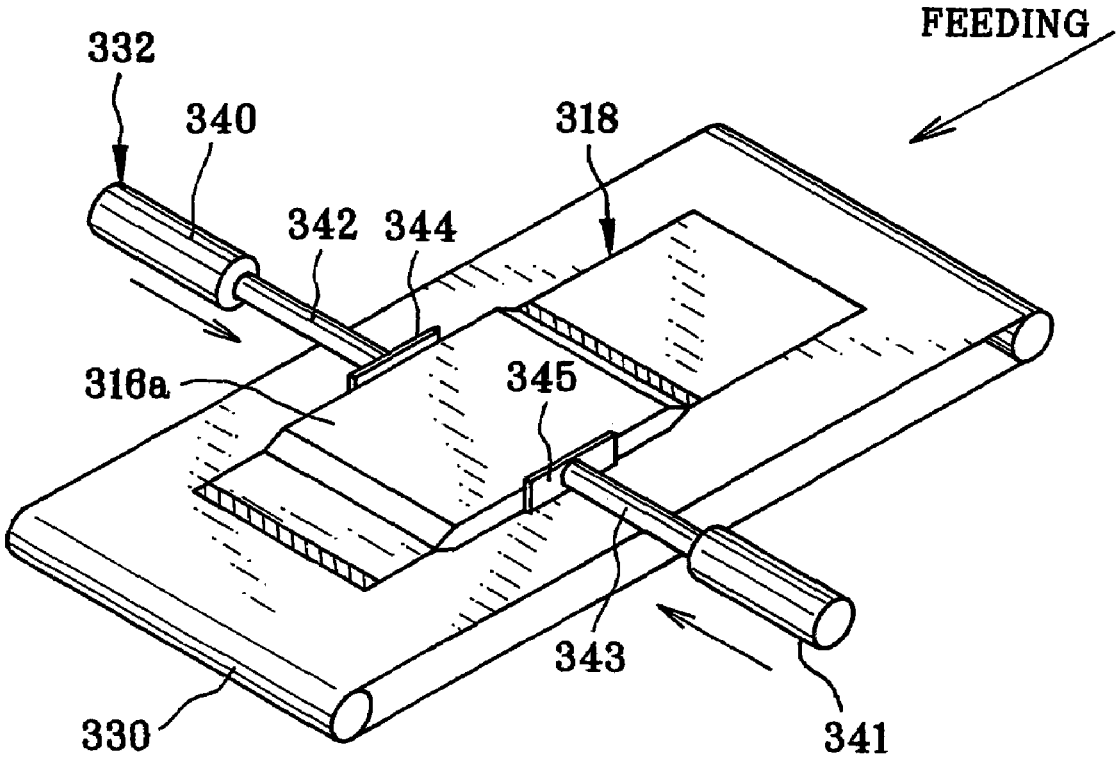
FIG. 39 is a perspective illustrating a centering mechanism.

In the third section as illustrated in FIG. 39, the centering mechanism 332 is constituted by cylinders 340 and 341 disposed beside the conveyor 330 and opposed to one another. The robot control unit 338 controls the cylinders 340 and 341 in synchronism. Regulation plates 344 and 345 are attached to rods 342 and 343 of the cylinders 340 and 341. The rods 342 and 343 slide perpendicularly to the feeding direction. The robot control unit 338 drives the cylinders 340 and 341 simultaneously upon receipt of the detection signal, and presses the regulation plates 344 and 345 against sides of the packaging bag 318 to set the packaging bag 318 at the center of the conveyor 330 in the width direction. Thus, the packaging bag 318 can be set in a region to be photographed by a CCD camera. The centering is continued until the front and rear fillets 318*a* and 318*b* are folded so as to prevent the packaging bag 318 from offsetting at the time of fillet folding.

The fillet position detector 336 is constituted by a CCD camera as an image area sensor 347, an indirect light source 348 and an image processing unit 349. As the conveyor belt in the conveyor 330 has black color for the reason of black antistatic material, the indirect light source 348 indirectly applies light to the packaging bag 318 through gaps around the image area sensor 347. It is possible to use a transparent conveyor belt in the conveyor 330, and to use a direct light source for illuminating the packaging bag 318 through the conveyor belt.

The image area sensor 347 photographs the packaging bag 318 in a downward direction in a state illuminated by the light source, and sends image data to the image processing unit 349. The image processing unit 349 includes a pattern memory 350, an extraction circuit 351, a data memory 352, a position detector circuit 353 and a position calculating unit 354. The image data from the image area sensor 347 is written to the pattern memory 350. The extraction circuit 351 reads the image data from the pattern memory 350, and extracts data of a contour of the packaging bag 318 as viewed on a plane. The contour data is written to the data memory 352. The position detector circuit 353 reads the contour data from the data memory 352, and obtains the edge positions of the front and rear fillets 318*a* and 318*b* and a bendback position.

Figure 40:
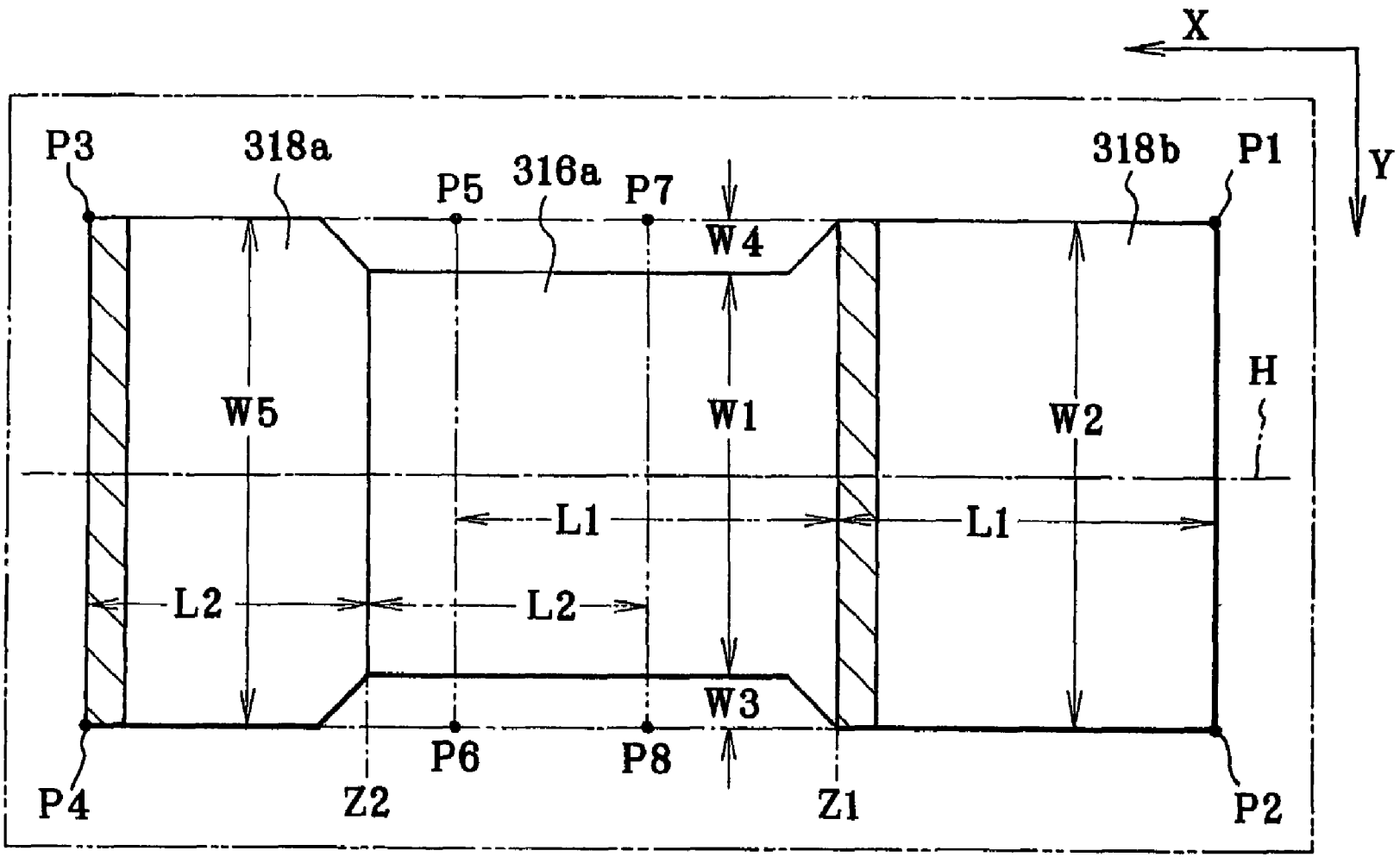
FIG. 40 is an explanatory view in plan illustrating a result of picking up an image of the packaging bag.

The calculation is described now. In FIG. 40, an image of the packaging bag 318 has been picked up in such a manner that its contour is very sharply photographed, because lateral folds are formed by pressurizing and heating the packaging bag 318 with the heating roller 327. Also, the width of the front and rear fillets 318*a* and 318*b* becomes greater than that of the bag body 316*a*. According to the data of the contour, the position detector circuit 353 obtains a center line H with reference to the width direction of the packaging bag 318 by vertical scanning. Then various values are calculated, including the width W1 of the bag body 316*a* in the direction Y, the width W2 of the rear fillet 318*b* in the direction Y, the size L1 of the rear fillet 318*b* in the feeding direction X, and the size L2 of the front fillet 318*a* in the feeding direction X. Note that the width W5 of the front fillet 318*a* is considered equal to the width W2 of the rear fillet 318*b* without direct detection or calculation. Of course, it is additionally possible to obtain the width W5 of the front fillet 318*a* by detection and calculation.

The position calculating unit 354 reads the data obtained in the position detector circuit 353, and finds edge positions P1-P4 of the front and rear fillets 318*a* and 318*b*, and distances W3 and W4. The distance W3 is determined between the left-side edge of the bag body 316*a* and the left-side edge of the rear fillet 318*b* as viewed in the feeding direction X, the distance W4 is determined between the right-side edge of the bag body 316*a* and the right-side edge of the rear fillet 318*b*.

A measured data memory 355 is used, to which the data obtained by the position detector circuit 353 is written in a sequence of having been calculated in the position detector circuit 353. The position calculating unit 354 reads the calculated data from the measured data memory 355, and calculates bendback positions P5, P6, P7 and P8 to which edges of the front and rear fillets 318*a* and 318*b* will be moved by the folding operation. The data of the bendback positions are sent to the robot control unit 338.

The bendback positions are calculated as follows. An input panel 356 is connected with the robot control unit 338. Parameters or conditions are input at the input panel 356 according to an X-ray film size. Examples of the conditions include equality of the length W3 and W4, and equality of the folded sizes to the lengths of the front and rear fillets 318*a* and 318*b* in the feeding direction X. For the rear fillet 318*b*, an axis Z1 is defined at a downstream end of the rear fillet 318*b*. According to the input conditions, the robot control unit 338 determines bendback positions P5 and P6 for the rear fillet 318*b* at a distance L1 from the axis Z1 in the feeding direction X. For the front fillet 318*a*, an axis Z2 is defined at an upstream end of the front fillet 318*a*. According to the input conditions, the robot control unit 338 determines bendback positions P7 and P8 for the front fillet 318*a* at a distance L2 from the axis Z2 in reverse to the feeding direction X.

The robot control unit 338 controls the six-axis multi-joint robots 333 and 334 according to the data of the bendback positions, to fold the front and rear fillets 318*a* and 318*b*. The six-axis multi-joint robots 333 and 334 are arranged on lateral edges of the conveyor 330, and access their common operation region defined on the conveyor 330, to cooperate for folding the front and rear fillets 318*a* and 318*b*. The six-axis multi-joint robot 333 includes a chuck moving arm 333*b*, and a chuck 333*a* secured to an end of the chuck moving arm 333*b*. Similarly, the six-axis multi-joint robot 334 includes a chuck moving arm 334*b* and a chuck 334*a*. Each of the chucks 333*a* and 334*a* includes grasping hooks or claws, actuated hydraulically or pneumatically, for moving in parallel. A hydraulic or pneumatic mechanism for the chucks 333*a* and 334*a* is controlled to clamp each edge of the front and rear fillets 318*a* and 318*b* at a predetermined pressure. The chucks 333*a* and 334*a* are supported in a rotatable manner on the chuck moving arms 333*b* and 334*b*, and are controlled for the orientation to prevent twisting the front and rear fillets 318*a* and 318*b* according to the control of the rotational direction about the axis of the chucks 333*a* and 334*a*, and control of the movement on remaining five (5) axes of the chuck moving arms 333*b* and 334*b*.

As movement of the chucks 333*a* and 334*a* is three-dimensional, positions of those according to the Z direction are also required as viewed vertically to the plane of the bag. The positions in the Z direction are predetermined for the time of grasping the edges of the front and rear fillets 318*a* and 318*b*, and for the time of displacing the edges of the front and rear fillets 318*a* and 318*b* to the bendback positions P5-P8. This is because the height of the front and rear fillets 318*a* and 318*b* and height of the bag body 316*a* do not vary remarkably between plural sizes of the X-ray film, and all the possible sizes can be treated suitably by enlarging openness of the chucks 333*a* and 334*a*.

Figure 41:
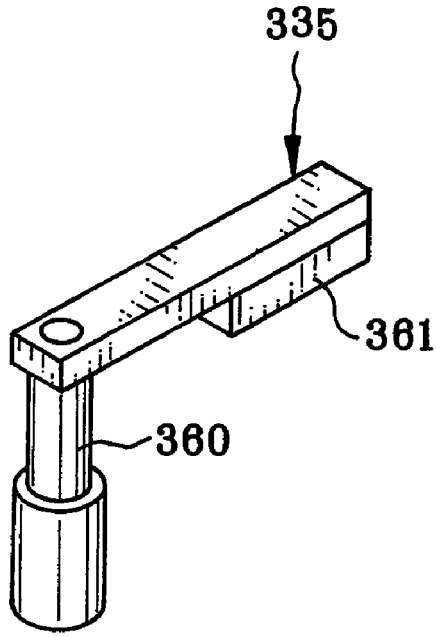
FIG. 41 is a perspective illustrating a retention mechanism for fillets.
Figure 42:
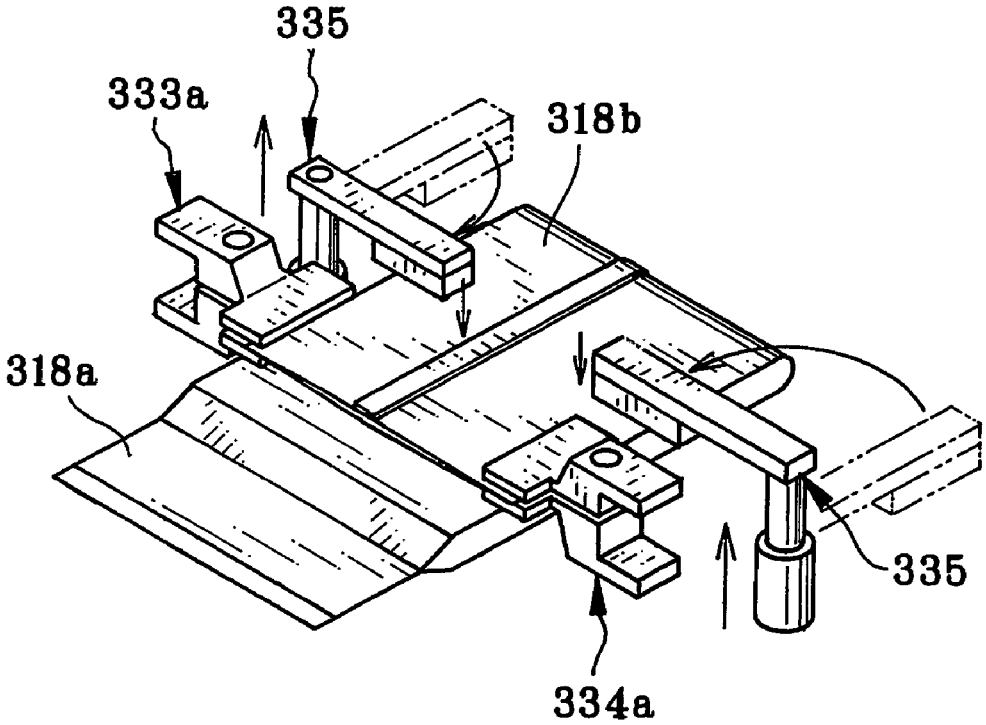
FIG. 42 is a perspective illustrating movement of the retention mechanism.
Figure 43:
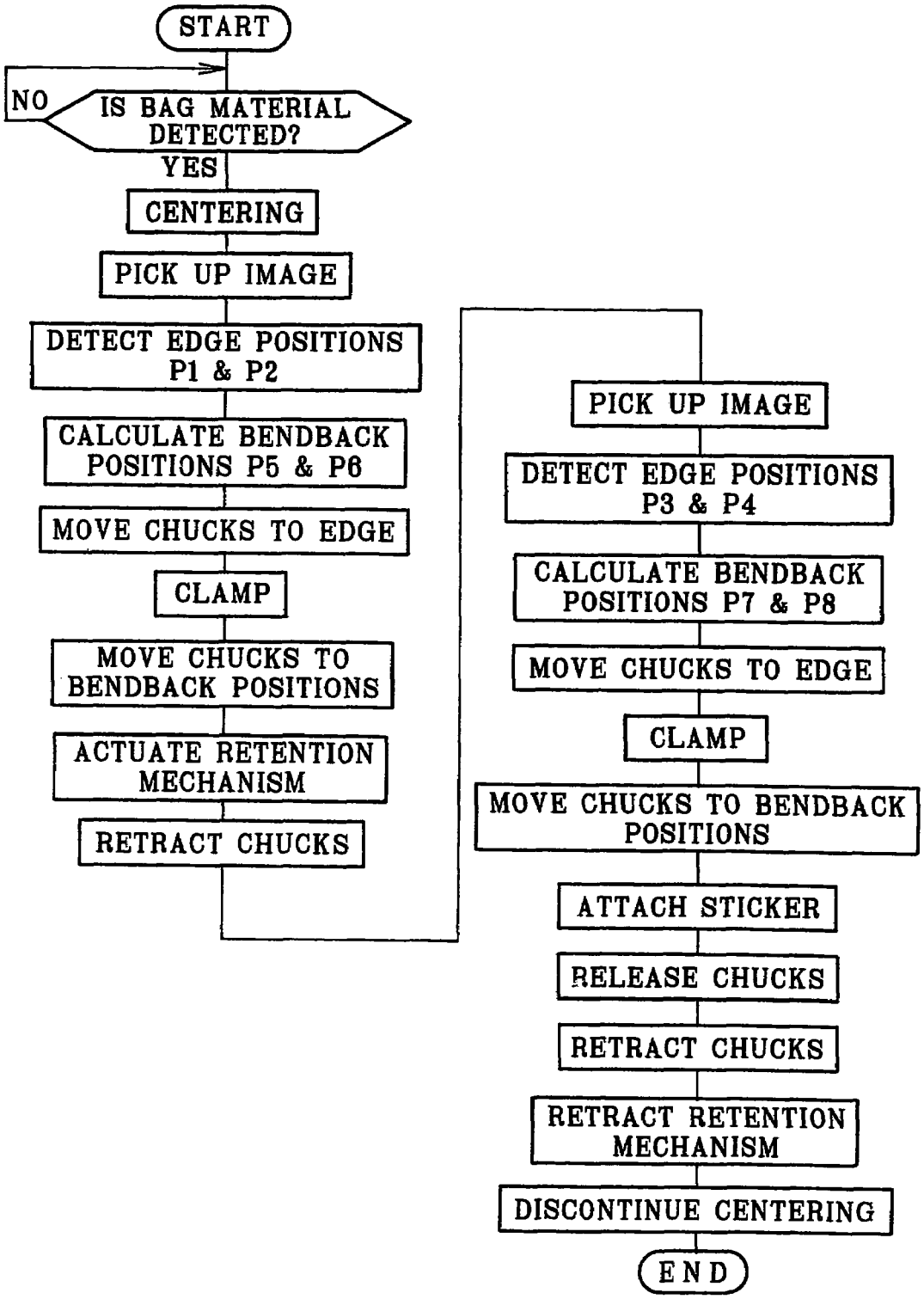
FIG. 43 is a flow chart illustrating a process of operation of a robot control unit.

The robot control unit 338 also controls the two retention mechanisms 335. The retention mechanisms 335 are disposed at the lateral edges of the conveyor 330, and synchronized with each other in operation. In FIG. 41, each of the retention mechanisms 335 is constituted by a cylinder rod 360 and a pressure plate 361. The cylinder rod 360 is movable vertically. The pressure plate 361 is secured to an end of the cylinder rod 360, and rotatable about an axis of the cylinder rod 360. In FIG. 42, a process of setting the retention mechanisms 335 is depicted. At first, the retention mechanisms 335 are positioned away from the conveyor 330 as indicated by the phantom line. Then the retention mechanisms 335 are moved up vertically, and then swung into a space above the conveyor 330 as indicated by the solid line in the drawing. Then the retention mechanisms 335 are moved down toward the conveyor 330, to press the rear fillet 318*b* for retention. After the operation of the retention mechanisms 335 is completed, the retention mechanisms 335 are moved in a sequence reverse to that in the setting process, to return to the initial position away from the conveyor 330. In the course of all the operation, the retention mechanisms 335 are controlled for pressing after the chucks 333*a* and 334*a* have finished grasping the rear fillet 318*b* but before the chucks 333*a* and 334*a* grasp the front fillet 318*a*. According to this, it is possible to keep the rear fillet 318*b* folded in a free state even after the folding operation.

The sticker attacher 337 is constituted by a sticker holder and a holder moving mechanism, and is controlled by the robot control unit 338. The holder moving mechanism is disposed above the conveyor 330, and supports the sticker holder three-dimensionally, namely in the direction X of feeding of the conveyor 330, in the direction Y widthwise of the conveyor 330, in the direction Z vertical to a surface of the conveyor 330. The sticker holder has a vacuum head for retaining the sticker by suction of a surface reverse to an adhesive surface of the sticker.

In the robot control unit 338 is memorized a program for a sequence of synchronized control of the centering mechanism 332, the fillet position detector 336, the six-axis multi-joint robots 333 and 334, the retention mechanisms 335 and the sticker attacher 337.

Figure 44A:
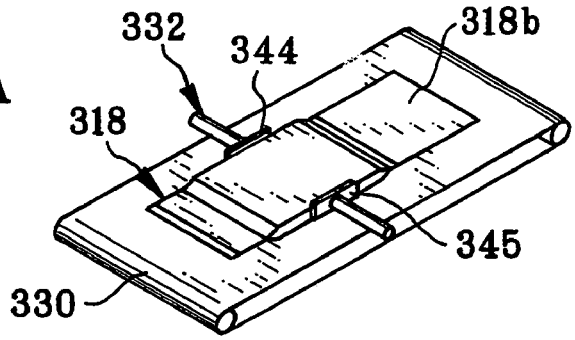
FIGS. 44A, 44B, 44C and 44D are perspectives illustrating a process starting from the centering step and ending in retaining step with the retention mechanism.
Figure 44B:
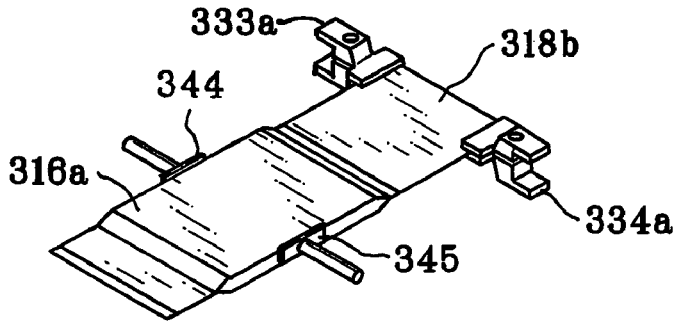
Figure 44C:
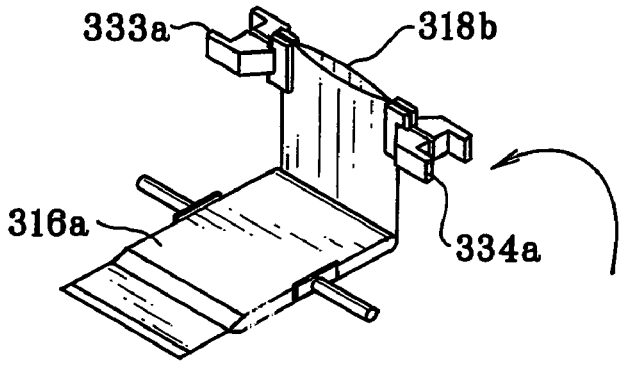
Figure 44D:
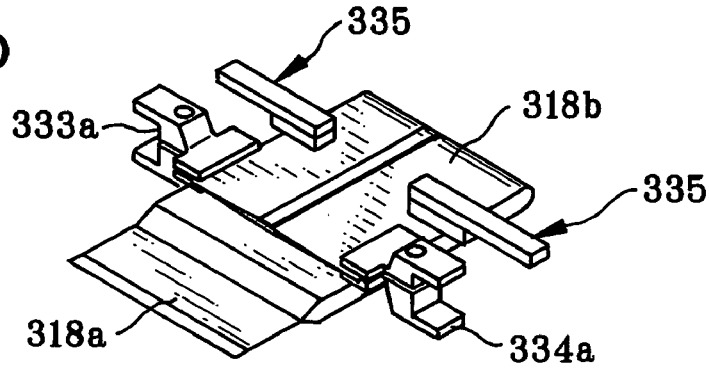
Figure 45A:
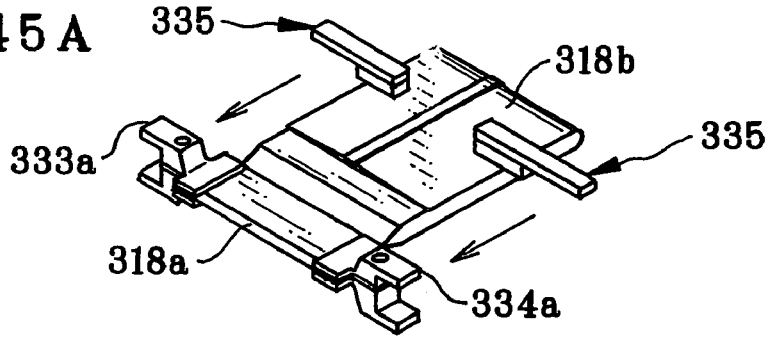
FIGS. 45A, 45B, 45C and 45D are perspectives illustrating a process starting from clamping of a front fillet and ending in attaching a sticker to the fillets.
Figure 45B:
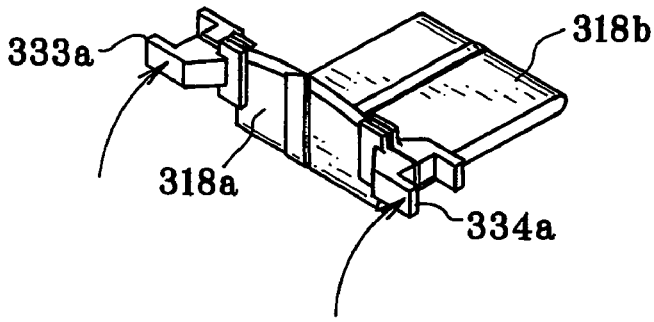
Figure 45C:
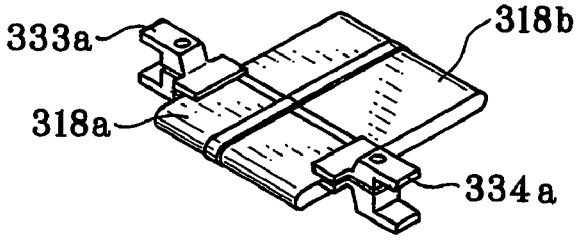
Figure 45D:
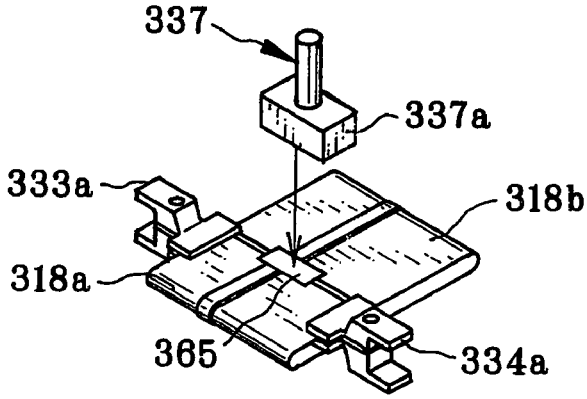

The actuating sequence is described now. A detection signal is received from the detector. After this, the packaging bag body is centered as illustrated in FIG. 44A. Then edge positions and bendback positions are calculated according to results of the photoelectric detection at the CCD camera. In FIG. 44B, lateral edges of the rear fillet 318*b* are clamped by the chucks 333*a* and 334*a*. As both lateral edges of the bag material are tightly folded, the lateral edges can be reliably clamped. The chucks 333*a* and 334*a* are pivotally moved along arc-shaped paths indicated in FIGS. 44C and 44D. The rear fillet 318*b* is bent back to the bendback position. The locus of movement is an arc as a portion of a circle defined about the folding position with a radius of L1.

Then the retention mechanisms 335 are actuated, to press the pressure plate 361 down against the rear fillet 318*b*. After pressing, the chucks 333*a* and 334*a* are moved to the edge position of the front fillet 318*a*, to grasp the edge portion of the front fillet 318*a*. See FIG. 45A. The chucks 333*a* and 334*a* are moved along the arc-shaped paths depicted in FIGS. 45B and 45C, set in the bendback positions for the front fillet 318*a*, and folds the front fillet 318*a*. The arc-shaped paths have a radius L2 about the center at the folded position. The sticker attacher 337 is actuated to move a sticker holder 337*a* to an attachment ready position calculated according to the bendback positions of the front fillet 318*a*. A sticker 365 or label is attached between the front end of the front fillet 318*a* and the rear fillet 318*b* by moving down from the attachment ready position. Thus, the front and rear fillets 318*a* and 318*b* are fastened.

After the sticker 365 is attached, the sticker holder 337*a* of the sticker attacher 337 is shifted to a sticker supply position, so a new sticker is supplied and supported on the sticker holder 337*a*. The chucks 333*a* and 334*a* are released after the sticker attachment. The retention mechanisms 335 are released from retention. The centering mechanism 332 is released from centering. Note that the centering mechanism 332 is not depicted in FIG. 44D and FIGS. 45A-45D for simplicity. The retention mechanisms 335 are omitted from FIGS. 45B-45D for simplicity.

Figure 46:
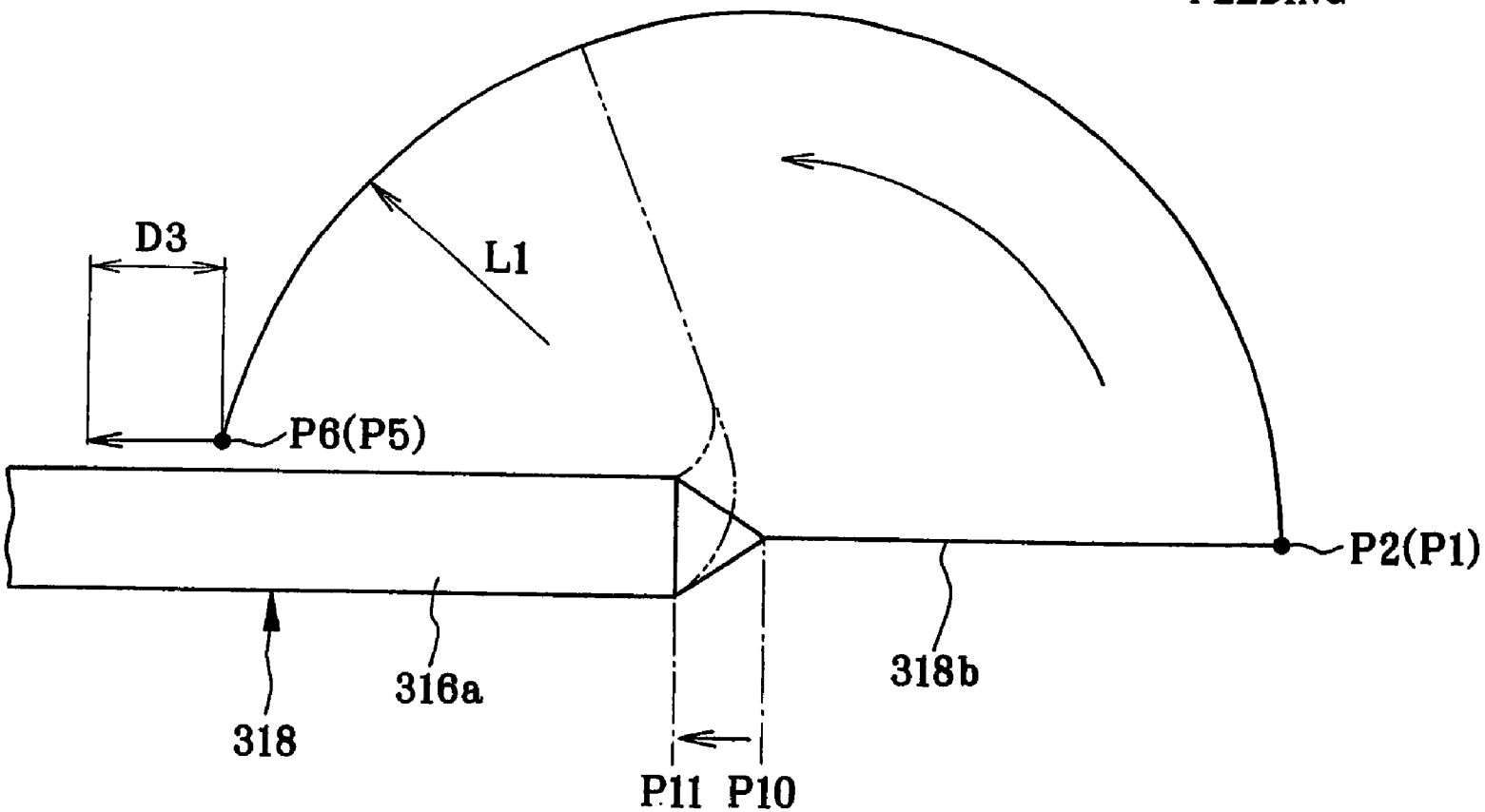
FIG. 46 is an explanatory view in elevation illustrating a moving path of the chucks with over-stroke in folding the rear fillet.

Folding of the rear fillet 318*b* with the chucks 333*a* and 334*a* is described now. In FIG. 46, the edge of the rear fillet 318*b* is moved to the bendback positions P5 and P6 by fitting the folding position P10 of the rear fillet 318*b* on an end position P11 of the bag body 316*a*. After this, the folding position P10 is moved in over-stroke movement by an amount D3 in a direction toward the end position P11 of the cover-fitted sheet stack 316 in the bag body 316*a*. Folding of the front fillet 318*a* with the chucks 333*a* and 334*a* is basically similar. The edge of the front fillet 318*a* is moved to the bendback positions P7 and P8. After this, the folding position is moved in over-stroke movement by an amount D3 in a direction toward the end position of the cover-fitted sheet stack 316. The folding position of the front fillet 318*a* is fitted on an end position of the bag body 316*a*.

The over-stroke movement applies predetermined load between the bag body 316*a* and each of the front and rear fillets 318*a* and 318*b* without contacting the bag body 316*a*. Should overload higher than a tolerable level be applied, there occur scratches of the packaged sheets due to unwanted movement of the cover-fitted sheet stack 316 in the bag body 316*a*, or a failure in clamping of the chucks 333*a* and 334*a* due to unwanted movement of the packaging bag 318. In order to prevent the occurrence of such problems, a frictional sheet, film, plate or the like of rubber or other resilient material is secured to surfaces of clamping of the chucks 333*a* and 334*a* for frictional retention of the bag body 316*a*. This frictional structure can prevent the packaging bag 318 from moving with slip by keeping squeezing pressure unchanged in the chucks 333*a* and 334*a* even when load equal to or more than the tolerable level is applied between one of the chucks 333*a* and 334*a* and the front and rear fillets 318*a* and 318*b*.

After the folding operation of the front and rear fillets 318*a* and 318*b*, the packaging bag 318 is transferred to a station for inspection. The front and rear fillets 318*a* and 318*b* are subject to inspection of offsetting, tightness and appearance. In the offsetting inspection, an offset amount of the front and rear fillets 318*a* and 318*b* is measured or calculated with respect to the width direction, and if more than a tolerable offset amount, is detected unacceptable. In the tightness inspection, the front and rear fillets 318*a* and 318*b* are raised by a certain tool or jig in a state attached with the sticker 365. A gap size is measured between the bag body 316*a* and the front and rear fillets 318*a* and 318*b* being raised. The gap size is evaluated, and if more than a tolerable gap size, is detected unacceptable, to conclude that the fitted state of the folding position of the front and rear fillets 318*a* and 318*b* is not reliable on the bag body 316*a*. The appearance inspection is to inspect existence of wrinkles, scratches, pinholes or the like in surfaces of the packaging bag 318. The appearance inspection camera automatically effected according to calculation and surface inspection by use of image processing of image data picked up by the CCD camera.

In FIG. 38, there is an inspection data memory 366, to which measured results of inspection of offsetting and tightness are written for each of the sizes of sheets or X-ray sheet films. The type of the packaging bag 318 having a different size can be specified according to the measured data from the image processing unit 349. A compensation circuit 367 is connected with the measured data memory 355. The compensation circuit 367 is connected also with the inspection data memory 366, and reads the inspection data from the inspection data memory 366, and also reads measured result data is read from the measured data memory 355 in association with the inspection data. The measured data being read is used for specifying each type of the packaging bag 318.

The inspection data is used for calculating compensation amounts to compensate for the bendback positions P5-P8 of the chucks 333*a* and 334*a*. The compensation circuit 367 calculates the compensation amounts in considering a type of the packaging bag 318 according to the results of the inspection so as to satisfy acceptability required in the inspection. The compensation circuit 367 sends data of the compensation amounts to the robot control unit 338 in a manner of feedback. Consequently, it is possible to solve problems of irregularity in the folding positions due to various causes including a characteristic of synthetic material of the packaging bag material 317, a surface friction and thickness of the packaging bag material 317, a thickness of the cover-fitted sheet stack 316, the material, thickness and shape of a protective cover 314, and offsetting of the packaging bag 318 relative to the conveyor 330 at the time of folding.

The operation of the packaging device is described now. Sheets are cut from continuous sheet material one after another, and stacked in a form of a sheet stack 313. The protective cover 314 is overlapped on the sheet stack 313, to form the cover-fitted sheet stack 316 of FIG. 32. The cover-fitted sheet stack 316 is fed to the first section of the packaging device. The conveyor mechanism in the first section feeds the cover-fitted sheet stack 316 intermittently by a regular length. In synchronism with this, a supply mechanism draws out the packaging bag material 317 at a regular length. In FIG. 34, a package former mechanism forms the packaging bag material 317 into a tubular shape, and wraps the cover-fitted sheet stack 316. Then the conveyor mechanism feeds the cover-fitted sheet stack 316 to the second section together with the packaging bag material 317. In the course of the feeding, a center sealer seals the juncture portions of the packaging bag material 317 under the cover-fitted sheet stack 316.

The cover-fitted sheet stack 316 in the second section is fed by the conveyor 330 to a predetermined position. In the course of feeding, the heating roller 327 moves down to the lower position each time after the bag body 316*a* passes, and provides the front and rear fillets 318*a* and 318*b* with lateral tight folds in a feeding direction. See FIG. 35. The heating roller 327 moves up the upper position while the bag body 316*a* passes. Therefore, it is possible to prevent problems such as pressure fogging to the cover-fitted sheet stack 316 in the bag body 316*a*, and a drop in the image quality. When the packaging bag material 317 reaches a predetermined position, portions corresponding to the rear fillet 318*b* of the advancing bag body 316*a* and to the front fillet 318*a* of the succeeding bag body 316*a* become opposed to respectively the package sealing heaters 324 and 325.

After the feeding is stopped, the package sealing heaters 324 and 325 are actuated for cross sealing. The package sealing heater 324 forms the rear cross sealed portion 318*d* to the advancing bag body 316*a*. The package sealing heater 325 forms the front cross sealed portion 318*c* to the bag body 316*a* succeeding to the advancing bag body 316*a*. After forming the front and rear cross sealed portions 318*c* and 318*d*, the cutter 326 is actuated to cut away the advancing bag body 316*a*. The same operation is repeated, to supply the third section with the packaging bag 318 one after another in a form having the front and rear fillets 318*a* and 318*b*.

The conveyor control unit 339 in the third section drives the conveyor 330, feeds the packaging bag 318 to a predetermined position, and causes the robot control unit 338 to execute the sequence. At first, the bag detector 331 monitors and checks whether the packaging bag 318 reaches the predetermined position. See FIG. 43. When a detection signal is generated by the bag detector 331, the robot control unit 338 actuates the centering mechanism 332, and causes the regulation plates 344 and 345 to center the packaging bag 318. An image of the packaging bag 318 is picked up while contacted by the regulation plates 344 and 345, to calculate data for folding the rear fillet 318*b*.

In the measuring and detecting operation, the edge positions P1 and P2 of the rear fillet 318*b*, the width W1 of the bag body 316*a*, and the width W2 of the rear fillet 318*b* are obtained. According to those, a control is effected to obtain the distance W3 between the left-side edge of the bag body 316*a* and the left-side edge of the rear fillet 318*b* as viewed in the feeding direction X, and the distance W4 between the right-side edge of the bag body 316*a* and the right-side edge of the rear fillet 318*b*. The bendback position of the rear fillet 318*b* is calculated on the basis of the obtained data.

Then the chucks 333*a* and 334*a* of the six-axis multi-joint robots 333 and 334 are moved forwards from the retracted position, and in FIG. 44B, clamp lateral edge portions of the rear fillet 318*b*. After this, the chuck moving arms 333*b* and 334*b* are swung about the axis Z1 in such a manner that the chucks 333*a* and 334*a* are rotated without twisting the lateral edge portions. The chucks 333*a* and 334*a* are moved toward the bendback positions P5 and P6 of the rear fillet 318*b*. In addition, the chucks 333*a* and 334*a* are moved in over-stroke movement to points farther than the bendback positions P5 and P6. The over-stroke movement can fit the portion of the folding position on ends of the cover-fitted sheet stack 316.

After bending back the rear fillet 318*b*, the retention mechanisms 335 are actuated to press the pressure plate 361 down against the rear fillet 318*b*. After the pressing, the chucks 333*a* and 334*a* are opened and released, and moved to the retracted position. Again, the packaging bag is electrically photographed. This is for the purpose of measuring the edge position of the front fillet 318*a* and the bendback position. The photoelectric detection for the two times is effective in preventing failure. If all the data are measured after one time of detection, the edge position of the front fillet 318*a* is likely to change due to movement of the packaging bag 318 upon bending back the rear fillet 318*b*. However, such failure in the measurement can be avoided according to the embodiment, so that no error occurs in clamping the lateral edge.

According to the picking up of the second time, the edge positions P3 and P4 of the front fillet 318*a* and the size L2 of the front fillet 318*a* are calculated. The width W5 of the front fillet 318*a* is regarded as equal to the width W2 of the rear fillet 318*b* calculated in the picking up of the first time.

After the calculation, the chucks 333*a* and 334*a* are shifted to the edge position of the front and rear fillets 318*a* and 318*b*. See FIG. 45A. Lateral ends of the front fillet 318*a* are clamped by the chucks 333*a* and 334*a*. The chuck moving arms 333*b* and 334*b* are swung about the axis Z2 in an arc shape while the chucks 333*a* and 334*a* are kept from twisting the lateral edges. The chucks 333*a* and 334*a* come to the bendback positions P7 and P8 of the front fillet 318*a*. The swing is in the manner of over-stroke movement. So the chucks 333*a* and 334*a* are moved to a farther position than the bendback position by an amount D3. Therefore, the front fillet 318*a* is folded back on to the rear fillet 318*b*.

After the front fillet 318*a* is folded, the sticker holder 337*a* is moved to the attachment ready position with the edges clamped by the chucks 333*a* and 334*a*, the attachment ready position having been obtained according to the bendback position of the front fillet 318*a*. The sticker holder 337*a* is moved down at a predetermined amount, attaches the sticker 365 between the edge of the front fillet 318*a* and the rear fillet 318*b* lying under the same. The front and rear fillets 318*a* and 318*b* are fastened together. After this, the chucks 333*a* and 334*a* are opened and released, and moved back to the retracted position. The retention mechanisms 335 are released and discontinue pressing, before the centering mechanism 332 is also released to discontinue the centering operation.

After releasing the centering mechanism 332, the packaging bag 318 is conveyed to the inspection section. At first, an offset state is inspected in the offsetting inspection. For the offsetting inspection, a maximum length of the offsetting between the front and rear fillets 318*a* and 318*b* in the width direction is measured, and compared with a reference size. It is checked whether the sheet package is acceptable according to a result in that the maximum length is lower than the reference size. After this, tightness of the package is inspected in the tightness inspection. The front and rear fillets 318*a* and 318*b* are raised after attachment of the sticker 365. A maximum length of the gap is measured between the bag body 316*a* and the front and rear fillets 318*a* and 318*b*, and compared with a reference size. It is checked whether the sheet package is acceptable according to a result in that the maximum length is lower than the reference size. Finally, the appearance of the package is inspected in the appearance inspection. Surface defects of any of various types are checked in the packaging bag 318, such as wrinkles, scratches, pinholes or the like. The sheet package detected acceptable for all the items is placed on a pallet one over another, and then transferred to a station for shipment. A sheet package, if unacceptable, is eliminated from the producing line.

Results of the measurement in the inspection of offsetting and tightness are sent and written to the inspection data memory 366 for each of the types of the packaging bag 318. The compensation circuit 367 reads the inspection data from the inspection data memory 366, and also reads the measured result data from the measured data memory 355 according to the inspection data to specify the type of the packaging bag 318. At the same time, results of the inspection is obtained from the inspecting process. In view of those various information, compensation amounts for the bend-back positions of the front and rear fillets 318*a* and 318*b* are calculated, and are sent to the robot control unit 338 in a feedback manner. Therefore, the folding operation of the fillets can be precise reliably.

Figure 47:
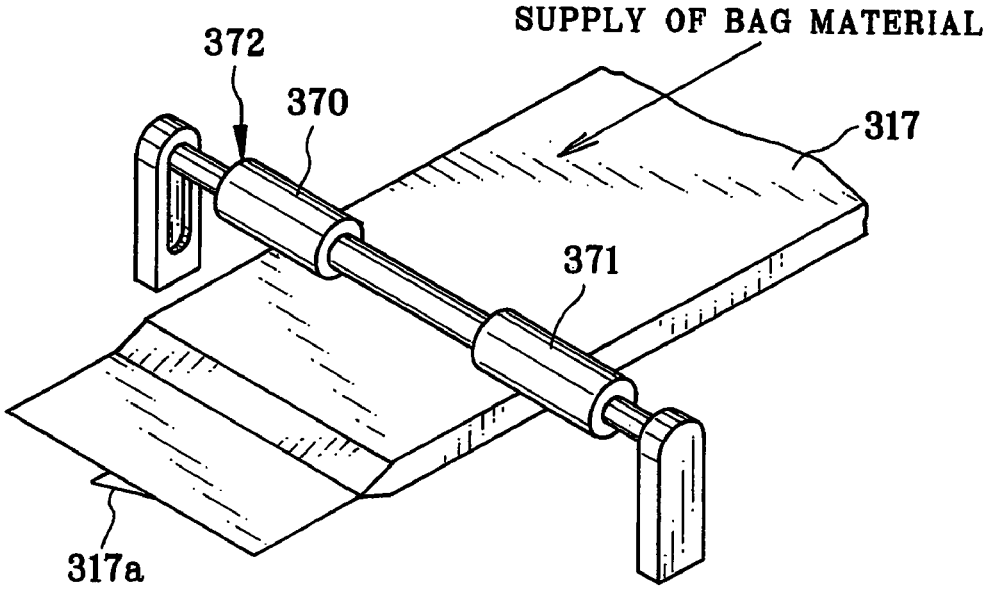
FIG. 47 is a perspective illustrating another preferred embodiment in which two roller portions in a heating roller have a greater diameter.

In the above embodiment, the heating roller 327 in FIG. 35 has a constant diameter and has a long shape. In FIG. 47, another preferred heating roller 372 is depicted, which has a central shaft, and two roller portions 370 and 371 having a greater diameter than the central shaft. The roller portions 370 and 371 pressurize and heat the packaging bag material 317, and provides the same with lateral folds formed tightly. A center seal 317*a* can be protected, because the heating roller 372 does not pressurize or heat a middle position of the packaging bag material 317.

Figure 48:
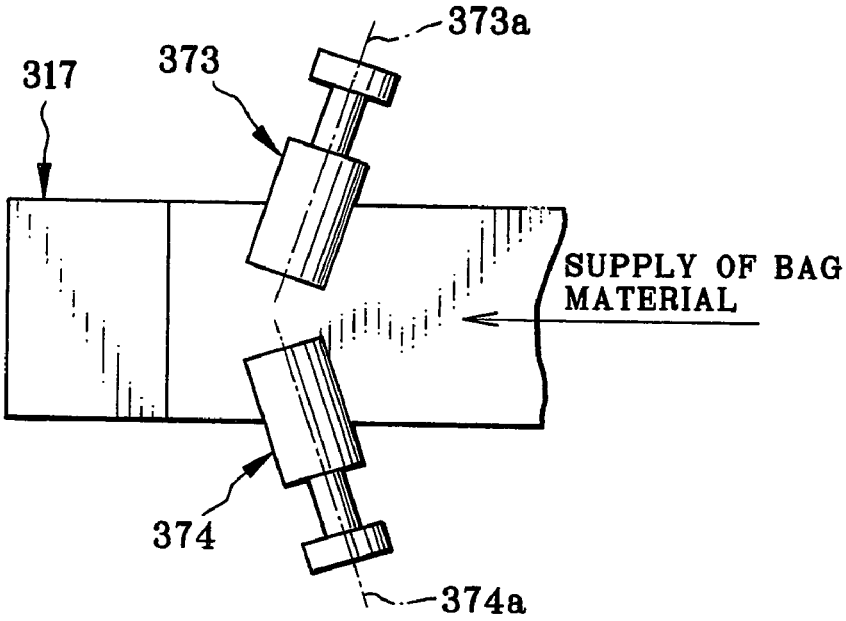
FIG. 48 is an explanatory view in plan illustrating a preferred embodiment in which a pair of heating rollers are disposed with inclinations.
Figure 49:
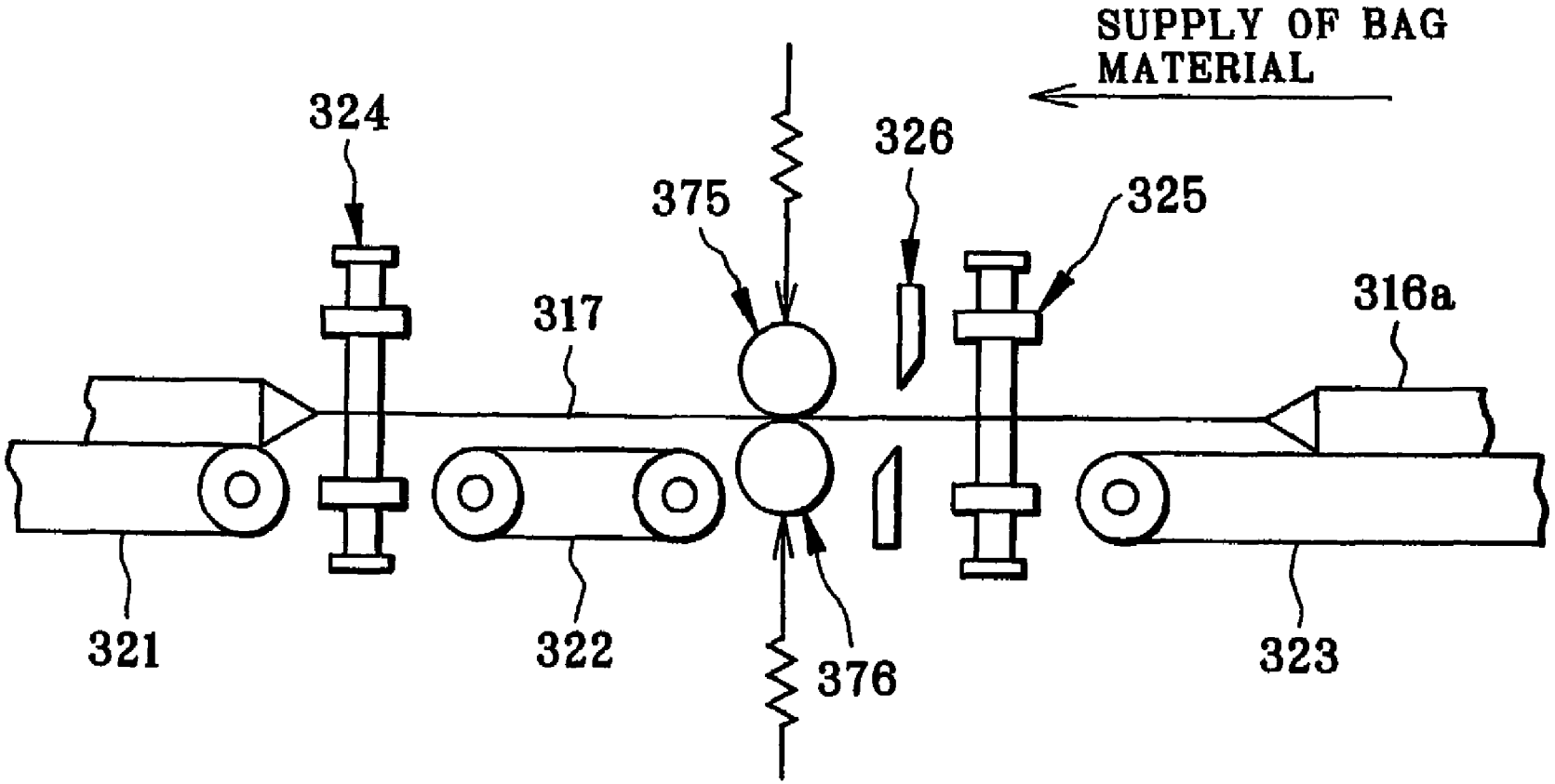
FIG. 49 is an explanatory view in elevation illustrating a preferred embodiment in which a pair of heating rollers nip a packaging bag.

In FIG. 48, an embodiment having a first heating roller 373 and a second heating roller 374 is illustrated. The first and second heating rollers 373 and 374 are disposed at lateral edges of the bag body to form tight folds to the packaging bag material 317. A roller shaft 373*a* for the first heating roller 373 is inclined so that its distal end is directed in the downstream direction. A roller shaft 374*a* for the second heating roller 374 is inclined similarly. In other words, the roller shafts 373*a* and 374*a* are arranged in a V-shape as viewed in the upstream direction. This is effective in applying tension to the packaging bag material 317 in a direction from the center line toward each of the lateral edges. The packaging hag material 317 can be prevented from being loose. In FIG. 49, another preferred embodiment is depicted, in which a first heating roller 375 is opposed to a second heating roller 376. The first and second heating rollers 375 and 376 squeeze the packaging bag material 317 for heating and pressurization in the feeding path. This squeezing structure is advantageous in forming the folds in a regularized and stable manner.

Figure 50:
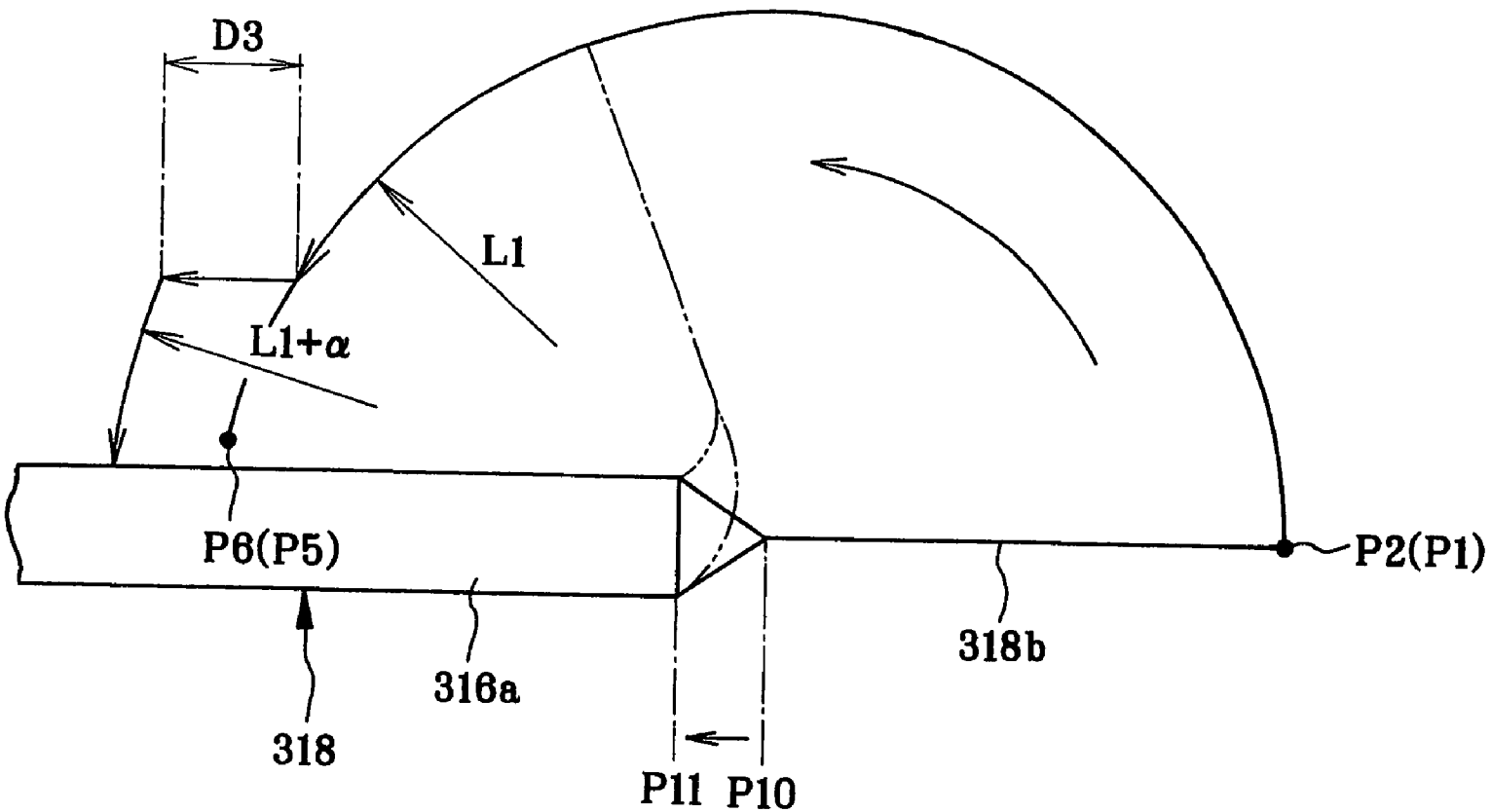
FIG. 50 is an explanatory view in elevation illustrating another preferred embodiment in which movement with the over-stroke is effected after a first portion of a rotational movement and before a second portion of the rotational movement.

In the above embodiment, the over-stroke movement for tight bending is after the front and rear fillets 318*a* and 318*b* are moved to the bendback position. However, the over-stroke movement may be effected at the time when the front and rear fillets 318*a* and 318*b* are disposed short of the bendback position. According to a preferred embodiment, a path of movement of the chucks 333*a* and 334*a* with the over-stroke movement is in a shape larger than a shape of an arc-shaped path of movement of the chucks 333*a* and 334*a* in the above embodiment. In FIG. 50, the chucks 333*a* and 334*a* are moved initially along an arc-shaped path about the bendback position at a radius of L1. When the chucks 333*a* and 334*a* move by more than half an angle defined by the arc-shaped path, the chucks 333*a* and 334*a* are shifted horizontally by the amount D3. After this, the chucks 333*a* and 334*a* are swing on a path of a concentric arc having a radius of (L1+α).

EXAMPLES

Sizes of the sheets or X-ray film are described now. In the following, the values of the sizes are indicated in the order of width, length and thickness and in the unit of millimeter.

| | |
|---|---|
| 8 × 10-inch size: | 201 × 252 × 30–32 |
| B4 size: | 257 × 364 × 30–32 |
| DK size: | 354 × 354 × 20–22 |
| H-size: | 354 × 430 × 20–22 |

The sizes L1 and L2 of the front and rear fillets 318*a* and 318*b* according to various types of X-ray films are as follows:

| | |
|---|---|
| 8 × 10-inch size: | L1 = 200 mm, L2 = 150 mm |
| B4 size: | L1 = 270 mm, L2 = 190 mm |
| DK size: | L1 = 305 mm, L2 = 150 mm |
| H-size: | L1 = 305 mm, L2 = 150 mm |

Note that the fillet sizes L1 and L2 can be varied according to sizes of sheet stacks.

The temperature for the heating roller for forming the tight folds is described now. Should the temperature be 70° C. or lower, tightness of the folds is insufficient. Should the temperature be 90° C. or higher, unwanted pseudo adhesion starts at the folds. It is concluded that a value of the temperature can be in a preferable range of 70-90° C., and desirably 80° C. A pressure to be applied can be in a preferable range from 7 kgf to 20 kgf inclusive of weight of the heating roller and weight applied by remaining parts in connection with the heating roller. A preferable speed of feeding of the conveyor in the course of heating is in a range of 9-12 m/min.

The force applied to the front and rear fillets 318*a* and 318*b* by the over-stroke movement may be in a preferable range of 1 kgf or lower, and can desirably be 600 gf in a manner irrespective of the film size on the condition of the packaging bag material 317 of the thermoplastic material.

In the offsetting inspection, the tolerable highest amount of offsetting of the front and rear fillets in the width direction is determined 7 mm in a manner irrespective of the sizes of the sheets. In the tightness inspection, the tolerable highest size of the gap between the bag body and the front and rear fillets is determined 25 mm.

In the above embodiments, X-ray films are produced. However, a producing system of the present invention may produce photographic film of a general type, thermosensitive film, heat development type of film, and any type of recording sheets. In the above embodiments, the multi-joint robots are used. However, a pair of combined mechanisms to move the two chucks may be used for straight movement in three directions of X, Y and Z-coordinates in a three-dimensional system.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A fillet folding device for a packaging bag including a bag body for wrapping a sheet stack including plural stacked sheets, and front and rear fillets, formed to protrude forwards and backwards from said bag body, for being folded back on an outside of said bag body, to tighten a wrapped state of said packaging bag, said fillet folding device comprising:

a conveyor for feeding said packaging bag forwards in a feeding direction;

a centering mechanism, supplied with said packaging bag by said conveyor, for centering said packaging bag by pressing first and second sides thereof with reference to a crosswise direction crosswise to said feeding direction;

a pair of chucks, arranged in said crosswise direction, for clamping first and second end portions of a first fillet selected from said front and rear fillets;

a chuck moving mechanism for moving said pair of said chucks in synchronism, to fold said first fillet, said first fillet thereby extending and being kept from twisting; and a position detector for detecting an edge position of said first fillet after operation of said centering mechanism;

wherein before clamping of said pair of said chucks, said chuck moving mechanism sets said pair of said chucks at said first and second end portions of said first fillet according to said edge position being detected.

2. The fillet folding device as defined in claim 1, further comprising a position calculating unit for calculating a bendback position of said first fillet according to said edge position being detected, wherein said chuck moving mechanism moves said pair of said chucks according to said bendback position.

3. The fillet folding device as defined in claim 2, further comprising a control unit for controlling said chuck moving mechanism, and for initially swinging said pair of said chucks at a first radius adapted to movement to said bendback position, to bend back said first fillet, wherein then said control unit moves said pair of said chucks in said feeding direction farther than said bendback position by a predetermined over-stroke, to tighten a bending state relative to said sheet stack by pulling said first fillet.

4. The fillet folding device as defined in claim 2, further comprising a control unit for controlling said chuck moving mechanism, and for initially swinging said pair of said chucks at a first radius adapted to movement to said bendback position, wherein:

then said control unit moves said pair of said chucks with a predetermined over-stroke, to tighten a bending state relative to said sheet stack by pulling said first fillet; and then said control unit swings said pair of said chucks at a second radius determined by combining said first radius with said over-stroke, to fold back said first fillet farther than said bendback position.

5. The fillet folding device as defined in claim 2, further comprising at least one heating roller, actuated before operation of said position detector, for heating and pressurizing first and second end portions of said packaging bag, to provide said packaging bag with tight lateral folds.

6. The fillet folding device as defined in claim 5, wherein said heating roller comprises:

a roller shaft; and first and second roller portions, secured to said roller shaft, arranged in said crosswise direction, for heating said first and second end portions of said packaging bag.

7. The fillet folding device as defined in claim 5, wherein said at least one heating roller comprises first and second heating rollers, disposed to extend in said crosswise direction, for heating said first and second end portions of said packaging bag.

8. The fillet folding device as defined in claim 7, further comprising first and second roller shafts for supporting respectively said first and second heating rollers, said first and second roller shafts being inclined downstream in said feeding direction in a direction toward a central portion of said packaging bag.

9. The fillet folding device: as defined in claim 5, wherein said at least one heating roller comprises first and second heating rollers for nipping said packaging bag between.

* * * * *